US012392494B2

(12) United States Patent
Crowe

(10) Patent No.: US 12,392,494 B2
(45) **Date of Patent: *Aug. 19, 2025**

(54) MODULAR ASSEMBLY FOR ELECTRIC FIREPLACE

(71) Applicant: Greentouch USA, Inc., Miami, FL (US)

(72) Inventor: Matthew Alfred Crowe, Dongguan (CN)

(73) Assignee: Greentouch USA, Inc., Miami Beach, FL (US)

( * ) Notice: Subject to any disclaimer, the term of this patent is extended or adjusted under 35 U.S.C. 154(b) by 319 days.

This patent is subject to a terminal disclaimer.

(21) Appl. No.: 17/824,468

(22) Filed: May 25, 2022

(65) Prior Publication Data

US 2022/0290866 A1 Sep. 15, 2022

Related U.S. Application Data

(63) Continuation-in-part of application No. 17/474,852, filed on Sep. 14, 2021, now Pat. No. 11,867,409, and (Continued)

(51) Int. Cl.
*F24C 7/00* (2006.01)
*F24H 3/02* (2022.01)
(Continued)

(52) U.S. Cl.
CPC ..... *F24C 7/004* (2013.01); *F24H 3/022* (2013.01); *F24H 9/02* (2013.01); *F24H 9/2071* (2013.01)

(58) Field of Classification Search
CPC . F24C 3/006; F24C 7/004; F21S 10/04; F21S 10/043; F21S 10/046;
(Continued)

(56) References Cited

U.S. PATENT DOCUMENTS 2,486,517 A * 11/1949 Casali ..... F24B 1/198 312/204
3,006,742 A 10/1961 Brown et al.
(Continued)

FOREIGN PATENT DOCUMENTS

CN 108036389 A 5/2018
CN 110657484 A 1/2020
(Continued)

OTHER PUBLICATIONS

Provisional Opinion Accompanying The Partial Search Result issued by the International Searching Authority, EPO, dated Jan. 26, 2021, for PCT Application Serial No. PCT/US2020/052486.
(Continued)

*Primary Examiner* — David R Dunn
*Assistant Examiner* — Christopher E Veraa
(74) *Attorney, Agent, or Firm* — ROEDER & BRODER LLP; Steven G. Roeder

(57) ABSTRACT

An electric fireplace (1210) includes a fireplace housing (412) and a heater assembly (1226) that is configured to generate heated air. The heater assembly (1226) is configured to be installed substantially within the fireplace housing (412). In various embodiments, the heater assembly (1226) includes a heater body (1245), and a grill cover (1248) that is couplable to the heater body (1245). The grill cover (1248) includes a cover body (1295) that is couplable to the heater body (1245), and at least one extender (1296) that is configured to be positioned substantially adjacent to the cover body (1295). The cover body (1295) has a first cover length. The cover body (1295) and the at least one extender (1296) cooperate to have a second cover length that is greater than the first cover length. The second cover length is substantially equal to a dimension of the fireplace housing (412).

20 Claims, 34 Drawing Sheets

Related U.S. Application Data a continuation-in-part of application No. 16/714,310, filed on Dec. 13, 2019, now Pat. No. 11,619,390.

(60) Provisional application No. 63/192,784, filed on May 25, 2021, provisional application No. 62/905,077, filed on Sep. 24, 2019.

(51) Int. Cl.
*F24H 9/02* (2006.01)
*F24H 9/20* (2022.01)

(58) Field of Classification Search
CPC .... F24D 19/1096; F24B 1/1808; F24B 1/185; F21W 2131/307; H05B 3/008
See application file for complete search history.

(56) References Cited

U.S. PATENT DOCUMENTS 3,216,774 A * 11/1965 Leonard ..... A47B 81/00 312/204
3,742,189 A 6/1973 Conroy et al.
4,272,908 A 6/1981 Bassetti et al.
4,932,224 A * 6/1990 Katterhenry ..... F25D 23/10 312/236
5,839,427 A 11/1998 Shorts
6,162,047 A 12/2000 Hess
7,300,179 B1 11/2007 LaDuke
D616,977 S 6/2010 Asofsky et al.
7,826,727 B2 11/2010 Bourne
D654,995 S 2/2012 Asofsky et al.
D654,996 S 2/2012 Asofsky et al.
D658,749 S 5/2012 Crowe et al.
D658,750 S 5/2012 Nemes
D666,281 S 8/2012 Nemes
D668,748 S 10/2012 Asofsky et al.
D687,136 S 7/2013 Nemes
D687,137 S 7/2013 Nemes
D687,937 S 8/2013 Nemes
D694,380 S 11/2013 Crowe et al.
D694,873 S 12/2013 Nemes et al.
8,739,439 B2 6/2014 Asofsky et al.
D738,477 S 9/2015 Nemes et al.
9,310,097 B2 4/2016 Harley et al.
9,395,100 B2 7/2016 Crowe et al.
9,459,010 B2 10/2016 Asofsky et al.
9,476,596 B2 10/2016 Asofsky et al.
10,247,375 B1 * 4/2019 Lu ..... F21S 10/043
10,274,188 B2 4/2019 Sculler
10,473,335 B2 11/2019 Nemes et al.
10,845,090 B2 11/2020 Crowe
10,883,722 B2 1/2021 Crowe
11,026,458 B2 6/2021 Crowe
D931,430 S 9/2021 Schafer
D931,431 S 9/2021 Schafer et al.
11,659,928 B2 * 5/2023 Miller ..... A47B 96/201 312/204
2002/0152655 A1 10/2002 Merrill et al.
2002/0166554 A1 11/2002 Berg
2003/0126775 A1 7/2003 Corry
2004/0173202 A1 9/2004 Lyons et al.
2004/0264949 A1 12/2004 Deng
2006/0191529 A1 8/2006 McDonald
2006/0230656 A1 10/2006 Spengler
2006/0242870 A1 11/2006 Atemboski
2007/0107280 A1 5/2007 Stinson et al.
2007/0221204 A1 9/2007 Hussong et al.
2007/0221206 A1 9/2007 Phillips et al.
2008/0013931 A1 1/2008 Bourne
2008/0083404 A1 4/2008 Rappold
2008/0143219 A1 * 6/2008 Free ..... A47B 81/064 312/204
2008/0164787 A1 7/2008 Peng
2008/0181587 A1 7/2008 Patil
2008/0181588 A1 7/2008 Gorby
2008/0216818 A1 9/2008 Rumens
2009/0126241 A1 * 5/2009 Asofsky ..... F24C 7/004 348/744
2009/0205633 A1 8/2009 Hussong
2009/0220221 A1 9/2009 Zhou
2010/0043775 A1 2/2010 Phillips et al.
2010/0229849 A1 9/2010 Asofsky et al.
2010/0326421 A1 12/2010 Atemboski
2011/0080261 A1 4/2011 Asofsky et al.
2011/0286725 A1 11/2011 O'Toole
2012/0048841 A1 3/2012 Asofsky et al.
2012/0155075 A1 6/2012 Asofsky et al.
2013/0328686 A1 12/2013 Nemes
2013/0330485 A1 12/2013 Crowe
2014/0044423 A1 2/2014 Chu
2014/0161425 A1 6/2014 Harley et al.
2014/0161426 A1 6/2014 Crowe et al.
2014/0326794 A1 * 11/2014 Frank ..... F24F 11/523 236/51
2015/0131275 A1 5/2015 Robl
2015/0139629 A1 5/2015 Crowe et al.
2017/0051920 A1 2/2017 Lenz
2017/0089587 A1 3/2017 Nemes et al.
2017/0122550 A1 5/2017 Sculler
2017/0211814 A1 7/2017 Bourne et al.
2017/0261212 A1 9/2017 Tao
2017/0328575 A1 11/2017 Crowe
2017/0363320 A1 12/2017 Crowe
2018/0149323 A1 5/2018 Goetz
2018/0299086 A1 10/2018 Gallo et al.
2018/0347818 A1 12/2018 Birnbaum
2018/0347820 A1 12/2018 Bourne et al.
2020/0072470 A1 3/2020 Nemes et al.
2021/0372627 A1 12/2021 Walker
2022/0299209 A1 * 9/2022 Jones ..... A47B 97/00

FOREIGN PATENT DOCUMENTS

GB 2265555 A 9/1993
GB 2321961 A 8/1998
GB 2408569 A 6/2005

OTHER PUBLICATIONS

International Search Report and Written Opinion issued by the International Searching Authority, EPO, dated May 10, 2021, for PCT Application Serial No. PCT/US2020/052486.
Office Action issued by the U.S. Patent Office in U.S. Appl. No. 17/581,100 on Jun. 28, 2022.
Office Action issued by the U.S. Patent Office in U.S. Appl. No. 16/714,310 on Jun. 29, 2022.
International Search Report and Written Opinion issued in PCT Application Serial No. PCT/US22/30902, by the European Patent Office on Oct. 25, 2022. (Related matter).
Office Action issued in U.S. Appl. No. 16/714,310, by the U.S. Patent Office on Nov. 28, 2022.
Final Rejection issued in U.S. Appl. No. 17/581,100, by the U.S. Patent Office on Nov. 28, 2022.
International Preliminary Report on Patentability, issued by the International Bureau in PCT Application Serial No. PCT/US2022/030902, dated Nov. 23, 2023.

* cited by examiner

MODULAR ASSEMBLY FOR ELECTRIC FIREPLACE

RELATED APPLICATIONS

This application claims priority on U.S. Provisional Patent Application Ser. No. 63/192,784, entitled "MODULAR ASSEMBLY FOR ELECTRIC FIREPLACE", filed on May 25, 2021. As far as permitted, the contents of U.S. Provisional Patent Application Ser. No. 63/192,784 are incorporated in their entirety herein by reference. Additionally, this application is a Continuation-in-Part Application and claims the benefit under 35 U.S.C. 120 on co-pending U.S. patent application Ser. No. 17/474,852, filed on Sep. 14, 2021, and entitled "MODULAR ASSEMBLY FOR ELECTRIC FIREPLACE"; and this application is also a Continuation-in-Part Application and claims the benefit under 35 U.S.C. 120 on co-pending U.S. patent application Ser. No. 16/714,310, filed on Dec. 13, 2019, and entitled "MODULAR ASSEMBLY FOR ELECTRIC FIREPLACE". Further, U.S. patent application Ser. No. 16/714,310 claims priority on U.S. Provisional Patent Application Ser. No. 62/905,077, entitled "MODULAR ASSEMBLY FOR ELECTRIC FIREPLACE", filed on Sep. 24, 2019. As far as permitted, the contents of U.S. patent application Ser. Nos. 17/474,852 and 16/714,310, and U.S. Provisional Patent Application Ser. No. 62/905,077 are incorporated in their entirety herein by reference.

BACKGROUND

Fireplaces of various types can be installed in homes and commercial establishments as a means to provide a source of heat and for aesthetic reasons. Although traditionally such fireplaces have most often taken the form of wood-burning fireplaces and gas-burning fireplaces, electric fireplaces have become increasingly popular in recent years. An electric fireplace is typically designed to look like a traditional wood-burning fireplace, but does not actually burn wood. As such, there is a continuing desire to make electric fireplaces look more realistic, i.e. to make electric fireplaces look more like a traditional wood-burning fireplace.

Unfortunately, in currently available electric fireplaces, mantel and/or insert portions, which commonly contain a fireplace housing, a grate, simulated logs, a heater, a flame generator and a glass frame, typically comes completely assembled and wired, and thus takes up a lot of space for packaging, shipping and storing. Additionally, since such inserts typically come already assembled, such currently available electric fireplaces also do not generally allow for substantial variability for the consumer in terms of the overall size, shape, design and aesthetic appearance of the electric fireplace.

FIG. 16A is a simplified side view illustration of a prior art embodiment of an electric fireplace 1610P and a cabinet assembly 1611B, and a package assembly 1682P that can be utilized to contain the electric fireplace 1610P and the cabinet assembly 1611P. The package assembly 1682P is illustrated as being substantially transparent in FIG. 16A so that the electric fireplace 1610P and the cabinet assembly 1611B can be seen as packaged within the package assembly 1682P. As shown in this prior art embodiment, the electric fireplace 1610P is fully assembled within the package assembly 1682P, which is how prior art electric fireplaces are packaged, shipped and stored, and arrive to the consumer.

As shown in FIG. 16A, with a standard-sized cabinet assembly 1611B, which can be packaged in an unassembled configuration, and the fully assembled electric fireplace 1610P, in certain embodiments, the package assembly 1682P can have an assembly length 1682L of between approximately 1065 millimeters (approximately 42 inches) and 1525 millimeters (approximately 60 inches). In one embodiment, the package assembly 1682P can have an assembly length 1682L of approximately 1310 millimeters (approximately 51.5 inches).

FIG. 16B is a simplified end view illustration of the prior art electric fireplace 1610P, cabinet assembly 1611B and package assembly 1682P illustrated in FIG. 16A. The package assembly 1682P is again illustrated as being substantially transparent in FIG. 16B so that the electric fireplace 1610P and the cabinet assembly 1611B can be seen as packaged within the package assembly 1682P. As shown in FIG. 16B, in some embodiments, the package assembly 1682P can have an assembly width 1682W of between approximately 380 millimeters (approximately 15 inches) and 560 millimeters (approximately 22 inches). In one embodiment, the package assembly 1682P can have an assembly width 1682W of approximately 470 millimeters (approximately 18.5 inches).

Additionally, FIG. 16B further illustrates that in certain embodiments, the package assembly 1682P can have an assembly height 1682H of between approximately 460 millimeters (approximately 18 inches) and 610 millimeters (approximately 24 inches). In one embodiment, the package assembly 1682P can have an assembly height 1682H of approximately 525 millimeters (approximately 20.75 inches). As shown, the assembly height 1682H of the package assembly 1682P must be sufficiently large to effectively contain the electric fireplace 1610 which is packaged and comes to the consumer fully assembled.

Thus, there is a desire to allow greater variety in the size, shape, design and aesthetic appearance of the electric fireplace for the consumer, while still enabling various product development, packaging, shipping, storing and overall cost efficiencies. Additionally, there is also a desire to enable the consumer to easily and safely connect all electrical components within the electric fireplace.

SUMMARY

The present invention is directed toward an electric fireplace including a fireplace housing and a heater assembly that is configured to generate heated air. The heater assembly is configured to be installed substantially within the fireplace housing. In various embodiments, the heater assembly includes a heater body, and a grill cover that is couplable to the heater body. In various embodiments, the grill cover includes a cover body that is couplable to the heater body, and at least one extender that is configured to be positioned substantially adjacent to the cover body. The cover body has a first cover length. The cover body and the at least one extender cooperate to have a second cover length that is greater than the first cover length. The second cover length is substantially equal to a dimension of the fireplace housing.

In some embodiments, the heater body has a body length; and the first cover length is substantially equal to the body length.

In certain embodiments, the at least one extender is configured to be positioned substantially adjacent to an outer lateral edge of the cover body.

In some embodiments, the grill cover includes two extenders, with one extender positioned substantially adjacent to each of the outer lateral edges of the cover body.

In certain embodiments, the second cover length is at least approximately 100 millimeters greater than the first cover length.

In various embodiments, the electric fireplace further includes a controller including a processor that is coupled to the heater assembly, the controller being configured to control operation of the heater assembly.

In certain embodiments, the electric fireplace also includes one or more simulated logs and a grate that is configured to support the one or more simulated logs. The one or more simulated logs and the grate are configured to be positioned substantially within the fireplace housing.

In some embodiments, the electric fireplace further includes a flame generator that is configured to generate a simulated flame, the heater assembly and the flame generator being installed independently of one another within the fireplace housing.

In various embodiments, the electric fireplace further includes an electrical connection assembly for electrically connecting the heater assembly and the flame generator to a power source, the electrical connection assembly including (i) a first electrical cable assembly that is configured to be electrically coupled at one end to the heater assembly, and electrically coupled at the other end to the power source; and (ii) a second electrical cable assembly that is configured to be electrically coupled at one end to the heater assembly, and electrically coupled at the other end to the flame generator.

In certain embodiments, the first electrical cable assembly includes an AC power cord; and the second electrical cable assembly includes a low voltage cable such as a USB cable or other suitable cable.

In some embodiments, the electric fireplace further includes a downlight light source that is configured to direct light in a downward direction within the fireplace housing to provide a glowing effect for the fireplace housing.

In various embodiments, the electric fireplace further includes a cabinet that defines a structural opening. The fireplace housing and the heater assembly are configured to be independently installed within the structural opening of the cabinet. Additionally, the second cover length is substantially equal to a dimension of the structural opening.

The present invention is further directed toward an electric fireplace including a cabinet that defines a structural opening; and a heater assembly that is configured to generate heated air, the heater assembly being configured to be installed substantially within the structural opening. The heater assembly includes a heater body, and a grill cover that is couplable to the heater body. The grill cover includes a cover body that is couplable to the heater body, and at least one extender that is configured to be positioned substantially adjacent to the cover body. The cover body has a first cover length, and the cover body and the at least one extender cooperate to have a second cover length that is greater than the first cover length. The second cover length is substantially equal to a dimension of the structural opening.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
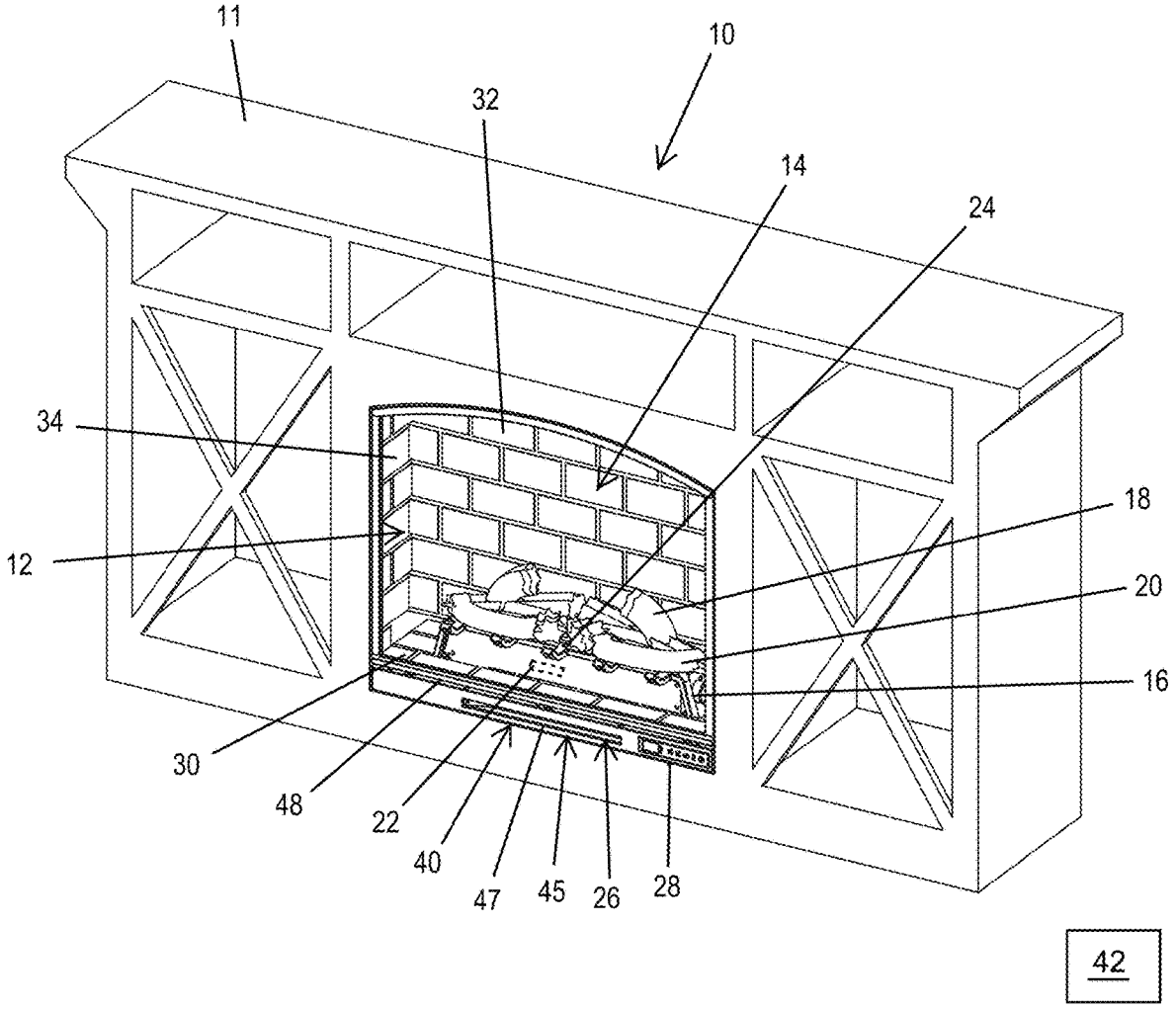
FIG. 1 is a front perspective view illustration of an embodiment of an electric fireplace having features of the present invention.

Embodiments of the present invention are described herein in the context of a modular assembly for an electric fireplace. More particularly, the modular assembly and design for the electric fireplace enables greater flexibility to the consumer for the overall design of the electric fireplace, as well as offering various cost and product development efficiencies. For example, numerous options for different components of the electric fireplace can be incorporated together in any desired manner to provide various alternatives for the consumer in terms of the overall size, shape, design and aesthetic appearance of the electric fireplace. Additionally, in certain embodiments, some of the components of the electric fireplace can be positioned in different locations within the electric fireplace depending on the preferences of the consumer and/or the design of the cabinet in which the electric fireplace is installed. Further, in various embodiments, certain components of the electric fireplace can be interchangeable with other similar, alternative components in order to provide a different overall aesthetic appearance and/or to fit within alternative cabinet assemblies with different sized and/or shaped structural openings. Additionally, in certain embodiments, the components of the electric fireplace can be configured relative to one another so that they can be packaged together much more compactly, which can provide even further cost efficiencies. Still further, in some embodiments, electrical connections for certain components of the electric fireplace can be configured to enable the consumer to easily and safely establish such electrical connections so that power is provided to all such electrical components of the electric fireplace. Yet further, in certain embodiments, the cabinet can also be provided to the consumer in the form of a modular cabinet assembly that is configured to be assembled, along with the electric fireplace, by the consumer.

Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

FIG. 1 is a front perspective view illustration of an embodiment of an electric fireplace 10 having features of the present invention. Additionally, as shown, the electric fireplace 10 is positioned and/or integrated into a cabinet 11 having a structural opening 211A (illustrated more clearly in FIG. 2) that is configured to receive the electric fireplace 10. It is appreciated that the cabinet 11 and/or the structural opening 211A can be of any suitable size, shape and design, which can be different than what is specifically shown in FIG. 1. Thus, the specific size, shape and design of the cabinet 11 and/or the structural opening 211A illustrated in the Figures is not intended to be limiting in any manner. Additionally, it is further appreciated that in some alternative embodiments, the cabinet 11 can also be provided in the form of a modular cabinet assembly 811B (illustrated, for example, in FIG. 8A) that is configured to be assembled by the consumer, prior to and/or in conjunction with the assembly and installation of the electric fireplace 10 within the structural opening 211A of the cabinet 11.

As illustrated herein, the electric fireplace 10 can be used to provide heat and to simulate a wood burning fire, e.g., in a room of a home or other type of building. More particularly, in certain embodiments, the electric fireplace 10 can be configured to look like a traditional wood-burning fireplace, although the electric fireplace 10 does not actually burn wood.

The design of the electric fireplace 10 can be varied. In certain embodiments, as illustrated in FIG. 1, the electric fireplace 10 can include (i) a fireplace housing 12; (ii) a viewing area 14 that is defined within the fireplace housing 12; (iii) a grate 16; (iv) a simulated flame 18 (i.e. which is visible when the electric fireplace 10 is in use); (v) one or more simulated logs 20; (vi) a light source 22 (illustrated as a box in phantom) and/or a simulated flame generator 24 (also sometimes referred to herein simply as a "flame generator") that can be used to selectively generate the simulated flame 18 and/or to create a glowing effect for the simulated logs 20; (vii) a heater assembly 26; and (viii) a controller 28. Additionally, although not specifically shown in FIG. 1, the electric fireplace 10 can further include an electrical connection assembly 249 (illustrated, for example, in FIG. 2) including greatly simplified electrical connections that enable power to be provided to various electrical components of the electric fireplace 10. Alternatively, the electric fireplace 10 can include more components or fewer components than those specifically illustrated in FIG. 1. For example, in one non-exclusive alternative embodiment, the electric fireplace 10 can further include a simulated ember-bed. Still alternatively, the various components of the electric fireplace 10 can be positioned in a different manner than that shown in FIG. 1.

As utilized herein, the fireplace housing 12 is also sometimes referred to generally as a "mantel", and the additional components of the electric fireplace 10 that are selectively positioned within the fireplace housing 12, e.g., during use and/or packaging of the electric fireplace 10, are also sometimes referred to generally as an "insert".

As an overview, in certain embodiments, the electric fireplace 10 is uniquely formed with a modular design such that various components are manufactured and installed independently of one another. Stated in another manner, the electric fireplace 10 can be constructed via a knock/down ("K/D") method, and one or more of the components can be K/D components that can be individually installed by the user or consumer. Moreover, certain components of the electric fireplace 10 can be positioned in different locations within the structural opening 211A of the cabinet 11 to suit the particular desires of the consumer. With such design, the electric fireplace 10 can be constructed by the consumer, i.e. at the consumer level, from the component parts, and need not be constructed at the manufacturer/factory level as is done with typical electric fireplaces. Additionally, with such design, the electric fireplace 10 and the components thereof can be configured to have any suitable size, shape, design and aesthetic appearance depending on the preferences of the consumer. For example, as described herein, the fireplace housing 12 can be formed from multiple individual components (e.g., a base panel 30, a back panel 32, side panels 34 and a front frame 236 (illustrated more clearly in FIG. 2)) of varying designs, sizes and shapes, which can be configured together to fit within structural openings of different sizes and shapes. Additionally, the design of each of the components of the electric fireplace 10 can be mixed and matched as desired. Thus, with the modular design described herein, the consumer is provided with a larger variety of options for the overall design (e.g., size, shape and aesthetic appearance) of the electric fireplace 10, thus enhancing consumer control and happiness, while still enabling various cost and product development efficiencies. Moreover, in some embodiments, the cabinet 11 can also be constructed via a knock/down ("K/D") method, with various components of the cabinet 11 being assembled by the consumer Further, in certain embodiments, some components of the electric fireplace 10, e.g., individual components of the fireplace housing 12 such as the back panel 32 and/or the side panels 34, may be configured to be flexible and/or foldable so as to take up less space when not in use, e.g., during packaging, shipping and/or storage. For example, in such embodiments, the back panel 32 and/or the side panels 34 can be moved between an unfolded configuration, where such components can be substantially planar in their entirety and are ready for installation (or are actually installed in the electric fireplace 10), and a folded configuration, where separate segments of such components can be substantially directly adjacent to one another so that the overall components are substantially flat and with a smaller footprint than such components when in the unfolded configuration. Such a segmented back panel 32 is illustrated and described in relation to FIG. 2.

Still further, as provided herein, various components can be configured to fit together compactly when installed and in use, and/or during packaging, shipping and/or storing of the electric fireplace 10. For example, in some embodiments, as described in greater detail herein below, the heater assembly 26 and the controller 28 can be packaged together into an integrated electrical insert 40, which can be sized and shaped to fit and/or be embedded within a base opening 230A (illustrated in FIG. 2, and also sometimes referred to as a "base aperture)) that is formed into the base panel 30 so that the size of the combined base panel 30 and electrical insert 40 is not much larger than the size of the base panel 30 by itself. In such embodiments, the combined base panel 30 and electrical insert 40 are also sometimes referred to as a "base module". Alternatively, the electrical insert 40, the heater assembly 26 and/or the controller 28 can be positioned in another suitable manner within the cabinet 11.

Thus, with such design, all of the components of the electric fireplace 10 can be provided in a much smaller overall package, e.g., similar to the size of just the fireplace housing 12, which can provide various cost efficiencies for shipping, storing, etc. Stated in another manner, the packaging size of the full electric fireplace 10, i.e. the mantel plus the insert, is roughly the same size as the packaging size for only a typical mantel. It is further appreciated that in embodiments where the cabinet is also assembled via the K/D method, the combined packaging of the cabinet 11 and the electric fireplace 10 can provide even additional cost efficiencies for packaging, shipping, storing, etc. based on the smaller overall packaging that would be required to contain all components of the cabinet 11 and the electric fireplace 10.

Moreover, with the product design as described in detail herein, the various components of the fireplace housing 12, and the electric fireplace 10 in general, can be manufactured independently of one another, and then such components, e.g., the base panel 30, the back panel 32, the side panels 34, the electrical insert 40, the grate 16, the simulated logs 20, etc., can be installed independently of one another at the consumer level.

Yet further, due to the inclusion of the easy-to-use electrical connection assembly 249, the consumer is able to easily and safely establish all necessary electrical connections, e.g., between the electrical insert 40 (the heater assembly 26 and/or the controller 28) and the grate 16 (the light source 22 and/or the flame generator 24), and between the electric insert 40 (the heater assembly 26 and/or the controller 28) and/or the grate 16 and an external power source 42 (illustrated as a box) such as an electrical outlet.

Upon installation of the electric fireplace 10, the fireplace housing 12 can be sized and shaped to retain most, if not all, of the remaining components of the electric fireplace 10. In particular, in many embodiments, the grate 16, the simulated flame 18 (i.e. when the electric fireplace 10 is in use), the one or more simulated logs 20, the light source 22, the flame generator 24, the heater assembly 26 and the controller 28 can be positioned substantially within the fireplace housing 12 once the electric fireplace 10 has been installed and prepared for use. In some embodiments, as shown in FIG. 1, the fireplace housing 12 can be installed and configured to have a substantially rectangular shape. Alternatively, the fireplace housing 12 can be installed and configured to have a different shape depending on the preferences of the consumer and the limitations of the structural opening 211A within which the electric fireplace 10 is being installed.

Further, the fireplace housing 12, and the various individual components thereof, can be formed from any suitable materials. For example, in some embodiments, the fireplace housing 12, and the various individual components thereof, can be formed from any of a number of suitable metallic materials. Alternatively, the fireplace housing 12, and the various individual components thereof, can be formed from any other suitable materials.

The viewing area 14 is the area within the fireplace housing 12 in which the grate 16, the simulated flame 18, the simulated logs 20, and the simulated emberbed (when included) are displayed and can be seen by the user.

As illustrated, the grate 16, i.e. an actual or simulated grate, is configured to support the simulated logs 20 above the base panel 30 of the fireplace housing 12. Additionally, in this embodiment, the grate 16 can be positioned substantially directly above the base module, i.e. the base panel 30 and/or the electrical insert 40.

Further, the grate 16 can also be formed from any suitable materials. For example, in certain non-exclusive alternative embodiments, the grate 16 can be formed from metallic materials such as a welded steel or aluminum material. Alternatively, the grate 16 can be formed from plastic, resin, and/or another suitable material.

As shown in FIG. 1, in various embodiments, the simulated flame 18 is displayed within the viewing area 14 of the electric fireplace 10. The simulated flame 18 is configured to give the electric fireplace 10 a more realistic appearance, i.e. to make the electric fireplace 10 look more like a traditional wood-burning fireplace. The simulated flame 18 can be formed from any suitable method. For example, in various embodiments, the electric fireplace 10 can utilize the light source 22 to illuminate a reflective medium (not shown), e.g., a suitable metal material, to generate the simulated flame 18, i.e. a flickering flame image. Alternatively, the simulated flame 18 can be generated through specific use of the flame generator 24 that is specifically configured to generate the simulated flame 18. Still alternatively, the simulated flame 18 can be generated in another suitable manner.

As noted above, upon installation, the simulated (or artificial) logs 20 can be retained within the fireplace housing 12 and thus positioned within the viewing area 14. Additionally, in certain embodiments, the simulated logs 20 can utilize the light source 22, the flame generator 24 and/or a separate light source to create a glowing effect for the simulated logs 20. Thus, the combination of the simulated logs 20 and the simulated flame 18 can use the light source 22, the flame generator 24 and/or a separate light source to create the appearance of burning logs, thereby closely simulating the flames of a wood-burning fireplace. As illustrated, the simulated logs 20 can further be placed on top of the grate 16. Alternatively, in one embodiment, the simulated logs 20 can be integrally formed with the grate 16.

Additionally, the simulated logs 20 can be formed from any suitable materials. For example, in certain non-exclusive alternative embodiments, the simulated logs 20 can be hollow molded logs that are formed from a molded resin material. Alternatively, the simulated logs 20 can be formed from another suitable material.

In some embodiments, when included as part of the electric fireplace 10, the simulated emberbed can be positioned adjacent to the base panel 30 of the fireplace housing 12 and substantially directly below the grate 16. Additionally, the simulated emberbed can also utilize the light source 22, the flame generator 24 and/or a separate light source to create a glowing effect for the simulated emberbed. It is appreciated that the glowing effect for the simulated emberbed can further enhance the overall look of the electric fireplace 10 to be more like that of a traditional wood-burning fireplace.

Further, the simulated emberbed can be formed from any suitable materials. For example, in certain non-exclusive alternative embodiments, the simulated emberbed can be formed from a molded resin material. Alternatively, the simulated emberbed can be formed from another suitable material.

As noted above, the light source 22 can be configured to assist in the generation of the simulated flame 18, as well as helping to create the glowing effect for the simulated logs 20 and/or the simulated emberbed. Stated in another manner, the light source 22 can be utilized, i.e. selectively activated, for purposes of generating the simulated flame 18, creating a glowing effect for the simulated logs 20, and/or creating a glowing effect for the simulated emberbed.

The light source 22 can have any suitable design. For example, in one non-exclusive alternative embodiment, the light source 22 can include a flat, PCB board upon which is mounted an LED panel having one or more LED light bulbs. It is appreciated that the use of LED light bulbs makes it generally unnecessary to access the light source 22 as the LED light bulbs have a very long, life span and do not need to be regularly replaced. Alternatively, the light source 22 can have another suitable design, e.g., can include other types of light bulbs or another type of light source. Additionally, the light source 22 can be positioned in any suitable manner for purposes of more effectively generating the simulated flame 18, creating a glowing effect for the simulated logs 20, and/or creating a glowing effect for the simulated emberbed, as desired.

In some embodiments, the light source 22 can be incorporated and/or formed into the structure of the grate 16. Thus, with the light source 22 incorporated into the grate 16, additional size and space efficiencies can be achieved. Additionally, with such design, electrical connection to the light source 22 can be provided via the grate 16, e.g., via electrical connection ports coupled to the light source 22 via the grate 16 and electrical connectors that can be coupled into the electrical connection ports. Alternatively, the light source 22 can be provided independently of the grate 16.

Similarly, as noted above, the flame generator 24 can also or alternatively be configured to assist in the generation of the simulated flame 18, as well as helping to create the glowing effect for the simulated logs 20 and/or the simulated emberbed. Stated in another manner, the flame generator 24 can be utilized, i.e. selectively activated, in conjunction with the light source 22 or in lieu of the light source 22, for purposes of generating the simulated flame 18, creating a glowing effect for the simulated logs 20, and/or creating a glowing effect for the simulated emberbed.

In some embodiments, the flame generator 24 can be incorporated and/or formed into the structure of the grate 16. Thus, with the flame generator 24 incorporated into the grate 16, additional size and space efficiencies can be achieved. Additionally, with such design, electrical connection to the flame generator 24 can be provided via the grate 16, e.g., via electrical connection ports coupled to the flame generator 24 via the grate 16 and electrical connectors that can be coupled into the electrical connection ports. Alternatively, the flame generator 24 can be provided independently of the grate 16.

Further, in certain embodiments, the grate 16 and the light source 22 and/or the flame generator 24, as well as the simulated logs 20, can be independent components that can be installed within the structural opening 211A by the user. Still further, in some embodiments, the grate 16 with the light source 22 and/or the flame generator 24, as well as the simulated logs 20, can be provided together and can be positioned on top of the base module, i.e. the base panel 30 and/or the electrical insert 40, during packaging and/or during use of the electric fireplace 10.

Additionally, in some embodiments, the flame generator 24 and/or the light source 22 can be powered through use of the electrical connection assembly 249. For example, in some embodiments, the electrical connection assembly 249 can include an AC connector, or other suitable electrical connector, that is selectively electrically connected to the external power source 42, and a user-friendly, low voltage DC connector that can be selectively electrically connected to and/or between the heater assembly 26 and the grate 16 to provide the necessary power to the flame generator 24 and/or the light source 22. Thus, in some such embodiments, the necessary power is provided to the light source 22 and/or the flame generator 24 indirectly from the external power source 42 via the heater assembly 26. In certain such embodiments, an electrical cable can be utilized to extend through an opening in an insert cover 244 (illustrated in FIG. 2). Further, in some embodiments, the grate 16, with the light source 22 and/or the flame generator 24 incorporated therein, can be connected to the electrical insert 40 with a user-friendly, low voltage connector, e.g., a USB cable assembly, a 3.5 mm jack or other suitable low voltage DC connector. Further, in certain alternative embodiments, the grate 16, with the light source 22 and/or the flame generator 24 incorporated therein, can also be included as part of the base module, e.g., included with the electrical insert 40 that is mounted within base opening 230A formed into the base panel 30. Various embodiments of the electrical connection assembly 249 will be described in greater detail herein below. In certain alternative embodiments, the power to the flame generator 24 and/or the light source 22 can be provided by other than the external power source 42, e.g., from an internal power source or other suitable power source.

As utilized herein, in certain non-exclusive alternative embodiments, a low voltage connector, a low voltage cable and/or a low voltage cable assembly, is one that is configured to carry less than approximately 50 volts, less than approximately 45 volts, less than approximately 40 volts, less than approximately 35 volts, less than approximately 30 volts, less than approximately 25 volts, less than approximately 20 volts, less than approximately 15 volts, less than approximately 10 volts, or less than approximately 5 volts.

It is appreciated that such quick and easy electrical connections possible for the consumer with the electrical connection assembly 249 provide a much more user-friendly experience for the consumer that does not entail hard-wired electrical connections which are typical in previous electric fireplaces. The electrical connection assembly 249, with its unique design, also enables the electrical connections to be easily and safely undertaken by the consumer at the consumer level, rather than being hard-wired at the factory level as occurs in typical electrical fireplaces.

As provided herein, it is appreciated that the light source 22 and the flame generator 24 can be utilized individually or in conjunction with one another for purposes of generating the simulated flame 18 (as well as providing a glowing effect for the simulated logs 20 and/or the simulated emberbed). Accordingly, the light source 22 and the flame generator 24 can sometimes be generally referred to, individually or collectively, as a "flame generator".

The heater assembly 26, e.g., an integrated electric heater assembly, can be configured to provide heated air which can be directed in a generally outward direction away from the electric fireplace 10. More particularly, in certain embodiments, the heater assembly 26 can include a heater body 45, a heat generator 46 and a fan or blower 247 (illustrated in FIG. 2) that are positioned substantially within the heater body 45, and a grill cover 48 that is positioned substantially directly adjacent to and/or is mechanically coupled or secured to the heater body 45. In such embodiments, the heat generator 46 (also referred to as heating elements in certain embodiments) is configured to generate heat, and the blower 247 is configured to blow the heat from the heat generator 46 in the form of hot air through an air outlet (not shown in FIG. 1) formed into the heater body 45 and subsequently through the grill cover 48, e.g., heat vents, into the area surrounding the electric fireplace 10, such as a room in a house, in order to heat such area.

As with the light source 22 and/or the flame generator 24, power for the heater assembly 26 can be provided directly or indirectly to the heater assembly 26 from the external power source 42 or another suitable power source.

In some embodiments, as shown in FIG. 1, the grill cover 48 can be coupled to and/or incorporated into the electrical insert 40 and positioned near and/or adjacent to the base panel 30 of the fireplace housing 12. In such embodiments, the grill cover 48 is so positioned to allow heat to be directed generally upwardly away from the electrical insert 40. Thus, the heated air can be moved into and through the area surrounding the electric fireplace 10, e.g., a room in a house, in order to heat such area. Additionally, with such design and positioning of the heater assembly 26 and/or the grill cover 48, the heat can be projected to rise up at an angle and away from the heater assembly 26 so that it feels more like it is actually emanating from the fire itself.

Alternatively, the heater assembly 26, i.e. the heater body 45 with the grill cover 48 coupled thereto, can be positioned in a different manner, e.g., at or near an upper portion of the fireplace housing 12, or near and/or adjacent to one or both of the side panels 34 of the fireplace housing 12. For example, in one non-exclusive alternative embodiment, the cabinet 11 can include a center shelf 360 (illustrated in FIG. 3A), and the heater assembly 26 and/or the grill cover 48 can be attached to, mounted on and/or positioned substantially adjacent to the center shelf 360 of the cabinet 11. In such alternative embodiment, at least a majority of the components of the electric fireplace 10 will be positioned within the structural opening 211A of the cabinet 11 below the center shelf 360, with the heater assembly 26 being attached to, mounted on and/or positioned substantially adjacent to the center shelf 360 of the cabinet 11 and above the other components of the electric fireplace 10.

Still alternatively, in one embodiment, the heater assembly 26 can include different sizes of grill covers 48 that can be alternatively coupled near a front of the heater body 45, i.e. with one such grill cover 48 being coupled to the front of the heater body 45 at any given time. With such design, the electric fireplace 10, including the heater assembly 26, can be installed in different sized structural openings 211A of the cabinet 11, and can thus provide a different overall aesthetic appearance, without actually changing the size and/or design of the components of the heater assembly 26 other than the grill cover 48, i.e. without changing the size, shape and/or design of the heater body 45. It is appreciated that in certain such embodiments, the grill cover 48 is the only component of the heater assembly 26 that is visible to the consumer when the electric fireplace 10 is completely assembled and installed within the structural opening 211A of the cabinet 11, thus providing the different overall aesthetic appearance for the electric fireplace 10 depending upon which alternative grill cover 48 is being used.

The controller 28 can include one or more circuits or processors that can be utilized to control the various functions of the electric fireplace 10. For example, the controller 28 can be utilized to activate and/or control (i) the intensity of the light source 22 and/or the flame generator 24 within the electric fireplace 10 that generates the simulated flame 18, (ii) the intensity of the light source 22 and/or the flame generator 24 within the electric fireplace 10 that creates the glowing effect for the simulated logs 20, (iii) the intensity of the light source 22 and/or the flame generator 24 within the electric fireplace 10 that creates the glowing effect for the simulated emberbed, (iv) the intensity of the heat generator 46 within the heater assembly 26 to regulate the amount of heat produced by the heater assembly 26, and (v) the speed of the blower 247 within the heater assembly 26 to regulate the velocity of heat being dispersed by the heater assembly 26.

As with the light source 22, the flame generator 24 and/or the heater assembly 26, power for the controller 28 can be provided directly or indirectly to the controller 28 from the external power source 42 or another suitable power source.

In some embodiments, the various electrical components of the electric fireplace 10, e.g., the light source 22, the flame generator 24, the heater assembly 26 and the controller 28, can be packed separately, such as when the electric fireplace 10 and/or the fireplace housing 12 is provided in a K/D mantel configuration. Additionally, in certain embodiments, this portion of the electric fireplace 10 can also be sourced from an electrical factory. However, since these components can be formed as a relatively simple DC module, with no certifications required, these components could also potentially be sourced locally.

Additionally, in this embodiment, with all of the electrical components located embedded within, near and/or adjacent to the base panel 30, such components do not adversely inhibit the desired size and shape of the opening.

It is appreciated that in some implementations, certain electrical components of the electric fireplace 10, e.g., the heater assembly 26 and the controller 28 that combine to form the electrical insert 40, can be fully assembled at the factory level prior to the components being packaged and shipped commercially. Alternatively, some assembly of such electrical components can be done at the consumer level, provided necessary safety requirements can be met.

Figure 2:
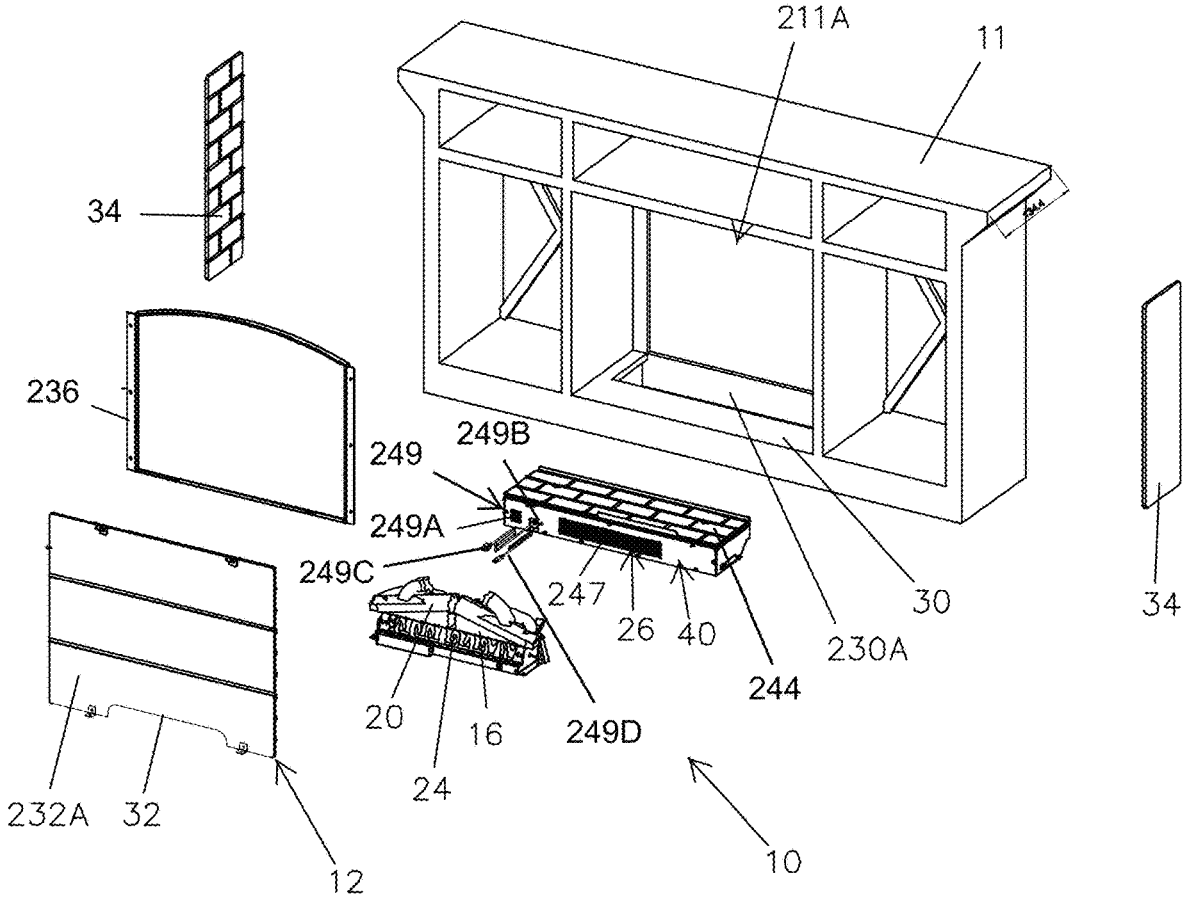
FIG. 2 is a partially exploded rear perspective view illustration of the electric fireplace illustrated in FIG. 1.

FIG. 2 is a partially exploded rear perspective view illustration of the electric fireplace 10 illustrated in FIG. 1. Additionally, FIG. 2 further illustrates the cabinet 11 including the structural opening 211A into which the electric fireplace 10 can be installed. In the condition as shown in FIG. 2, only the base panel 30 of the fireplace housing 12 has so far been installed and/or integrated within the structural opening 211A of the cabinet 11.

As illustrated, FIG. 2 shows that the electric fireplace 10 can include the fireplace housing 12 including the base panel 30 (sometimes also referred to as a "mantel base"), the back panel 32, side panels 34, and the front frame 236, the grate 16, the one or more simulated logs 20, and the electrical insert 40. As described above, in this embodiment, at least the heater assembly 26 and the controller 28 (illustrated in FIG. 1) are incorporated together within the electrical insert 40. Further, it is appreciated that, although not shown in FIG. 2, in some embodiments, the electrical insert 40 can further include and/or incorporate the light source 22 (illustrated in FIG. 1) and/or the flame generator 24. Still further, since FIG. 2 is showing an exploded, and thus non-operational, view of the electric fireplace 10, the viewing area 14 (illustrated in FIG. 1), and the simulated flame 18 (illustrated in FIG. 1) are also not illustrated in FIG. 2.

As noted above, the base panel 30, the back panel 32, the side panels 34 and the front frame 236 can have any suitable design. Additionally, the design, size and shape of the base panel 30, the back panel 32, the side panels 34 and the front frame 236 can be mixed and matched as desired to provide greater flexibility to the consumer for the overall design of the electric fireplace 10. Further, in certain embodiments, one or more of the back panel 32 and the side panels 34 can be flexible and/or foldable such that they take up much less space for purposes of packaging, shipping and storage. More particularly, in such embodiments, one or more of the back panel 32 and the side panels 34 can be movable between an unfolded configuration and a folded configuration. Such movement between the unfolded configuration and the folded configuration is demonstrated herein in relation to FIG. 6I.

One objective of the construction of the electric fireplace 10, as described in detail herein, is to embed the various operational components of the electric fireplace 10 into the components of the fireplace housing 12 to make the combined packaging substantially the same size as a typical packaging of only the fireplace housing 12. For example, as illustrated in FIG. 2, the base panel 30 (or mantel base) can include the base opening 230A (or base aperture) that is configured to receive the electrical insert 40. More particularly, as shown, a lower portion of the electrical insert 40 is sized and shaped to fit and be supported and retained within the base opening 230A that is formed into the base panel 30. Further, as illustrated, the electric fireplace 10 can also include an insert cover 244 that is configured to fit over the electrical insert 40, such that the base panel 30 and the insert cover 244 provide an outer housing for the electrical insert 40 that is positioned compactly therein.

With such design, the bulky components of the heat generator 46 and the motor blower 247 of the heater assembly 26, as retained within the heater body 45, and the controller 28, which are integrated and/or incorporated together within the electrical insert 40, are now positioned to be embedded within the base opening 230A of the base panel 30. This allows for the viewing area 14 (illustrated in FIG. 1) to not be impeded with these bulky components as only the heat outlet, i.e. the grill cover 48 (illustrated in FIG. 1) and/or the insert cover 244, will slightly protrude over the lip of the base panel 30. Further, this also allows for the electrical insert 40 to be pre-assembled into the base panel 30, i.e. into the base opening 230A, at the factory level without impeding packaging efficiency and reducing the level of assembly required at the consumer level.

Additionally or in the alternative, in embodiments where the cabinet 11 includes a center shelf 360 (illustrated in FIG. 3A), and the heater assembly 26, the controller 28 and/or the electrical insert 40 are attached to, mounted on and/or positioned substantially adjacent to the center shelf 360, the electrical insert 40 can still be assembled at the factory level in such manner that it still does not impede packaging efficiency and still helps to reduce the level of assembly required at the consumer level.

The back panel 32 and the side panels 34 can have any suitable design to create any suitable aesthetic appearance. In some embodiments, as shown in FIG. 2, the back panel 32 and/or the side panels 34 can have a brick-like appearance. Alternatively, the back panel 32 and/or the side panels 34 can have another suitable design, e.g., a magnesium oxide or stone façade, or another suitable design. Further, or in the alternative, in certain embodiments, the back panel 32 and/or the side panels 34 can be reversible to provide different options of backdrop style at the user level.

Additionally, in certain such embodiments, the back panel 32 and/or the side panels 34 can be foldable and can be mounted on a segmented substrate. In one such embodiment, as shown in FIG. 2, only the back panel 32 is mounted on a segmented substrate 232A so as to be foldable, i.e. movable between the unfolded configuration and the folded configuration. It is appreciated that such design as shown in FIG. 2 for the back panel 32 can also be used for the side panels 34. It is further appreciated that the maintaining of the portions or segments of the segmented substrates 232A together and selectively foldable within the back panel 32 and/or the side panels 34 can be accomplished in any suitable manner. For example, in one non-exclusive embodiment, the segments are held together with a PVC lamination which can fold at the segments, but which looks like a single part when unfolded. In such embodiment, only the substrate 232A is segmented and not the PVC lamination. Alternatively, the segments of the segmented substrate 232A can be maintained together in another suitable manner. Still alternatively, the back panel 32 and/or the side panels 34 can have a different design than what is shown in FIG. 2.

With such design, despite being foldable, the back panel 32 and/or the side panels 34 can still possess the desired strength, rigidity and sturdiness to help form the fireplace housing 12 for the electric fireplace 10. Additionally, with the back panel 32 and/or the side panels 34 being foldable, it is appreciated that the back panel 32 and/or the side panels 34 can be more compact during shipping and storage.

It is further appreciated that the back panel 32 and the side panels 34 can be built locally at a mantel factory, since there is no need for special construction at a specialized certified manufacturer. Additionally, the back panel 32 and/or the side panels 34 can be K/D parts that are installed independently as part of the fireplace housing 12 (or mantel) which enables increased depth of the fireplace housing 12 to get a larger and/or better flame projection. The noted design also allows the use of back panels 32 with thicker or heavier textures, and/or allows for multiple back panels 32 to be included within a single package. It is appreciated that the back panel 32 and the side panels 34 can be attached to the cabinet 11 within the structural opening 211A in any suitable manner. For example, the back panel 32 and the side panels 34 can be attached to the cabinet 11 within the structural opening 211A with an adhesive, with one or more screws or other connectors, or in another suitable manner. Further, in some embodiments, one or more brackets or other stabilizers can also be used to facilitate the attachment of the back panel 32 and/or the side panels 34 within the structural opening 211A of the cabinet 11.

The front frame 236 can also have any suitable size, shape and design. Further, different sizes, shapes and designs for the front frame 236 can be mixed and matched with any designs for the remainder of the electric fireplace 10 and the fireplace housing 12 as desired. For example, in one non-exclusive embodiment, the front frame 236 can be provided in the form of a single pane of glass or glass doors that are closeable so as to more fully enclose the electric fireplace 10. Additionally, or in the alternative, the front frame 236 can be provided with any suitable aesthetic decorative design aspects so as to provide a more ornate appearance. Still alternatively, the front frame 236 can have another suitable design, e.g., a simple mesh screen or any other suitable design. As such, by simply changing the design of the front frame 236, the overall aesthetic appearance of the electric fireplace 10 can be changed without actually changing a majority of the components that are individually included within the electric fireplace 10.

It is appreciated that with the design noted herein, the front frame 236 can be sourced locally and/or built by the mantel factory. In some embodiments, the front frame 236 can be independently formed and provided, and can be installed by the user. With such design, there are no height or shape restrictions for the structural opening 211A within which the electric fireplace 10 is installed, so there could be several options for oversized openings, curved openings, etc.

As noted above, the electrical insert 40 can include at least the heater assembly 26 and the controller 28 integrally provided therein. Further, as shown in this embodiment, the insert cover 244 can be positioned substantially directly on top of the electrical insert 40. In some embodiments, the insert cover 244 can be utilized to enhance the overall aesthetic appearance of the electric fireplace 10. For example, in one such embodiment, the insert cover 244 can have a brick-like appearance that can be configured to match the design of the back panel 32 and the side panels 34. Alternatively, the insert cover 244 can have another suitable design provided for aesthetic purposes, or the insert cover 244 can be configured with no particular design provided thereon.

Additionally, as shown, the electrical connection assembly 249 can be utilized for providing the necessary power to the electrical insert 40, i.e. the heater assembly 26 and/or the controller 28, and also to one or more of the light source 22 and the flame generator 24. As illustrated in FIG. 2, in some embodiments, the electrical connection assembly 249 can include a first electrical connection port 249A that is formed into the electrical insert 40 (and can thus be said to be electrically coupled to the heater assembly 26 and/or the controller 28), a second electrical connection port 249B that is formed into the electrical insert 40 (and can thus be said to be electrically coupled to the heater assembly 26 and/or the controller 28), a first electrical cable assembly 249C (including a first electrical cable 449C1 (illustrated more clearly in FIG. 4A) and at least one corresponding electrical connector 449C2 (illustrated more clearly in FIG. 4A) coupled at an end of the first electrical cable 449C1), and a second electrical cable assembly 249D (including a second electrical cable 449D1 (illustrated more clearly in FIG. 4A) and at least one corresponding connector 449D2 (illustrated more clearly in FIG. 4A) coupled at an end of the second electrical cable 449D1). Additionally, the electrical connection assembly 249 can further include a third electrical connection port 349E (illustrated in FIG. 3B) that is formed into the grate 16, which can include the light source 22 and/or the flame generator 24 incorporated therein. Thus, the third electrical connection port 349E can be said to be electrically coupled to the light source 22 and/or the flame generator 24. Alternatively, the electrical connection assembly 249 can include more components or fewer components than what is illustrated and described herein. For example, in one non-exclusive alternative embodiment, the electrical connection assembly 249 can include connection ports and/or electrical cable assemblies, e.g., cables and corresponding connectors, to provide direct connections between the electrical insert 40 (or the heater assembly 26 or the controller 28) and the light source 22, and between the electrical insert 40 (or the heater assembly 26 or the controller 28) and the flame generator 24. As utilized herein, an "electrical cable assembly" shall mean and include an electrical cable and at least one electrical connector that is coupled to an end of the electrical cable, or possible two electrical connectors that are coupled at either end of the electrical cable. Each electrical connector can be an electromechanical device that selectively connects the electrical cable to the respective component. For example, each electrical connector can be a male component that selectively plugs into a corresponding female component. A non-exclusive example of a suitable electrical connector is a USB connector.

In certain embodiments, the first electrical cable assembly 249C, e.g., an AC power cord with corresponding connector(s), or other suitable cable assembly, can include an electrical connector 449C2 that is plugged into and/or electrically coupled at one end to the first electrical connection port 249A, and another electrical connector 449C2 that can be electrically connected and/or coupled at the other end to an external power source 42 (illustrated in FIG. 1) such as an electrical outlet, to generally provide power to the electrical insert 40, the heater assembly 26 and/or the controller 28, and thus to the electric fireplace 10 as a whole. Alternatively, in other embodiments, the first electrical cable assembly 249C can be hard-wired into the electrical insert 40 and/or the heater assembly 26, such that the electrical connection assembly 249 can be configured without a specific need for the first electrical connection port 249A to selectively, electrically couple the first electrical cable assembly 249C to the electrical insert 40 and/or the heater assembly 26.

Additionally, in some embodiments, the second electrical cable assembly 249D, e.g., a USB cable with corresponding connector(s) or other similar, low voltage DC electrical cable assembly, can include an electrical connector 449D2 that is plugged into and/or electrically coupled at one end to the second electrical connection port 249B, and another electrical connector 449D2 that can be electrically connected and/or coupled at the other end into the third electrical connection port 349E that is formed into the grate 16, in order to transmit power from the electrical insert 40 to the light source 22 and/or the flame generator 24 which can be incorporated into the grate 16. Alternatively, in other embodiments, the second electrical cable assembly 249D can be hard-wired into the electrical insert 40 and/or the heater assembly 26, such that the electrical connection assembly 249 can be configured without a specific need for the second electrical connection port 249B to selectively, electrically couple the second electrical cable assembly 249D to the electrical insert 40 and/or the heater assembly 26; or the second electrical cable assembly 249D can be hard-wired into the grate 16, the light source 22 and/or the flame generator 24, such that the electrical connection assembly 249 can be configured without a specific need for the third electrical connection port 349E to selectively, electrically couple the second electrical cable assembly 249D to the grate 16, the light source 22 and/or the flame generator 24. With such design, in any such embodiments, the electrical connection assembly 249 is able to provide the necessary power to each of the electrical insert 40, i.e. the heater assembly 26 and the controller 28, the light source 22 and the flame generator 24. Additionally, it is further appreciated that such a simple design enables the consumer to quickly and easily establish such electrical connections so that the electric fireplace 10 can be fully assembled and installed by the consumer to desired design specifications.

Figure 3B:
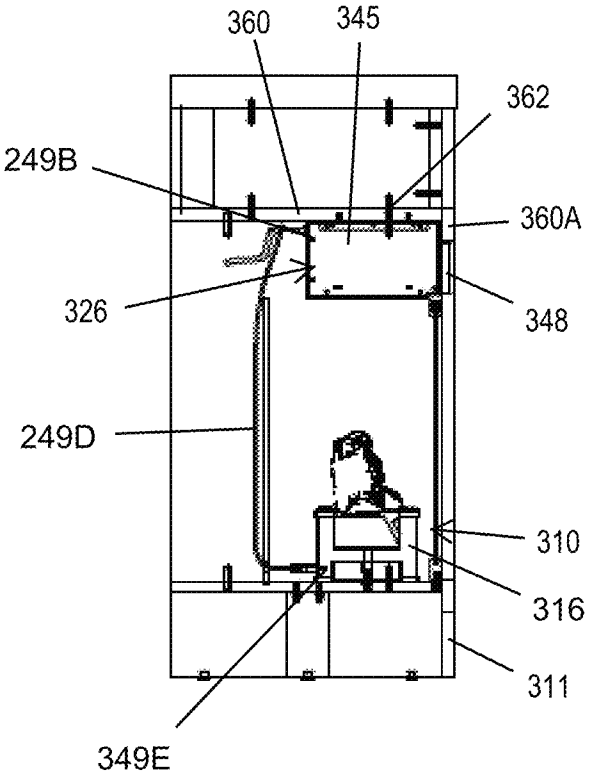
FIG. 3B is a cross-sectional side view illustration of the electric fireplace illustrated in FIG. 3A taken on line B-B.
Figure 3A:
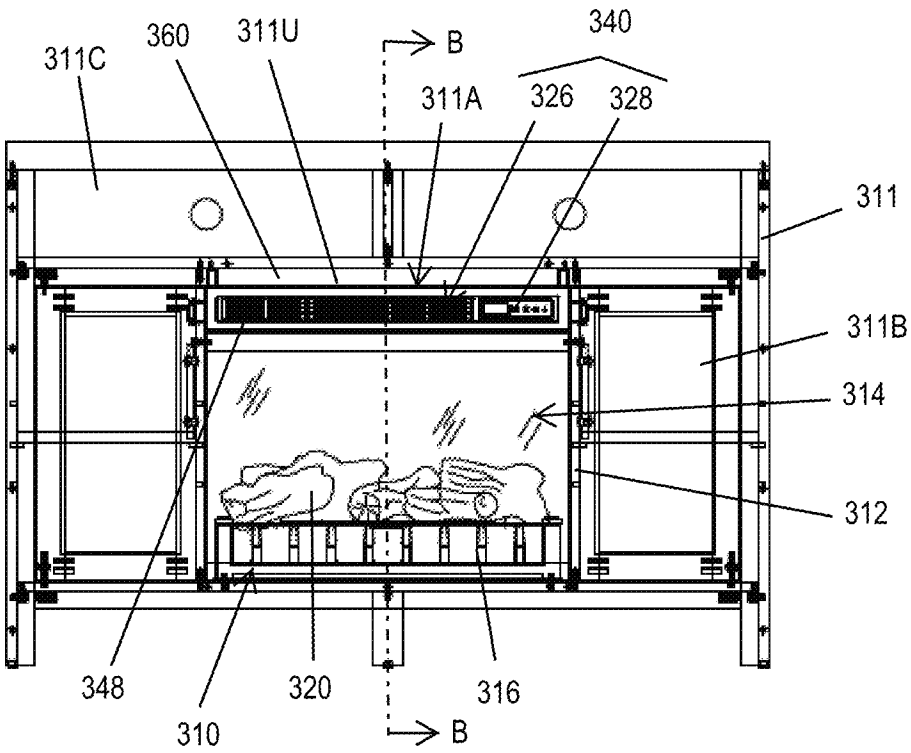
FIG. 3A is a simplified front view illustration of another embodiment of the electric fireplace.

FIG. 3A is a simplified front view illustration of another embodiment of the electric fireplace 310. As shown, the electric fireplace 310 is somewhat similar to the embodiments illustrated and described herein above. For example, as shown, the electric fireplace 310 again includes a fireplace housing 312, a viewing area 314 that is defined within the fireplace housing 312, a grate 316, one or more simulated logs 320, and an electrical insert 340 including a heater assembly 326 and a controller 328 that are similar in design and function to the corresponding components illustrated and described herein above. It is appreciated that the simulated flame, the light source and the flame generator, as shown in the embodiments above, are not visible in FIG. 3A, but would likely be included within the embodiment of the electric fireplace 310 illustrated in FIG. 3A.

However, in this embodiment, the cabinet 311 and the structural opening 311A of the cabinet 311 are somewhat different than the previous embodiments, and the electrical insert 340, including the heater assembly 326 and the controller 328, is positioned within the electric fireplace 310 in a different manner than in the previous embodiments.

As illustrated in the embodiment shown in FIG. 3A, the cabinet 311 can include one or more side storage areas 311B (two are shown in FIG. 3A) that are positioned laterally adjacent to the structural opening 311 for the electric fireplace 310, and one or more drawers 311C (two are shown in FIG. 3A) that are positioned above the structural opening 311A and/or the side storage areas 311B. Additionally, or in the alternative, the cabinet 311 can include more or fewer storage areas 311B, more or fewer drawers 311C, and/or the storage areas 311B and/or the drawers 311C can be positioned within the cabinet 311 in a different manner than what is shown in FIG. 3A.

Additionally, as shown, the cabinet 311 further includes a center shelf 360 that is positioned above the structural opening 311A in which the electric fireplace 310 is installed, and/or which defines at least a portion of an upper side 311U of the structural opening 311A.

Further, in this embodiment, the electrical insert 340, including the heater assembly 326 and the controller 328, is positioned or installed within the fireplace housing 312 and above the grate 316 and the simulated logs 320. Additionally, as shown, the electrical insert 340, including the heater assembly 326 and the controller 328, is positioned or installed substantially and/or directly adjacent to the center shelf 360. More particularly, in the embodiment illustrated in FIG. 3A, the electrical insert 340 is positioned substantially directly beneath the center shelf 360. Moreover, in certain embodiments, the electrical insert 340, the heater assembly 326 and/or the controller 328 can be mechanically coupled to, secured to and/or mounted onto the center shelf 360.

As illustrated, the grill cover 348 of the heater assembly 326 is positioned to face in a generally forward direction so that heat generated by the heater assembly 326 is directed through the grill cover 348 in a generally forward direction away from the electric fireplace 310 and into the area around the front of the electric fireplace 310. Additionally, as shown, based on the design of the cabinet 311 and/or the structural opening 311A, only the grill cover 348 of the heater assembly 326 is visible from a front view perspective.

FIG. 3B is a cross-sectional side view illustration of the electric fireplace 310 illustrated in FIG. 3A taken on line B-B. In particular, FIG. 3B more clearly illustrates the positioning of the heater assembly 326 of the electric fireplace 310 substantially directly adjacent to the center shelf 360 of the cabinet 311.

As shown in this embodiment, the heater body 345 of the heater assembly 326 can be secured to the center shelf 360 with one or more body attachers 362, e.g., screws, so that the heater body 345 and the heater assembly 326 are held in position substantially directly adjacent to and beneath the center shelf 360. Additionally, as also shown, the grill cover 348 of the heater assembly 326 is coupled to and/or secured to the heater body 345 in a manner to face in a generally forward direction away from the cabinet 311. In some implementations, the heater body 345, and thus the heater assembly 326, the controller 328 and/or the electrical insert 340 as a whole, can be secured to the center shelf 360 at the factory level to ensure proper installation. Alternatively, the heater body 345, and thus the heater assembly 326, the controller 328 and/or the electrical insert 340 as a whole, can be secured to the center shelf 360 by the consumer.

FIG. 3B further illustrates that in certain embodiments, the center shelf 360 can include a shelf lip 360A that extends in a generally downward direction at a front of the center shelf 360 in a manner so as to aid in the proper and desired positioning of the heater assembly 326 beneath the center shelf 360 and at a front of the cabinet 311. More specifically, in certain embodiments, the heater assembly 326 can be wedged in adjacent to the center shelf 360 and the shelf lip 360A so that the heater assembly 326 can be relatively easily positioned as desired. Additionally, as noted above, with such design, only the grill cover 348 of the heater assembly 326 is visible to the consumer when the electric fireplace 310 is completely assembled and installed within the cabinet 311. As such, the grill cover 348 can be designed to provide the desired aesthetic appearance for the consumer.

Also shown in FIG. 3B is the second electrical cable assembly 249D, e.g., a low voltage DC cable such as a USB cable with corresponding connector(s) in one particular embodiment, that plugs into the second electrical connection port 249B (formed and/or coupled into the heater assembly 326), or is hard-wired into the electrical insert 40 or heater assembly 26, at one end and into the third electrical connection port 349E (formed into and/or coupled into the grate 316) at the other end. With such simple, low voltage DC connection between the heater assembly 326 and the grate 316, the consumer can easily make such electrical connections during the installation process so that the necessary power is provided from the heater assembly 326 (which receives power directly or indirectly from the external power source 42 (illustrated in FIG. 1)) to the grate 316 (and thus the light source 22 (illustrated in FIG. 1) and/or the flame generator 24 (illustrated in FIG. 1).

As noted above, in certain embodiments, the electric fireplace can include a heater assembly which can include different sizes of grill covers that can be alternatively coupled near a front of the heater body, i.e. with one such grill cover being coupled to the heater body at any given time, which would be selected based on the size and shape of the cabinet and/or the structural opening. In such embodiments, it is appreciated that the different grill covers can be alternatively coupled to the heater body in any suitable manner. With such design, the electric fireplace, including the heater assembly, can be installed in different sized structural openings of the cabinet, and can thus provide a different overall aesthetic appearance, without actually changing the size of the components of the heater assembly other than the grill cover, e.g., without changing the size and shape of the heater body 45. More particularly, in such embodiments, the size of the grill cover can be selected to specifically relate to the size and/or width of the structural opening of the cabinet. For example, as shown in FIGS. 4A-4D, the electric fireplace includes a heater assembly including a heater body and a first grill cover that is coupled to the heater body near a front of the heater body; and, as shown in FIGS. 5A-5D, the electric fireplace includes a heater assembly including a heater body that is identical in size to the embodiment shown in FIGS. 4A-4D, and a second grill cover having a size that is different than the size of the first grill cover, which is coupled to the heater body near the front of the heater body. Thus, it is appreciated that a heater assembly usable within the present invention can include a heater body, and alternative interchangeable grill covers of differing sizes that can alternatively be coupled to the heater body. Stated in another manner, in various embodiments, the heater assembly includes a heater body and alternative grill covers of differing sizes, e.g., differing lengths, that are alternatively selectively couplable to the heater body to provide different aesthetic appearances for the heater assembly as part of the electric fireplace.

In some embodiments, such as shown in FIGS. 12A-12F, the size of the grill cover can be varied by using a common sized cover body, e.g., that has a size and/or length that matches that of the heater body, and can further include one or more extenders of any desired size or length, which can be positioned substantially adjacent to and/or coupled to outer lateral edges of the cover body. Thus, in such embodiments, the length and/or size of the grill cover can be altered as desired to fit within the structural opening of the cabinet merely via the inclusion (or absence) of any extenders being coupled to the outer lateral edges of the cover body.

In certain embodiments, only the grill cover of the heater assembly is visible to the consumer in the electric fireplace that has been completely assembled and fully installed within the structural opening of the cabinet.

More specifically, it has been discovered through continuous development of the present invention that the size of the heater body can be maintained, while simply interchanging the grill cover size (which is a separate part(s) that can be at least partially pre-assembled at the factory level) for larger width structural openings for the electric fireplace. This provides a significant advantage because it makes the assembled product look much larger from the front viewing angle, but with very minimal cost increase (as only the grill cover is increased in size). Such design also allows for production efficiency since the main enclosure size, i.e. the size of heater body, stays consistent among all sizes for the electric fireplace based on the size of the structural opening within which the electric fireplace is installed.

It is further appreciated that in different embodiments, the heater assembly with interchangeable grill covers can be configured to be positioned and/or embedded within the base panel, such as in FIG. 1, positioned substantially adjacent to the center shelf, such as in FIG. 3A, positioned substantially adjacent to a cabinet top, or positioned in another suitable manner within the electric fireplace. Additionally, it is also appreciated that, although this embodiment refers to alternative interchangeable grill covers, only one grill cover will typically be included as part of the electric fireplace provided to the consumer, and the selection would be based on the size and shape of the cabinet of the consumer and/or the structural opening therein. It is merely important to emphasize that each of the different grill covers can be selectively attached to the heater body, i.e. to a heater body of a standard, common size.

Figure 4A:
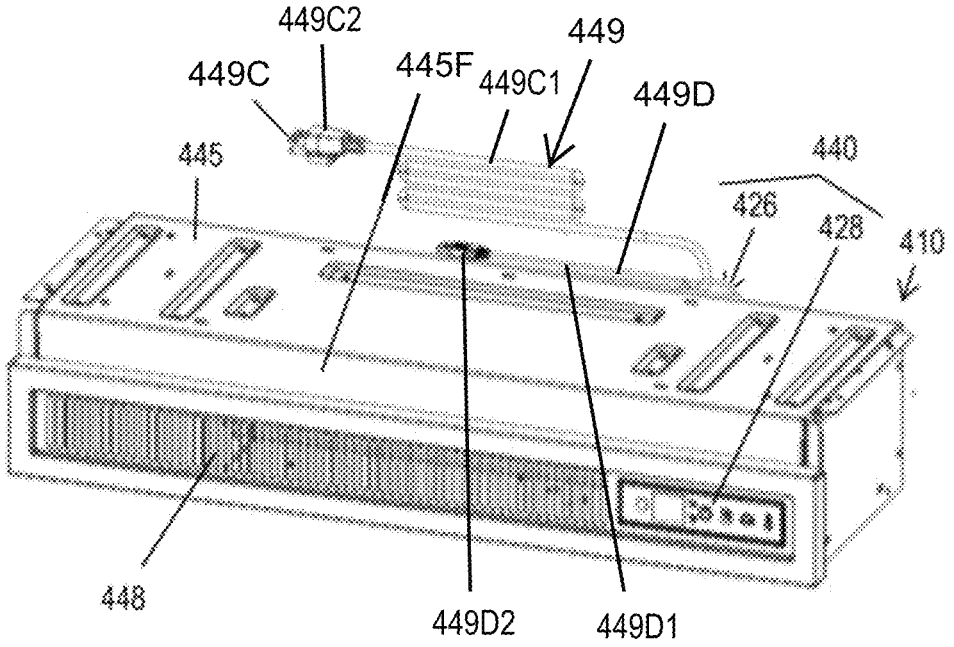
FIG. 4A is a perspective view illustration of a portion of still another embodiment of the electric fireplace, including an embodiment of a heater assembly usable as part of the electric fireplace.

FIG. 4A is a perspective view illustration of a portion of still another embodiment of the electric fireplace 410. In particular, FIG. 4A is a perspective view illustration of an embodiment of a heater assembly 426 that can be included as part of the electric fireplace 410.

As shown in FIG. 4A, the heater assembly 426 includes a heater body 445 and a first grill cover 448 that has been selectively coupled to the heater body 445, e.g., near a front 445F of the heater body 445 in this particular embodiment. As noted, it is appreciated that the first grill cover 448 can be selectively coupled to the heater body 445 in any suitable manner. For example, the first grill cover 448 can be selectively coupled to the heater body 445 using a cover attachment assembly 451 (illustrated in phantom in FIG. 4B), which can include one or more cover attachers 451A (illustrated in phantom in FIG. 4B), e.g., screws, so that the first grill cover 448 can be fixed in position relative to the heater body 445. Alternatively, the first grill cover 448 can be selectively coupled to the heater body 445 in another suitable manner.

FIG. 4A also illustrates a controller 428 that can be incorporated with the heater assembly 426 into an electrical insert 440 that can be installed as a single unit as part of the electric fireplace 410. More particularly, as shown in this embodiment, the controller 428 can be incorporated into the first grill cover 448 that is coupled to the front 445F of the heater body 445.

The heater assembly 426 can further include a heat generator 46 (illustrated in FIG. 1) and a blower 247 (illustrated in FIG. 2), which can be positioned substantially within the heater body 445, and an air outlet 445A (illustrated in FIG. 4D) that is formed into the heater body 445, with the first grill cover 448 being configured, shaped and/or designed to conform to, fit over and cover the air outlet 445A when coupled to the heater body 445. It is appreciated that the heater assembly 426 and the controller 428 can be substantially similar in overall design and function to what has been illustrated and described herein above. Thus, a detailed description of the heater assembly 426 and the controller 428 will not be provided other than how this embodiment differs from the embodiments illustrated and described above.

As shown in this embodiment, the heater body 445 is substantially rectangular box-shaped. Alternatively, the heater body 445 can have another suitable shape.

Additionally, it is appreciated that the first grill cover 448 can be designed to have any suitable desired outward aesthetic appearance. For example, in one embodiment, the first grill cover 448 can have an outward appearance including slats or louvers that extend all the way to the edges of the first grill cover 448. Alternatively, the first grill cover 448 can have an outward appearance including slats or louvers that do not extend all the way to the edges of the first grill cover 448. It is further appreciated, however, that in many embodiments, the first grill cover 448 can include slats or louvers that extend far enough to substantially completely coincide with and/or cover the air outlet 445A.

Figure 5A:
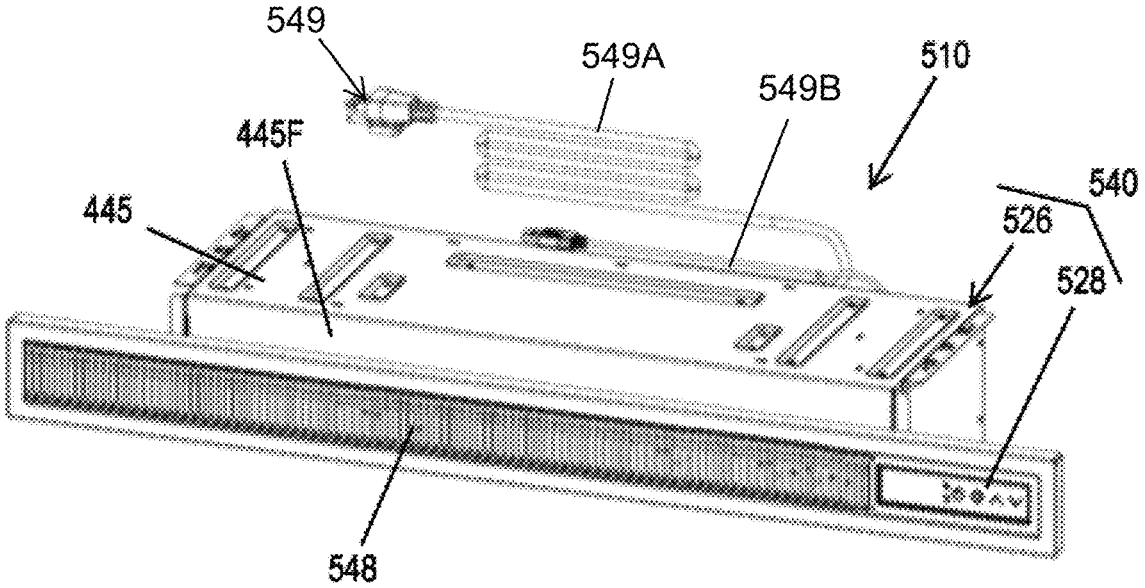
FIG. 5A is a perspective view illustration of a portion of yet another embodiment of the electric fireplace, including another embodiment of the heater assembly usable as part of the electric fireplace.

FIG. 5A is a perspective view illustration of a portion of yet another embodiment of the electric fireplace 510. In particular, FIG. 5A is a perspective view illustration of another embodiment of a heater assembly 526 that can be included as part of the electric fireplace 510.

As shown in FIG. 5A, the heater assembly 526 includes the heater body 445 that is also included within the heater assembly 426 of FIG. 4A, and a second grill cover 548 that has been selectively coupled to the heater body 445, e.g., to the front 445F of the heater body 445 in this particular embodiment. In this embodiment, the second grill cover 548 can also sometimes be referred to as an "oversized grill cover" because, as shown, the second grill cover 548 is wider (and, thus, oversized) compared to a width of the heater body 445.

As noted, it is appreciated that the second grill cover 548 can be selectively coupled to the heater body 445 in any suitable manner. For example, the second grill cover 548 can be selectively coupled to the heater body 445 using the cover attachment assembly 451 (illustrated in phantom in FIG. 5B, and illustrated more clearly in FIG. 5D), which can include the one or more cover attachers 451A (illustrated in phantom in FIG. 5B, and illustrated more clearly in FIG. 5D), e.g., screws, so that the second grill cover 548 can be fixed in position relative to the heater body 445. In some such embodiments, the cover attachment assembly 451 can include more cover attachers 451A when being used to selectively couple a larger grill cover to the heater body 445. Alternatively, the second grill cover 548 can be selectively coupled to the heater body 445 in another suitable manner.

This greatly simplifies the manufacturing, because a common sized heater body 445 can alternatively be used with a plurality of different sized grill covers 448, 548 for a plurality of different sized cabinets 11 (illustrated in FIG. 1) and/or structural openings 211A (illustrated in FIG. 2A). As a specific example, if the cabinet 11 and/or the structural opening 211A is wide, a wide grill cover 548 can be attached to the heater body 445 and the wide cabinet 11. Alternatively, if the cabinet 11 and/or the structural opening 211A is narrow, a narrow grill cover 448 can be attached to the heater body 445 and the narrow cabinet 11.

FIG. 5A also illustrates a controller 528 that can be incorporated with the heater assembly 526 into an electrical insert 540 that can be installed as a single unit as part of the electric fireplace 510. More particularly, as shown in this embodiment, the controller 528 can be incorporated into the second grill cover 548 that is coupled to the front 445F of the heater body 445. Additionally, as shown in this embodiment, the controller 528, as incorporated into the second grill cover 548, is positioned to extend outward laterally away from the heater body 445. As such, the electric fireplace 510 and/or the electrical insert 540 can have additional wiring requirements that enable the proper electrical connection between the controller 528 and the heater body 445. Further, additional structural support members may also be provided in certain embodiments so that the extended second grill cover 548 may be adequately structurally supported relative to the smaller heater body 445.

The heater assembly 526 can further include a heat generator 46 (illustrated in FIG. 1) and a blower 247 (illustrated in FIG. 2), which can be positioned substantially within the heater body 445, and the air outlet 445A (illustrated in FIG. 4D) that is formed into the heater body 445, with the second grill cover 548 being configured, shaped and/or designed to conform to, fit over and cover the air outlet 445A when coupled to the heater body 445. It is appreciated that the heater assembly 526 and the controller 528 can be substantially similar in overall design and function to what has been illustrated and described herein above. Thus, a detailed description of the heater assembly 526 and the controller 528 will not be provided other than how this embodiment differs from the embodiments illustrated and described above.

Additionally, it is appreciated that the second grill cover 548 can be designed to have any suitable desired outward aesthetic appearance. For example, in one embodiment, the second grill cover 548 can have an outward appearance including slats or louvers that extend all the way to the edges of the second grill cover 548. Alternatively, the second grill cover 548 can have an outward appearance including slats or louvers that do not extend all the way to the edges of the second grill cover 548. It is further appreciated, however, that in many embodiments, the second grill cover 548 can include slats or louvers that extend far enough to substantially completely coincide with and/or cover the air outlet 445A.

Figure 4B:
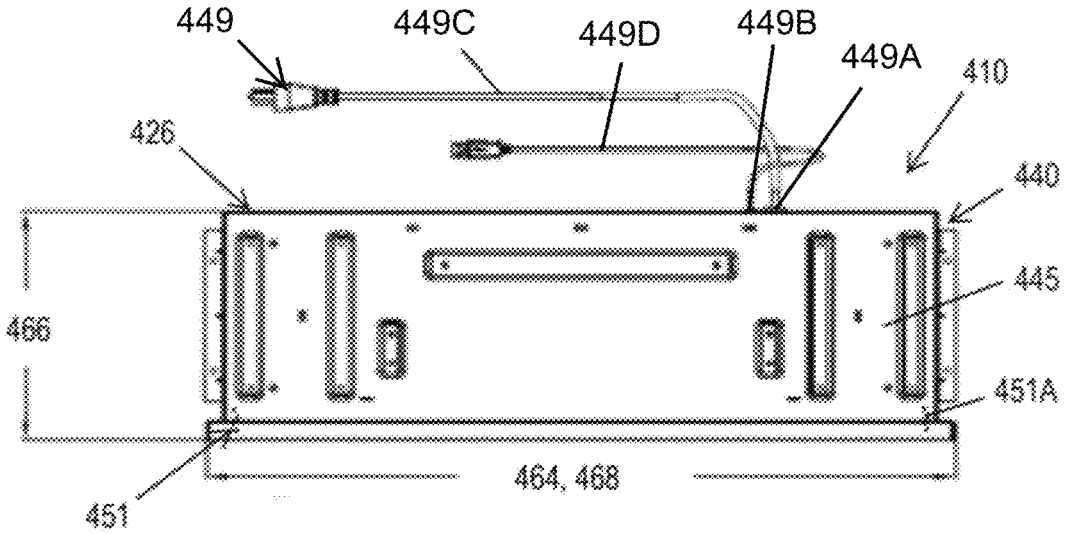
FIG. 4B is a simplified top view illustration of the portion of the electric fireplace illustrated in FIG. 4A.
Figure 4C:
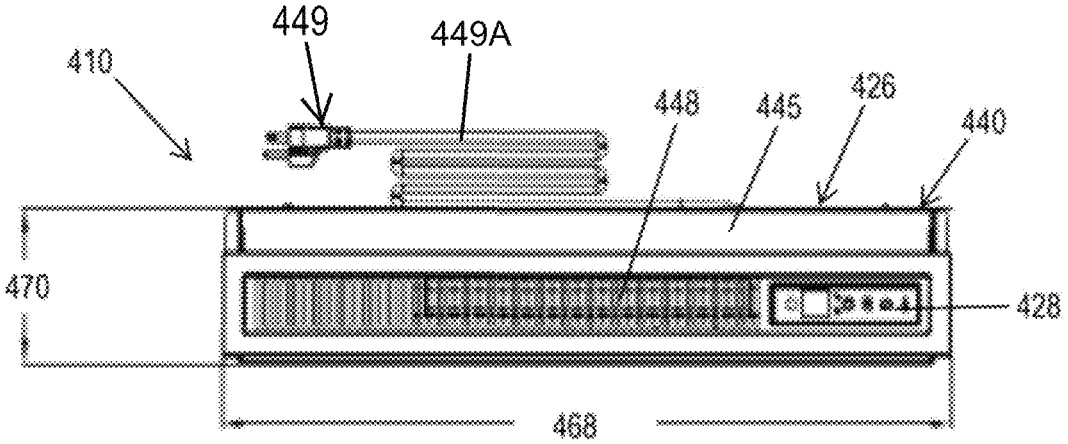
FIG. 4C is a simplified front view illustration of the portion of the electric fireplace illustrated in FIG. 4A.

FIGS. 4B and 4C provide alternative views of the heater assembly 426 illustrated in FIG. 4A that illustrate certain dimensions for the heater body 445 and the first grill cover 448. More particularly, FIG. 4B is a simplified top view illustration of the heater assembly 426 illustrated in FIG. 4A that can be included as part of the electric fireplace 410; and FIG. 4C is a simplified front view illustration of the heater assembly 426 illustrated in FIG. 4A that can be included as part of the electric fireplace 410.

Each of FIGS. 4A-4D also illustrate at least a portion of the electrical connection assembly 449, including the first electrical connection port 449A (illustrated in FIG. 4B), the second electrical connection port 449B (illustrated in FIG. 4B), the first electrical cable assembly 449C (e.g., the AC external power cord with corresponding connector(s)), and the second electrical cable assembly 449D (e.g., the low voltage DC cable such as a USB cable with corresponding connector(s)). As such, power can be supplied from the external power source 42 (illustrated in FIG. 1) to the electrical insert 440 using the first electrical cable assembly 449C, i.e. the heater assembly 426 and the controller 428 (illustrated in FIG. 4A), and then from the electrical insert 440 to the grate 16 (illustrated in FIG. 1) using the second electrical cable assembly 449D, i.e. to the light source 22 (illustrated in FIG. 1) and/or the flame generator 24 (illustrated in FIG. 1). Thus, the AC external power cord 449C with corresponding connector(s) connects the heater assembly 426 to power, and the second electrical cable assembly 449D allows the heater assembly 426 to power and control the light source 22 and/or the flame generator 24.

As shown in FIG. 4B, the heater body 445 can have a body length 464 and a body depth 466; and the first grill cover 448 can have a first cover length 468.

In certain non-exclusive embodiments, the body length 464 of the heater body 445 (from one side to the other side) can be between approximately 500 millimeters and 650 millimeters. More specifically, in some such embodiments, the body length 464 of the heater body 445 can be between approximately 570 millimeters and 585 millimeters. Alternatively, the body length 464 of the heater body 445 can be greater than 650 millimeters or less than 500 millimeters.

Additionally, in certain non-exclusive embodiments, the body depth 466 of the heater body 445 (from front to back) can be between approximately 160 millimeters and 240 millimeters. More specifically, in some such embodiments, the body depth 466 of the heater body 445 can be between approximately 195 millimeters and 205 millimeters. Alternatively, the body depth 466 of the heater body 445 can be greater than 240 millimeters or less than 160 millimeters.

Further, in certain non-exclusive embodiments, the first cover length 468 of the first grill cover 448 (from one side to the other side) can be substantially equal to the body length 464 of the heater body 445. In particular, in this embodiment, the first cover length 468 of the first grill cover 448 can be between approximately 500 millimeters and 650 millimeters. More specifically, in some such embodiments, the first cover length 468 of the first grill cover 448 can be between approximately 570 millimeters and 585 millimeters. Alternatively, the first cover length 468 of the first grill cover 448 can be greater than 650 millimeters or less than 500 millimeters.

As shown in FIG. 4C, the heater body 445 can have a body height 470. FIG. 4C also illustrates the first cover length 468 of the first grill cover 448, which, as noted above, can be substantially equal to the body length 464 (illustrated in FIG. 4B) of the heater body 445.

In certain non-exclusive embodiments, the body height 470 of the heater body 445 (from top to bottom) can be between approximately 75 millimeters and 125 millimeters. More specifically, in some such embodiments, the body height 470 of the heater body 445 can be between approximately 95 millimeters and 105 millimeters. Alternatively, the body height 470 of the heater body 445 can be greater than 125 millimeters or less than 75 millimeters.

Figure 4D:
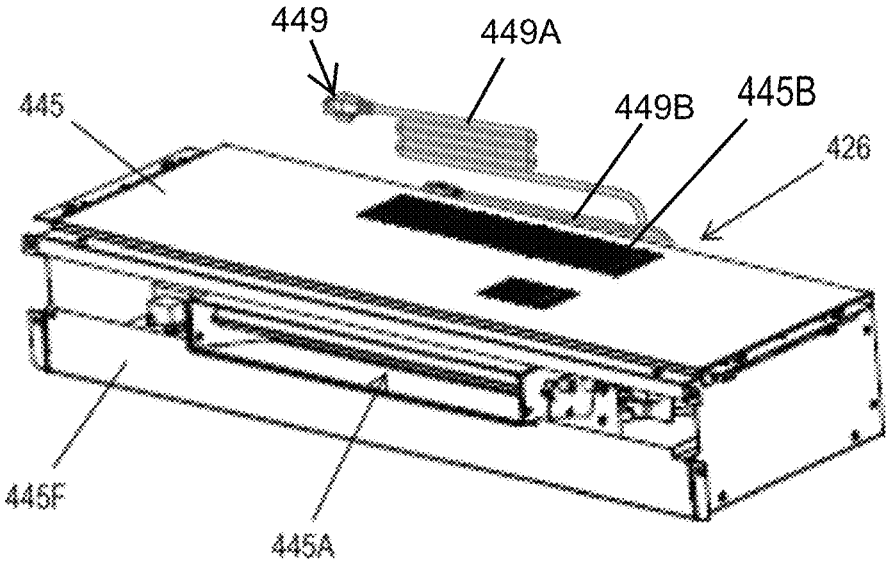
FIG. 4D is a simplified front perspective view illustration of a portion of the heater assembly illustrated in FIG. 4A.

FIG. 4D is a simplified front perspective view of a portion of the heater assembly 426 illustrated in FIG. 4A. In particular, FIG. 4D is a simplified front perspective view of the heater body 445 of the heater assembly 426, with the first grill cover 448 having been omitted for purposes of clarity.

As illustrated, the heater body 445 includes the air outlet 445A through which heated air can be directed out of the heater body 445 before being directed through the first grill cover 448. As noted, the first grill cover 448 (or the second grill cover 548 for the embodiment shown in FIG. 5A) is configured to cover the air outlet 445A when coupled to the heater body 445. In one embodiment, as shown, the air outlet 445A can be a substantially rectangular-shaped opening that is formed into the front 445F of the heater body 445. Alternatively, the air outlet 445A can be designed to have a different size and/or shape than what is specifically shown in FIG. 4D.

Additionally, FIG. 4D also illustrates an air intake 445B that brings air into the heater body 445. In this embodiment, the air intake 445B is formed, at least in part, into an upper surface 445U of the heater body 445. With such design or positioning of the air intake 445B, the heater assembly 426 is best configured to be positioned and/or embedded within the base panel 30 (illustrated in FIG. 1), i.e. within the base opening 230A (illustrated in FIG. 2) of the base panel 30. Alternatively, the air intake 445B can be positioned in another suitable manner. For example, in some alternative embodiments, the air intake 445B can be formed into a bottom surface (not shown) and/or a rear surface (not shown) of the heater body 445 such as for embodiments where the heater assembly 426 is positioned substantially adjacent to the center shelf 360 (illustrated in FIG. 3A) of the cabinet 311 (illustrated in FIG. 3A).

Figure 5B:
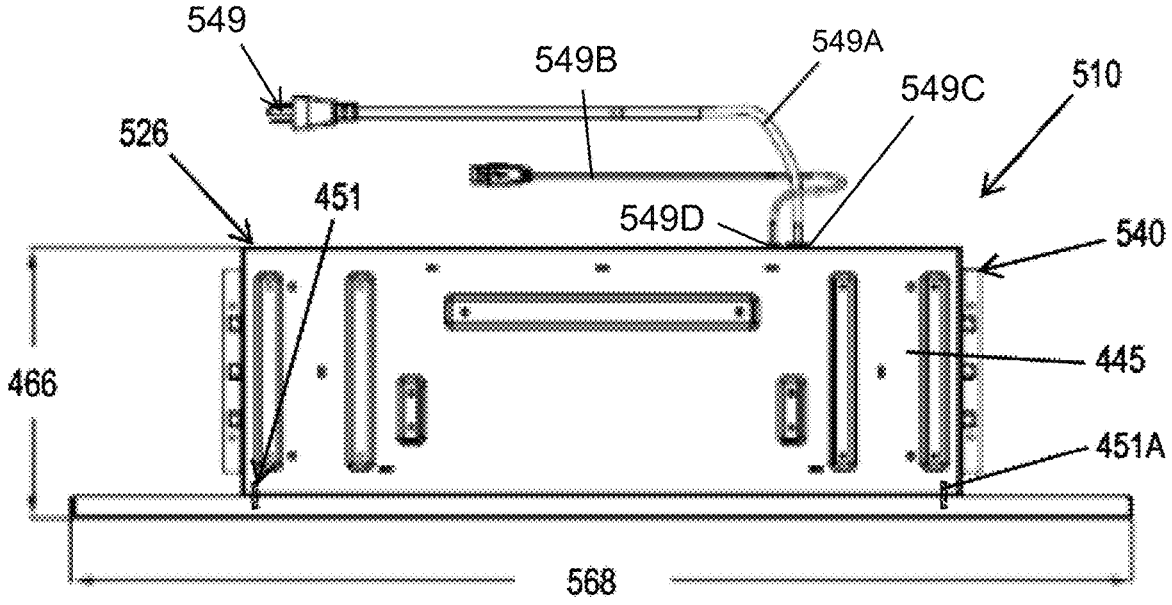
FIG. 5B is a simplified top view illustration of the portion of the electric fireplace illustrated in FIG. 5A.
Figure 5C:
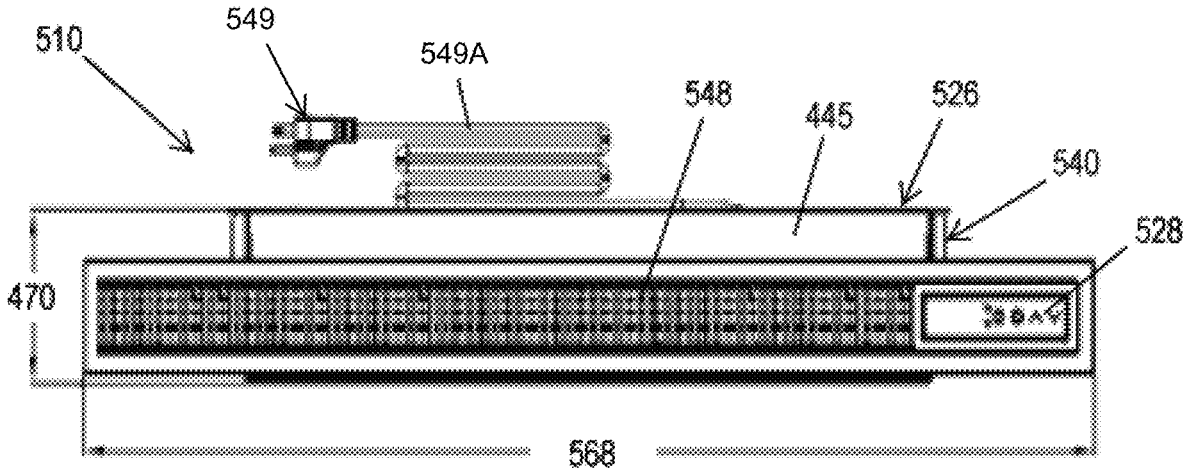
FIG. 5C is a simplified front view illustration of the portion of the electric fireplace illustrated in FIG. 5A.

FIGS. 5B and 5C provide alternative views of the heater assembly 526 illustrated in FIG. 5A that illustrate certain dimensions for the heater body 445 and the second grill cover 548. More particularly, FIG. 5B is a simplified top view illustration of the heater assembly 526 illustrated in FIG. 5A that can be included as part of the electric fireplace 510; and FIG. 5C is a simplified front view illustration of the heater assembly 526 illustrated in FIG. 5A that can be included as part of the electric fireplace 510.

Each of FIGS. 5A-5C also illustrate at least a portion of the electrical connection assembly 549, including the first electrical connection port 549A (illustrated in FIG. 5B), the second electrical connection port 549B (illustrated in FIG. 5B), the first electrical cable assembly 549C (e.g., the AC external power cord with corresponding connector(s)), and the second electrical cable assembly 549D (e.g., the low voltage DC cable such as a USB cable with corresponding connector(s)). As such, power can be supplied from the external power source 42 (illustrated in FIG. 1) to the electrical insert 540, i.e. the heater assembly 526 and the controller 528 (illustrated in FIG. 5A), and then from the electrical insert 540 to the grate 16 (illustrated in FIG. 1), i.e. to the light source 22 (illustrated in FIG. 1) and/or the flame generator 24 (illustrated in FIG. 1).

Since the heater body 445 in the embodiment shown in FIG. 5B is the same as is shown in FIG. 4B, the body length 464 and the body depth 466 of the heater body 445 are the same as what has been described in relation to FIG. 4B. FIG. 5B further shows that the second grill cover 548 can have a second cover length 568. As illustrated, the second cover length 568 of the second grill cover 548 (from one side to the other side) is greater than the first cover length 468 (illustrated in FIG. 4B) of the first grill cover 448 (illustrated, for example, in FIG. 4B).

In certain non-exclusive embodiments, the second cover length 568 of the second grill cover 548 can be between approximately 750 millimeters and 900 millimeters. More specifically, in some such embodiments, the second cover length 568 of the second grill cover 548 can be between approximately 805 millimeters and 820 millimeters. Alternatively, the second cover length 568 of the second grill cover 548 can be greater than 900 millimeters or less than 750 millimeters.

Moreover, in certain such embodiments, the second cover length 568 can be greater than the first cover length 468 by between approximately 100 millimeters and 400 millimeters. More specifically, in some such embodiments, the second cover length 568 can be greater than the first cover length 468 by between approximately 220 millimeters and 250 millimeters. In certain non-exclusive alternative embodiments, the second cover length 568 can be greater than the first cover length 468 by at least approximately 100, 120, 140, 160, 180, 200, 220, 240, 250, 260, 280, 300, 320, 340, 360, 380 or 400 millimeters. Alternatively, the difference in length between the first cover length 468 and the second cover length 568 can be greater than 400 millimeters or less than 100 millimeters.

Additionally, since the body length 464 of the heater body 445 is approximately the same as the first cover length 468, in some embodiments, the second cover length 568 can be greater than the body length 464 by between approximately 100 millimeters and 400 millimeters. More specifically, in certain such embodiments, the second cover length 568 can be greater than the body length 464 by between approximately 220 millimeters and 250 millimeters. In some non-exclusive alternative embodiments, the second cover length 568 can be greater than the body length 464 by at least approximately 100, 120, 140, 160, 180, 200, 220, 240, 250, 260, 280, 300, 320, 340, 360, 380 or 400 millimeters. Alternatively, the difference in length between the second cover length 568 and the body length 464 can be greater than 400 millimeters or less than 100 millimeters.

It should be noted that two different sized grill covers 448 (FIG. 4C), 548 (FIG. 5C) are shown with a common sized heater body 445. However, more than two different sized grill covers 448, 548 can be provided so that the assembly can fit a wider variety of cabinet sizes. With this design, an appropriately sized grill cover 448, 548 can be selected to fit the size of the cabinet 11 and/or the structural opening 211A of the cabinet 11.

As shown in FIG. 5C, since the heater body 445 in the embodiment shown in FIG. 5C is the same as is shown in FIG. 4C, the body height 470 of the heater body 445 is the same as what has been described in relation to FIG. 4C. FIG. 5C also illustrates the second cover length 568 of the second grill cover 548, as was previously illustrated and described in relation to FIG. 5B.

Figure 5D:
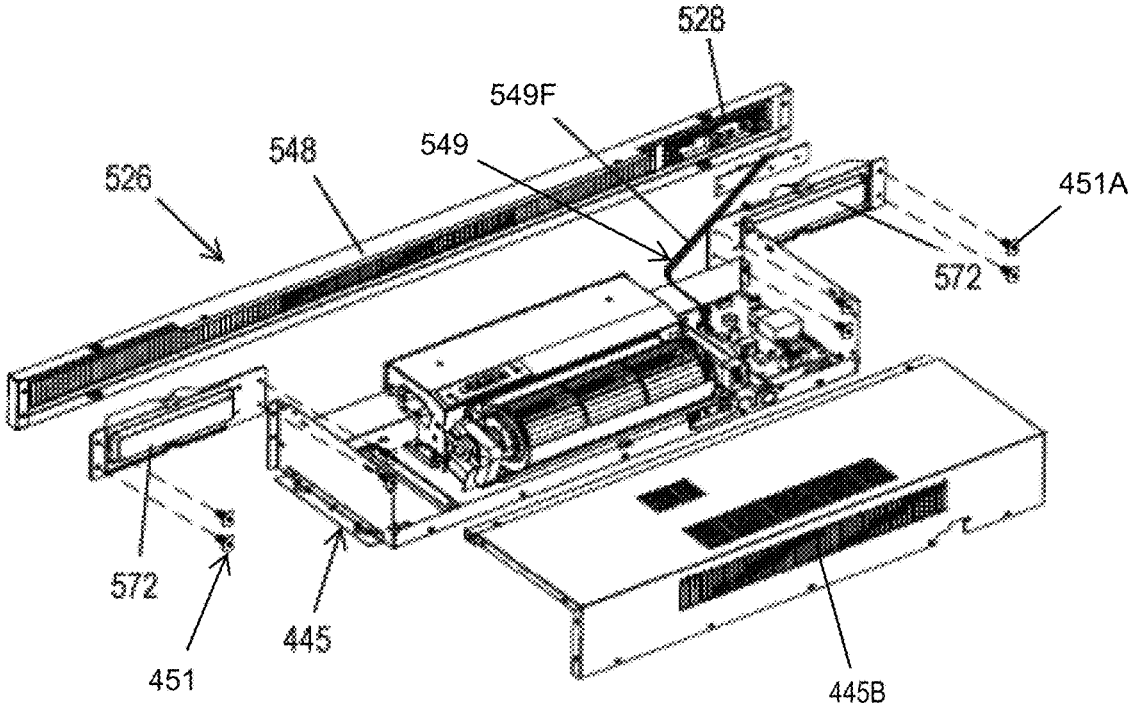
FIG. 5D is a partially exploded rear perspective view illustration of the heater assembly illustrated in FIG. 5A.

FIG. 5D is a partially exploded rear perspective view of the heater assembly 526 illustrated in FIG. 5A. In particular, FIG. 5D is a partially exploded rear perspective view showing the heater body 445 and the second grill cover 548 that can be alternatively selectively coupled to the heater body 445.

As shown in FIG. 5D, the second grill cover 548 can have an outward appearance including slats or louvers that extend all the way to the edges of the second grill cover 548. Alternatively, the second grill cover 548 can have an outward appearance including slats or louvers that do not extend all the way to the edges of the second grill cover 548.

FIG. 5D further illustrates certain additional features that can be included with the heater assembly 526 when using the second grill cover 548, or any suitable grill cover that has a cover length 568 (illustrated in FIG. 5B) that is greater than the body length 464 (illustrated in FIG. 4B) of the heater body 445. For example, FIG. 5D illustrates a pair of reinforcement members 572 that can help support portions of the second grill cover 548 that extend outwardly away from the heater body 445. The reinforcement members 572 are configured to provide desired structural support for the ends of the second grill cover 548 that extend outwardly away from the heater body 445 when the second grill cover 548 is coupled to the heater body 445. The reinforcement members 572 can have any suitable design for providing such structural support and for inhibiting undesired flexing of the wider second grill cover 548 when the heater assembly 526 is being installed within the structural opening 311A (illustrated in FIG. 3A) of the cabinet 311 (illustrated in FIG. 3A).

The heater assembly 526 can incorporate any suitable types of attachment means for purposes of attaching the second grill cover 548 to the reinforcement members 572, the reinforcement members 572 to the heater body 445, and the second grill cover 548 to the heater body 445. For example, FIG. 5D more clearly illustrates an embodiment of the cover attachment assembly 451 including the one or more cover attachers 451A, e.g., screws, that can be used for purposes of attaching the second grill cover 548 to the reinforcement members 572, the reinforcement members 572 to the heater body 445, and the second grill cover 548 to the heater body 445. It is appreciated that any suitable number of cover attachers 451A can be utilized for purposes of attaching the second grill cover 548 to the reinforcement members 572, the reinforcement members 572 to the heater body 445, and the second grill cover 548 to the heater body 445.

Additionally, as shown in the embodiment illustrated in FIG. 5D, the electrical connection assembly 549 can further include an auxiliary electrical cable assembly 549F, which extends between the controller 528 and the heater assembly 526, and which may be required for purposes of electrically connecting the controller 528 to the heater body 526. The auxiliary electrical cable assembly 549F can have any suitable design, which may be typically of standard wiring for enabling electrical connections within an electric fireplace 510 (illustrated in FIG. 5A). The auxiliary electrical cable assembly 549F allows for different sized grill covers 448, 548 to be selectively attached to a common sized heater body 445.

Further, FIG. 5D also illustrates an air intake 445B that brings air into the heater body 445. In this embodiment, the air intake 445B is formed, at least in part, into an upper surface 445U and/or a rear surface 445R of the heater body 445. With such design or positioning of the air intake 445B, the heater assembly 526 is best configured to be positioned and/or embedded within the base panel 30 (illustrated in FIG. 1), i.e. within the base opening 230A (illustrated in FIG. 2) of the base panel 30. Alternatively, the air intake 445B can be positioned in another suitable manner. For example, in some alternative embodiments, the air intake 445B can be formed, at least in part, into a bottom surface (not shown) of the heater body 445 such as for embodiments where the heater assembly 526 is positioned substantially adjacent to the center shelf 360 (illustrated in FIG. 3A) of the cabinet 311 (illustrated in FIG. 3A).

FIGS. 6A-6K are a set of illustrations showing one representative embodiment of a method of installation of the electric fireplace 10.

Figure 6A:
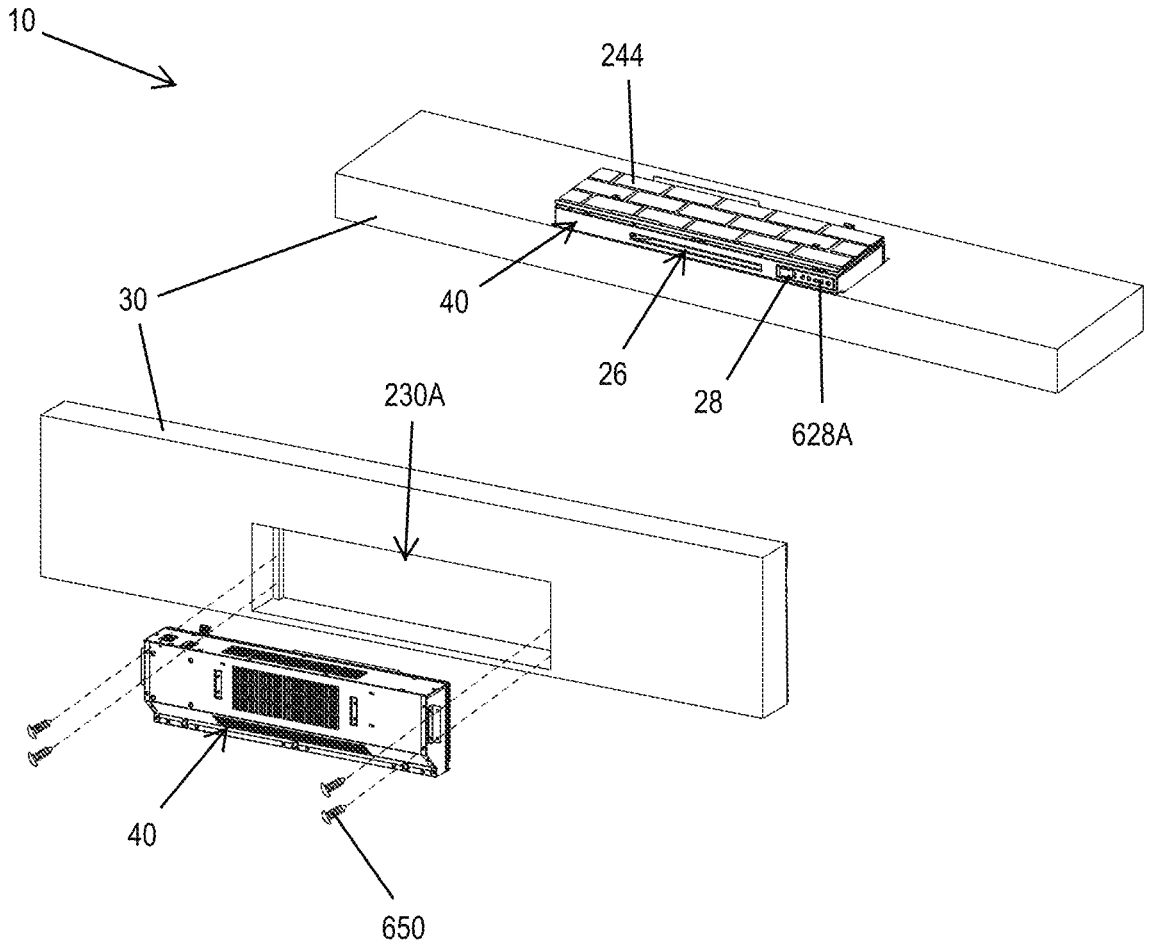
FIGS. 6A-6K are a set of illustrations showing one representative embodiment of a method of installation of the electric fireplace.

Initially, FIG. 6A is an illustration demonstrating installation of the electrical insert 40 into the base opening 230A of the base panel 30. More specifically, FIG. 6A illustrates a plurality of insert attachers 650 that can be utilized to effectively secure the electrical insert 40 within the base opening 230A of the base panel 30. The electric fireplace 10 can include any suitable number and design of insert attachers 650. For example, in one embodiment, as shown in FIG. 6A, the electric fireplace 10 can include four screw-type insert attachers 650 for purposes of effectively securing the electrical insert 40 within the base opening 230A of the base panel 30. Alternatively, the electric fireplace 10 can include greater than four or fewer than four insert attachers 650, and/or the insert attachers 650 can have another suitable design.

Additionally, FIG. 6A further illustrates an embodiment of the electrical insert 40, including the heater assembly 26 and the controller 28 (with printed control board assembly (PCBA)), with the insert cover 244 positioned on top of the electrical insert 40. As noted above, the heater assembly 26 and the controller 28 can have any suitable design. Further, as shown, the controller 28 can include a control panel 628A that enables the user to control the various functions of the electric fireplace 10, e.g., the power, the heat, the light/flames, etc.

Figure 6B:
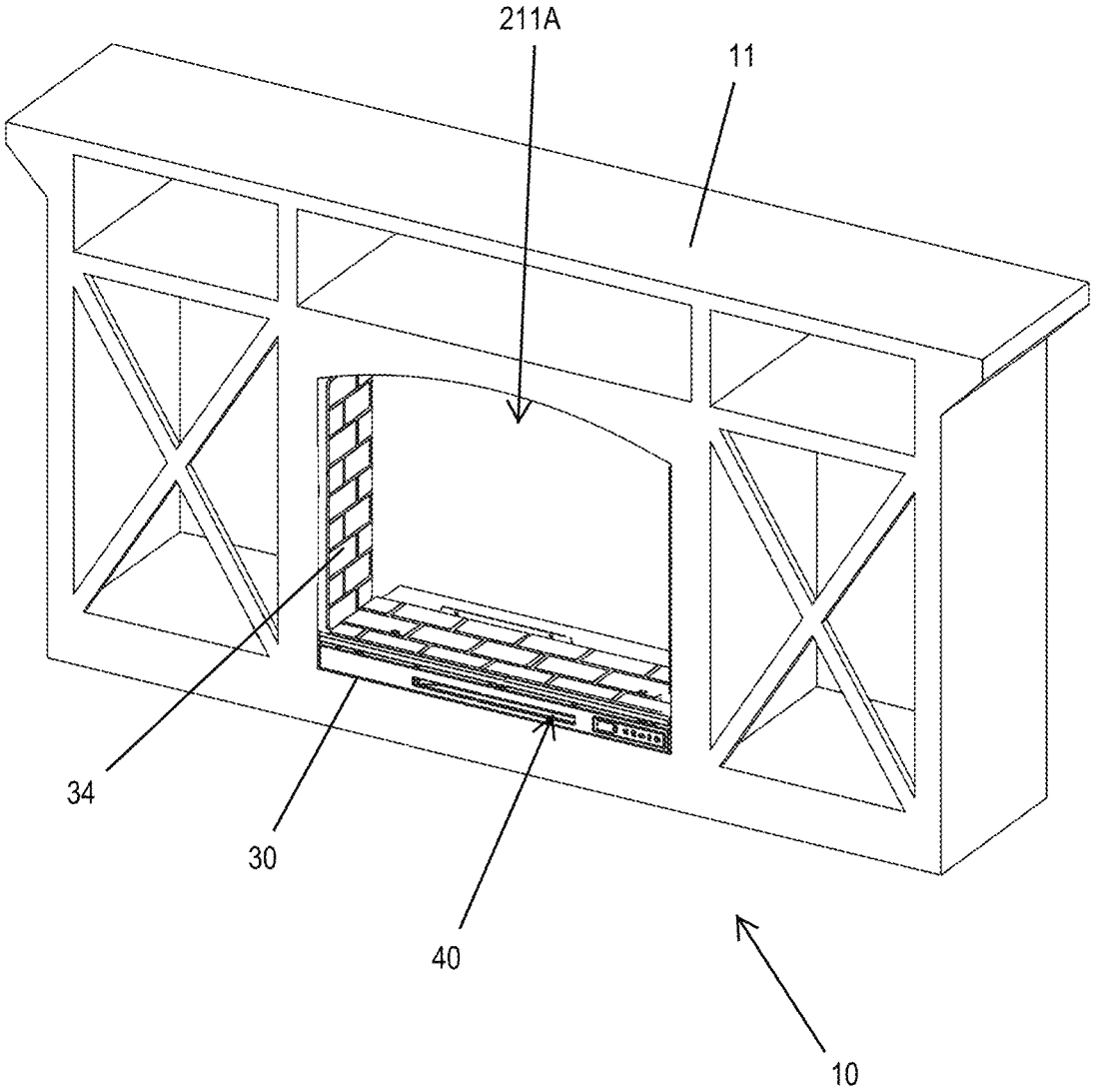

FIG. 6B is a front perspective view illustration of the electric fireplace 10 with the electrical insert 40 having been installed and/or embedded into the base panel 30, i.e. into the base opening 230A (illustrated in FIG. 2), and the side panels 34 also having been installed within the structural opening 211A in the cabinet 11.

With the design as described herein, the configuration of the electrical insert 40 being embedded into the base panel 30 will allow for more flexibility and increased efficiencies for manufacturing hub diversification, since only the base module, i.e. the electrical insert 40 embedded into the base panel 30, would need to come from a certified insert supplier, i.e. an electrical factory.

Figure 6C:
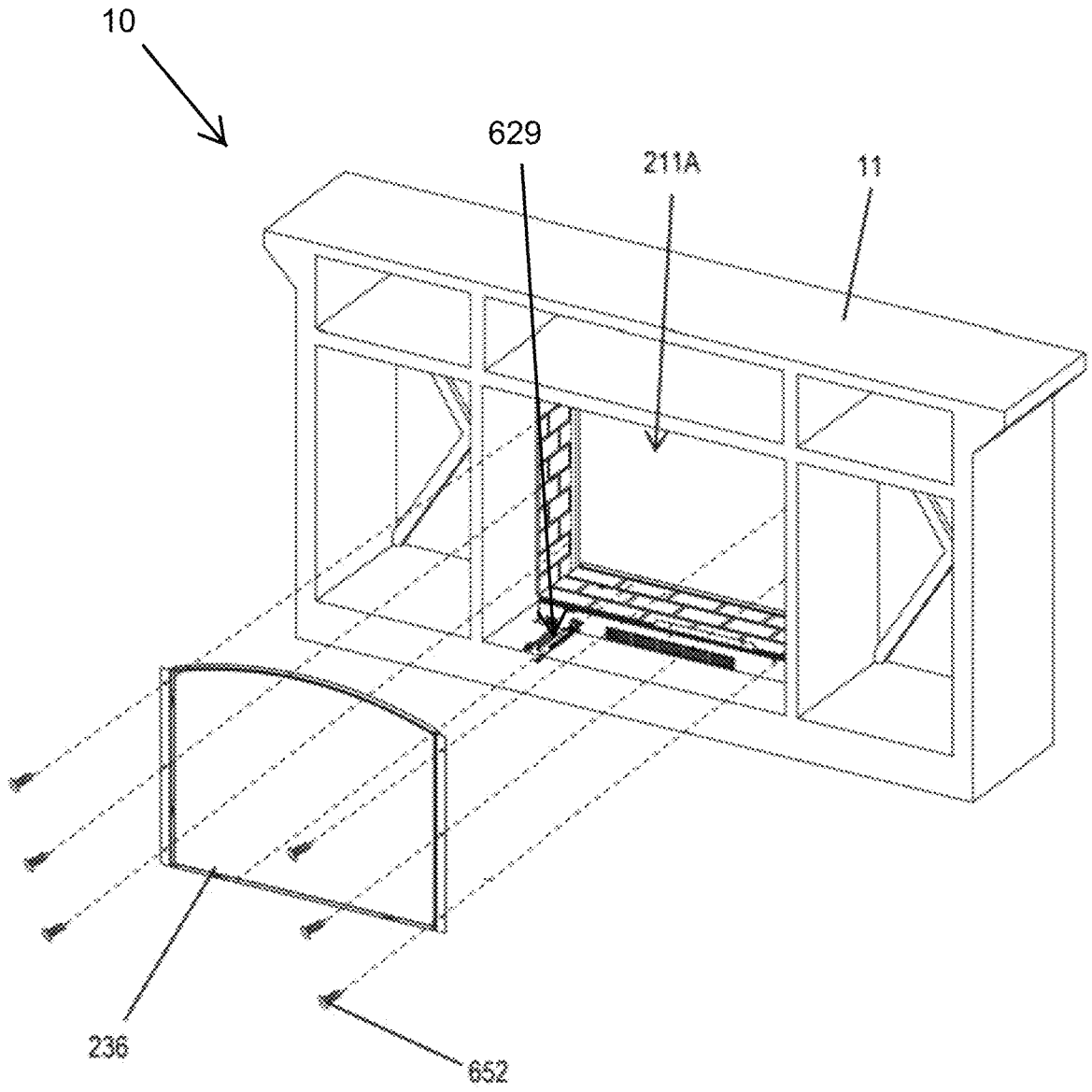

FIG. 6C is a rear perspective view illustration of the electric fireplace 10, as the front frame 236 is being installed within the structural opening 211A of the cabinet 11. Additionally, FIG. 6C illustrates a plurality of frame attachers 652 that can be utilized to secure the front frame 236 within the structural opening 211A of the cabinet 11. The electric fireplace 10 can include any suitable number and design of frame attachers 652. For example, in one embodiment, as shown in FIG. 6C, the electric fireplace 10 can include six screw-type frame attachers 652 for purposes of effectively securing the front frame 236 within the structural opening 211A of the cabinet 11. Alternatively, the electric fireplace 10 can include greater than six or fewer than six frame attachers 652, and/or the frame attachers 652 can have another suitable design.

Additionally, FIG. 6C also illustrates at least a portion of the electrical connection assembly 649 that is utilized to provide necessary power to the various electrical components of the electric fireplace 610.

Figure 6D:
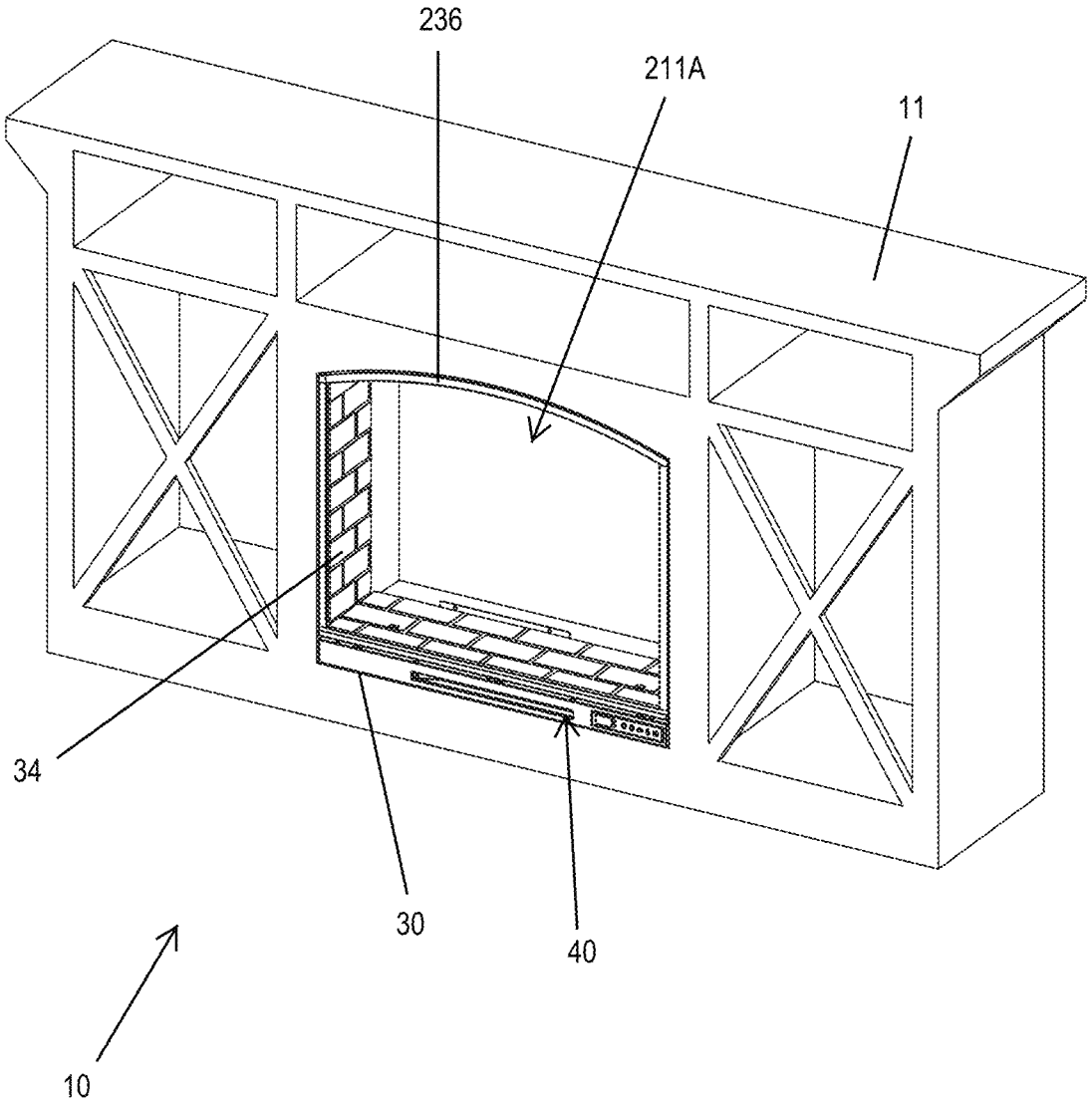

FIG. 6D is a front perspective view illustration of the electric fireplace 10, with the electrical insert 40 having been installed and/or embedded into the base panel 30, i.e. into the base opening 230A (illustrated in FIG. 2), and the side panels 34 and the front frame 236 also having been installed within the structural opening 211A in the cabinet 11.

Figure 6E:
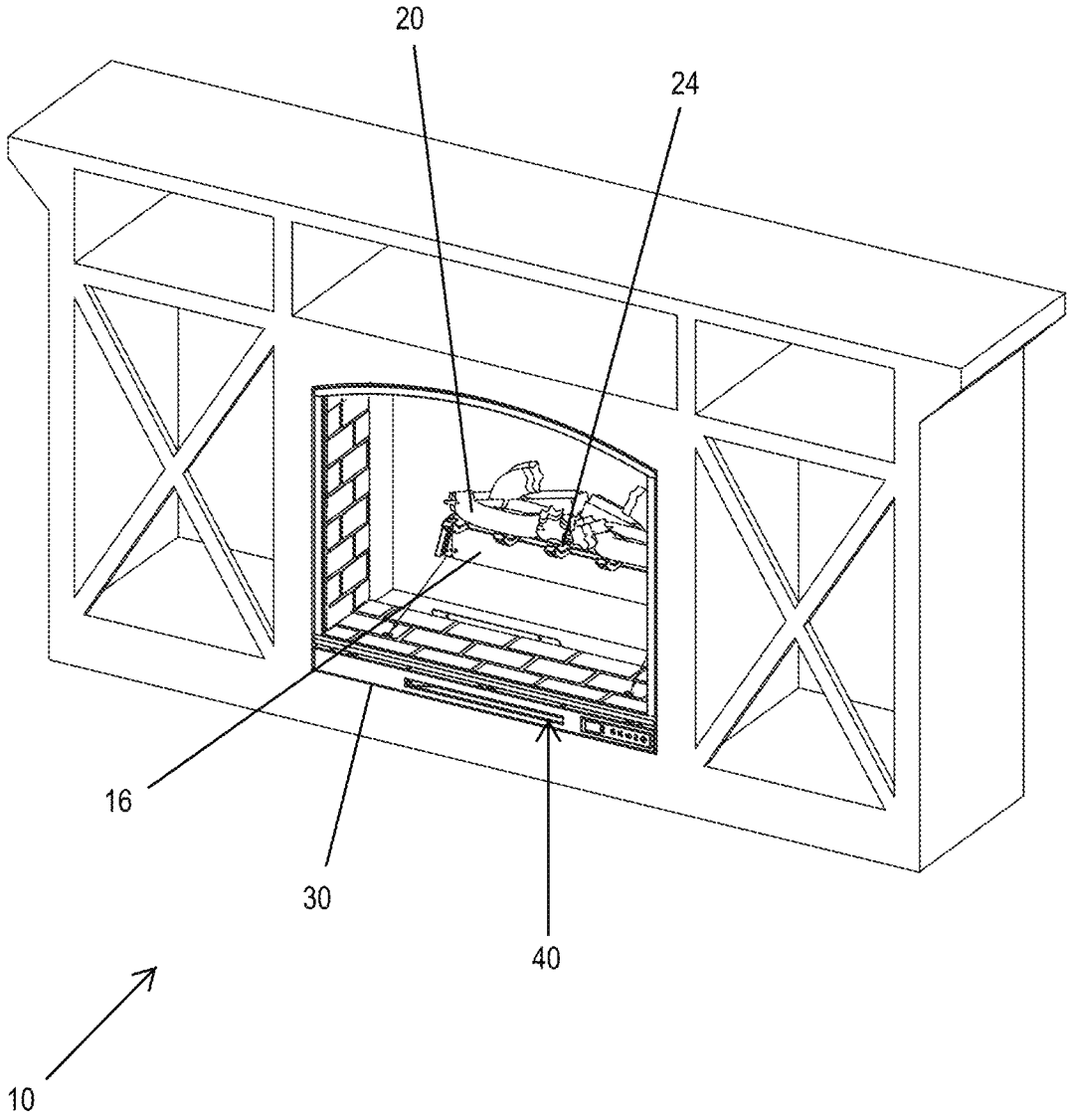

FIG. 6E is a front perspective view illustration of the electric fireplace 10, with the grate 16, the simulated logs 20, the light source 22 (illustrated in FIG. 1) and the flame generator 24 in the process of being installed above the base module, i.e. the electrical insert 40 and the base panel 30.

Figure 6F:
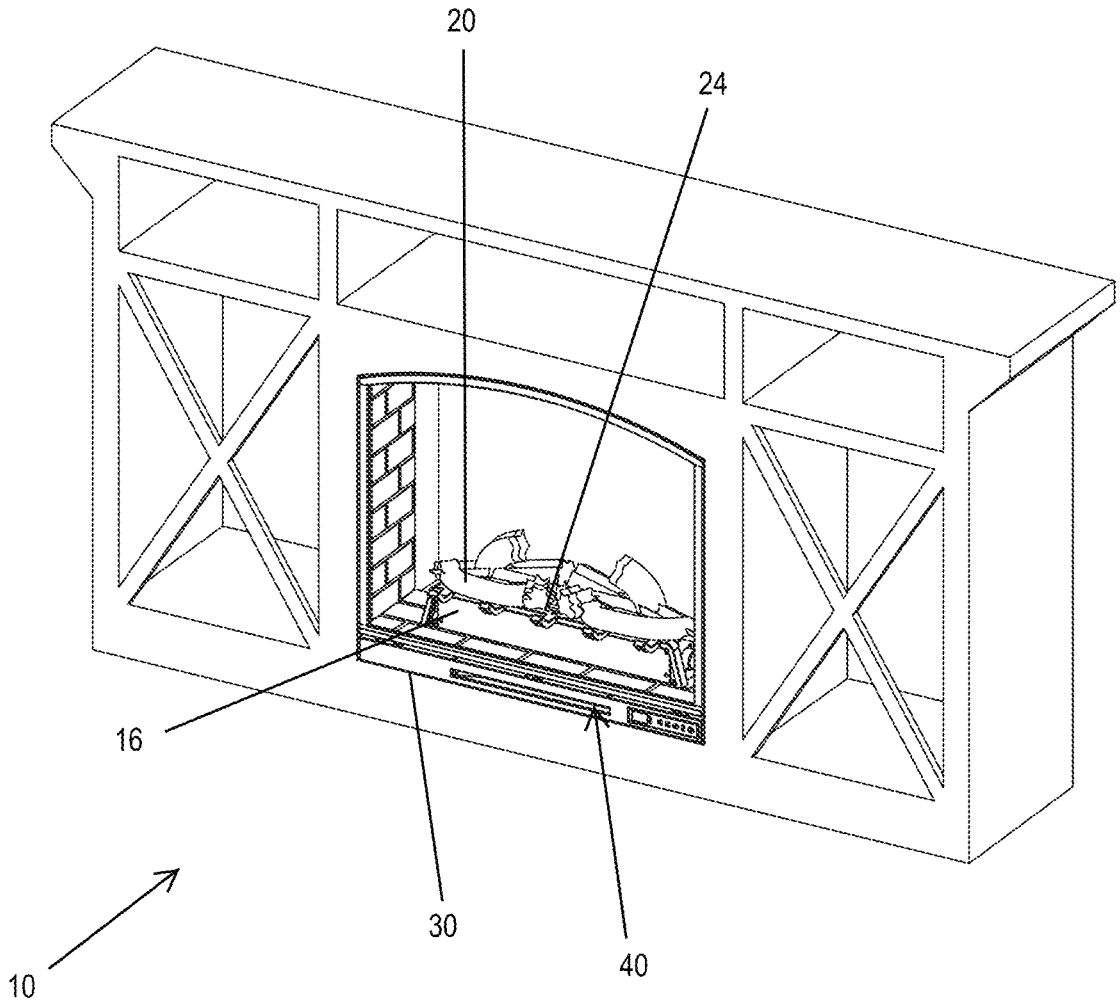

FIG. 6F is another front perspective view illustration of the electric fireplace 10, after the grate 16, the simulated logs 20, the light source 22 (illustrated in FIG. 1) and the flame generator 24 have been installed above the base module, i.e. the electrical insert 40 and the base panel 30.

Figure 6G:
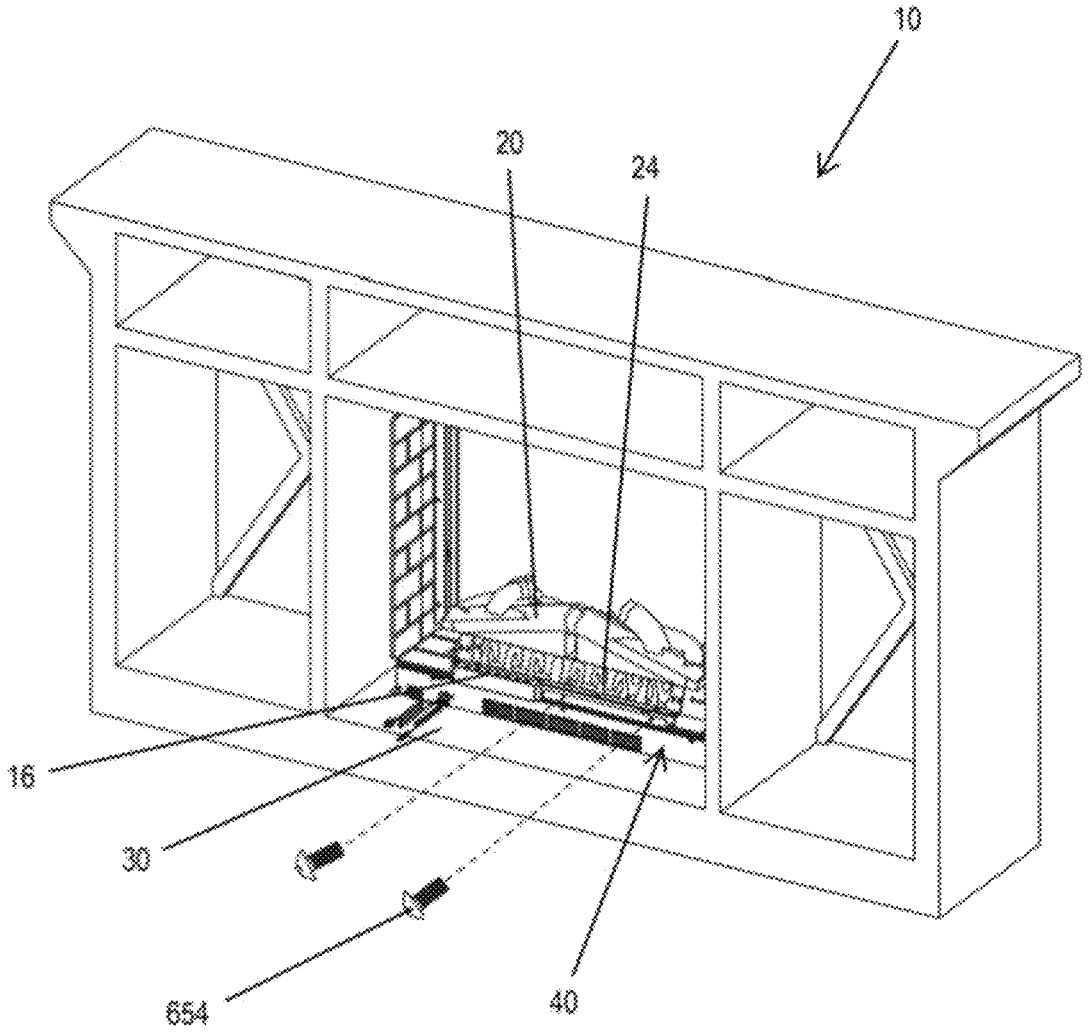

FIG. 6G is a rear perspective view illustration of the electric fireplace 10, with the grate 16, the simulated logs 20, the light source 22 (illustrated in FIG. 1) and the flame generator 24 being secured in place above the base module, i.e. the electrical insert 40 and the base panel 30, with a plurality of grate attachers 354. The electric fireplace 10 can include any suitable number and design of grate attachers 654. For example, in one embodiment, as shown in FIG. 6G, the electric fireplace 10 can include two screw-type grate attachers 654 for purposes of effectively securing the grate 16, the simulated logs 20, the light source 22 and the flame generator 24 in place above the base module. Alternatively, the electric fireplace 10 can include greater than two or fewer than two grate attachers 654, and/or the grate attachers 654 can have another suitable design.

Figure 6H:
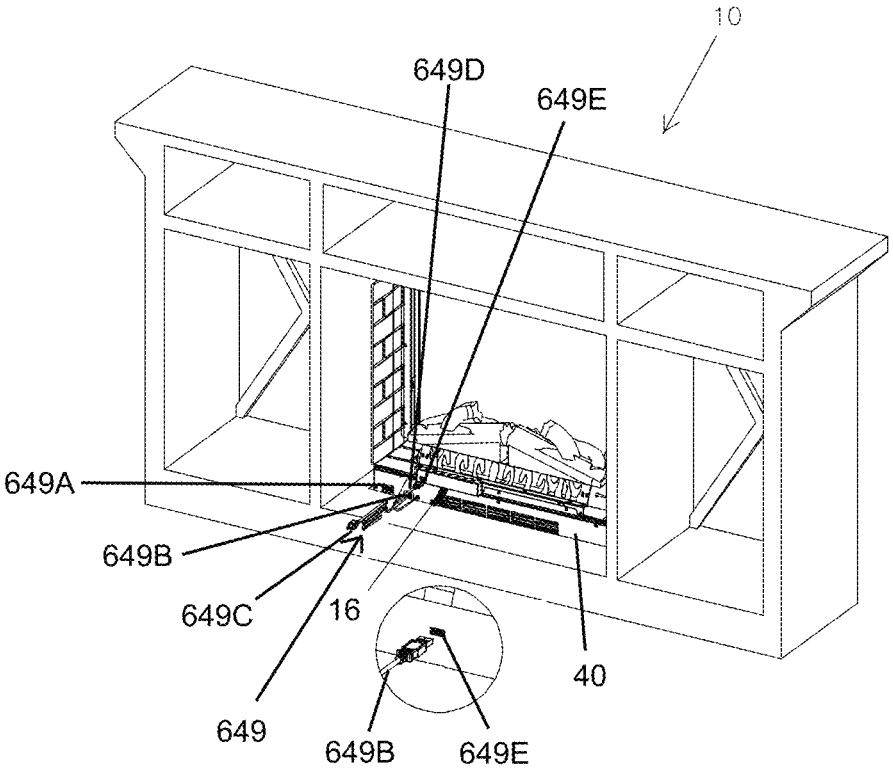

FIG. 6H is a rear perspective view illustration of the electric fireplace 10, further illustrating a portion of the electrical connection assembly 649 that can be utilized to selectively provide power to the various electrical components of the electric fireplace 10. More particularly, FIG. 6H illustrates that the electrical connection assembly 649 can include the first electrical connection port 649A, the second electrical connection port 649B (e.g., a low voltage DC port such as a USB port), the first electrical cable assembly 649C (e.g., the AC external power cord with corresponding connector(s)), the second electrical cable assembly 649D (e.g., the low voltage DC cable such as a USB cable with corresponding connector(s), also shown in the enlarged view), and the third electrical connection port 649E (e.g., a low voltage DC port such as a USB port, also shown in an enlarged view). As such, power can be supplied from the external power source 42 (illustrated in FIG. 1) to the electrical insert 40, i.e. the heater assembly 26 (illustrated in FIG. 6A) and the controller 28 (illustrated in FIG. 6A), and then from the electrical insert 40 to the grate 16, i.e. to the light source 22 (illustrated in FIG. 1) and/or the flame generator 24 (illustrated in FIG. 6E).

Figure 6I:
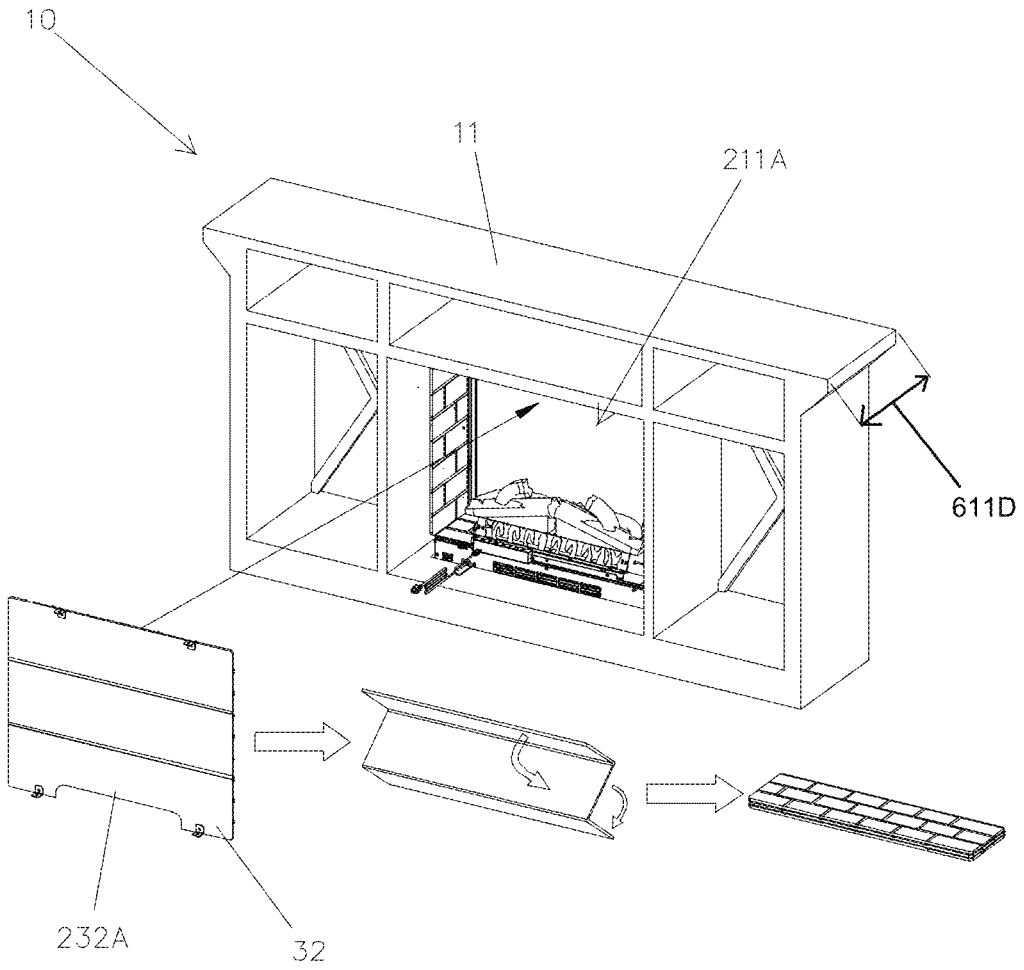

FIG. 6I is a rear perspective view illustration of the electric fireplace 10, as the back panel 32 is about to be installed within the structural opening 211A of the cabinet 11. Additionally, FIG. 6I further illustrates that in one embodiment, the back panel 30 can be mounted on a segmented substrate 232A to enable the back panel 32 to be foldable. As noted above, with such design, the back panel 32 can be packed more compactly for purposes of shipping and/or storage.

FIG. 6I further illustrates a cabinet depth 611D for the cabinet 11. In certain non-exclusive embodiments, the cabinet 11 can have a cabinet depth 611D of between approximately 100 centimeters and 170 centimeters. Alternatively, the cabinet 11 can have a cabinet depth 611D that is greater than approximately 170 centimeters or less than approximately 100 centimeters.

Figure 6J:
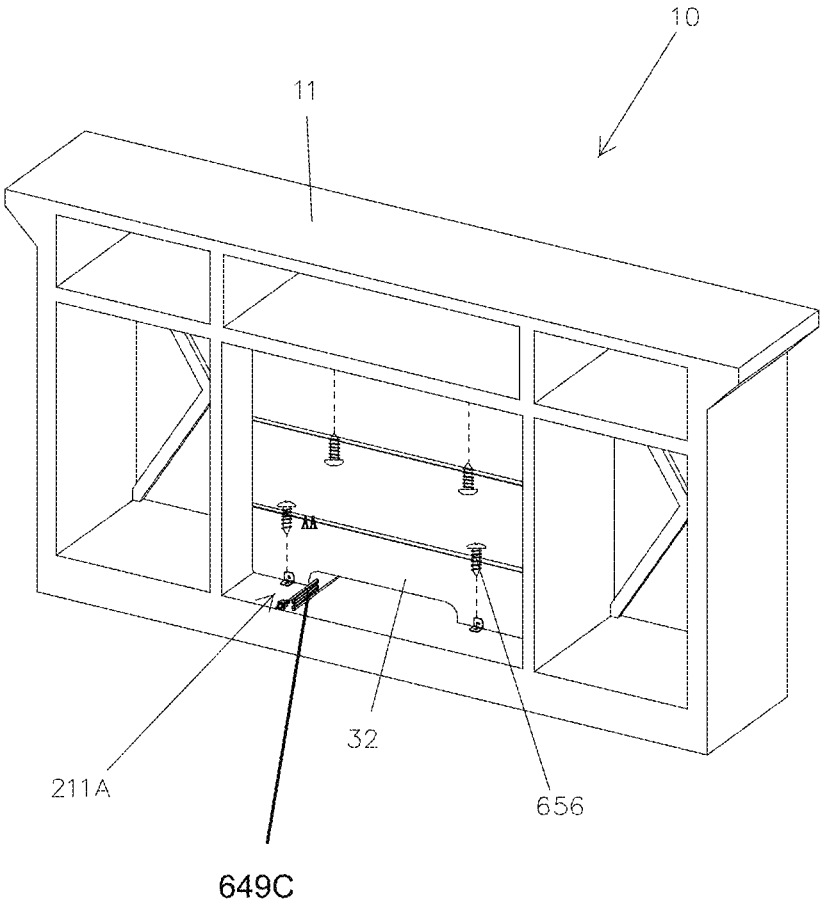

FIG. 6J is another rear perspective view illustration of the electric fireplace 10, during the process of installing the back panel 32 within the structural opening 211A of the cabinet 11. In particular, FIG. 6J illustrates a plurality of panel attachers 656 that can be utilized for installing and securing the back panel 32 within the structural opening 211A of the cabinet 11. The electric fireplace 10 can include any suitable number and design of panel attachers 656. For example, in one embodiment, as shown in FIG. 6J, the electric fireplace 10 can include four screw-type panel attachers 656 for purposes of effectively securing the back panel 32 within the structural opening 211A of the cabinet 11. Alternatively, the electric fireplace 10 can include greater than four or fewer than four panel attachers 656, and/or the panel attachers 656 can have another suitable design.

Additionally, FIG. 6J also illustrates the first electrical cable assembly 649C that is usable for connecting the electric fireplace 10 to the external power source 42 (illustrated in FIG. 1), such as an electrical outlet.

Figure 6K:
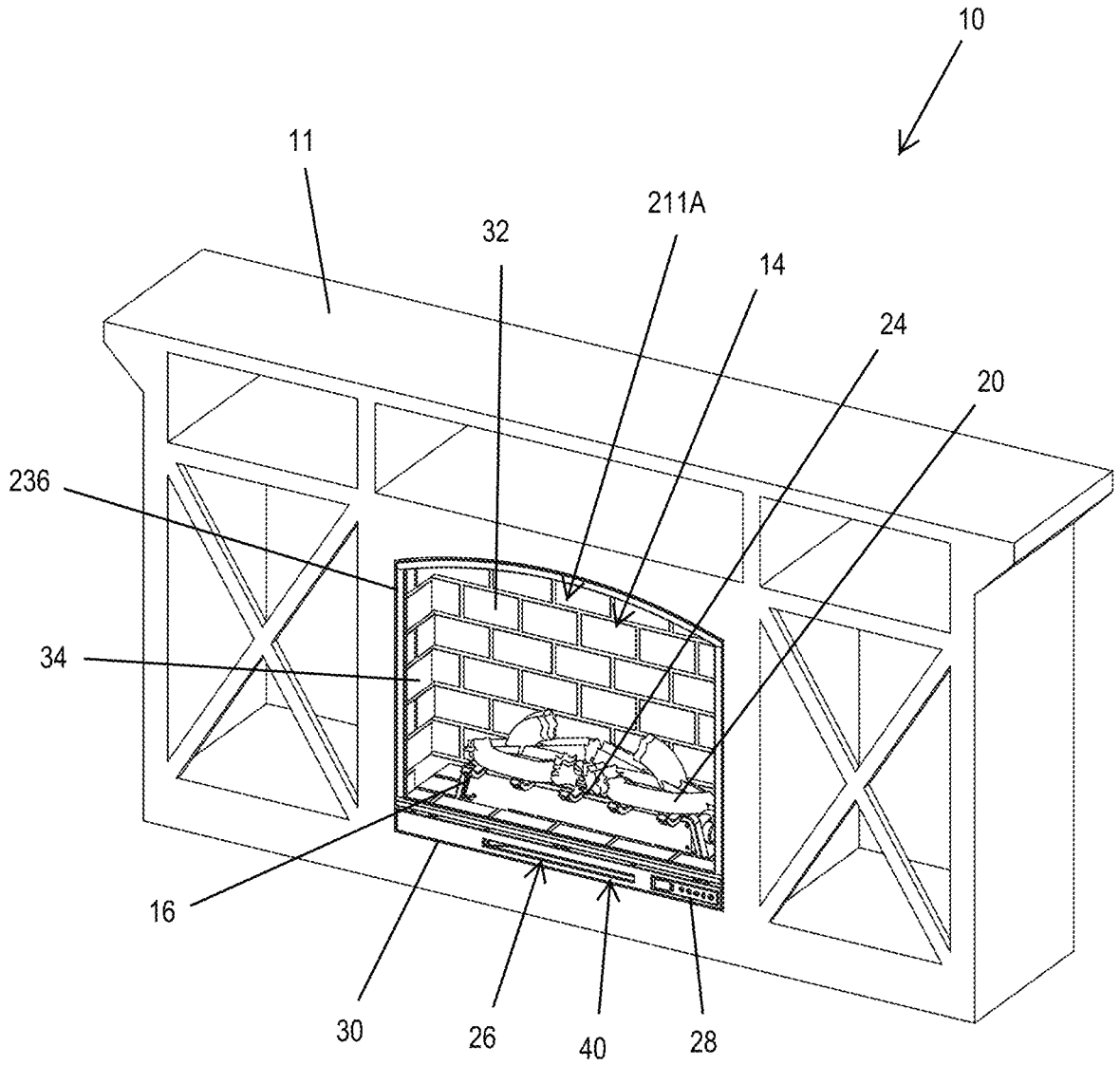

Finally, FIG. 6K is a front perspective view illustration of the electric fireplace 10, after all of the components of the electric fireplace 10 have been installed and/or secured within the structural opening 211A of the cabinet 11. More specifically, FIG. 6K illustrates the electric fireplace 10 after the base panel 30, the side panels 34, the front frame 236, the electrical insert 40, i.e. the heater assembly 26 and the controller 28 in this embodiment, the grate 16, the simulated logs 20, the light source 22 (illustrated in FIG. 1), the flame generator 24, and the back panel 32 have been installed and/or secured within the structural opening 211A of the cabinet 11.

Additionally, or in the alternative, it is appreciated that, in some embodiments, the electric fireplace 10 can be configured without the back panel 32 and/or the front frame 236. For example, in certain such embodiments, the electric fireplace 10 can be a two-sided fireplace, wherein the viewing area 14 is viewable from either side of the electric fireplace 10. In such embodiments, the electric fireplace 10 would be configured and/or installed without the back panel 32, and could also include a separate front frame 236 on either side.

In summary, the objective of this construction of the electric fireplace 10 is to embed the insert components into the fireplace housing 12 (or mantel) parts to make the combined packaging the same size as a typical mantel-only box size. Additionally, the construction will also improve the aesthetic appearance of the overall electric fireplace 10 as there are no longer height or shape restrictions for the mantel opening. Further, the appearance of the simulated flame 18 will be improved due to increased depth and more backdrop options. Moreover, backdrop depth is no longer limited by insert enclosure size, so heavier textures can be used with larger flame projection. Different backdrop styles and/or reversible backdrops can also be provided for different options at the user level.

Additionally, since there are no limitations on the height of the structural opening 211A, e.g., within the cabinet 11, or the size and shape of the back panel 32 and/or the simulated logs 20, more standardized structural features can be utilized. For example, a standardized 26-inch part can be utilized within 23-inch, 26-inch or 28-inch structural openings; and a standardized 36-inch part can be utilized within 33-inch and 36-inch structural openings. Different heights, shapes and simulated logs can then be utilized to differentiate the overall design.

Figure 7A:
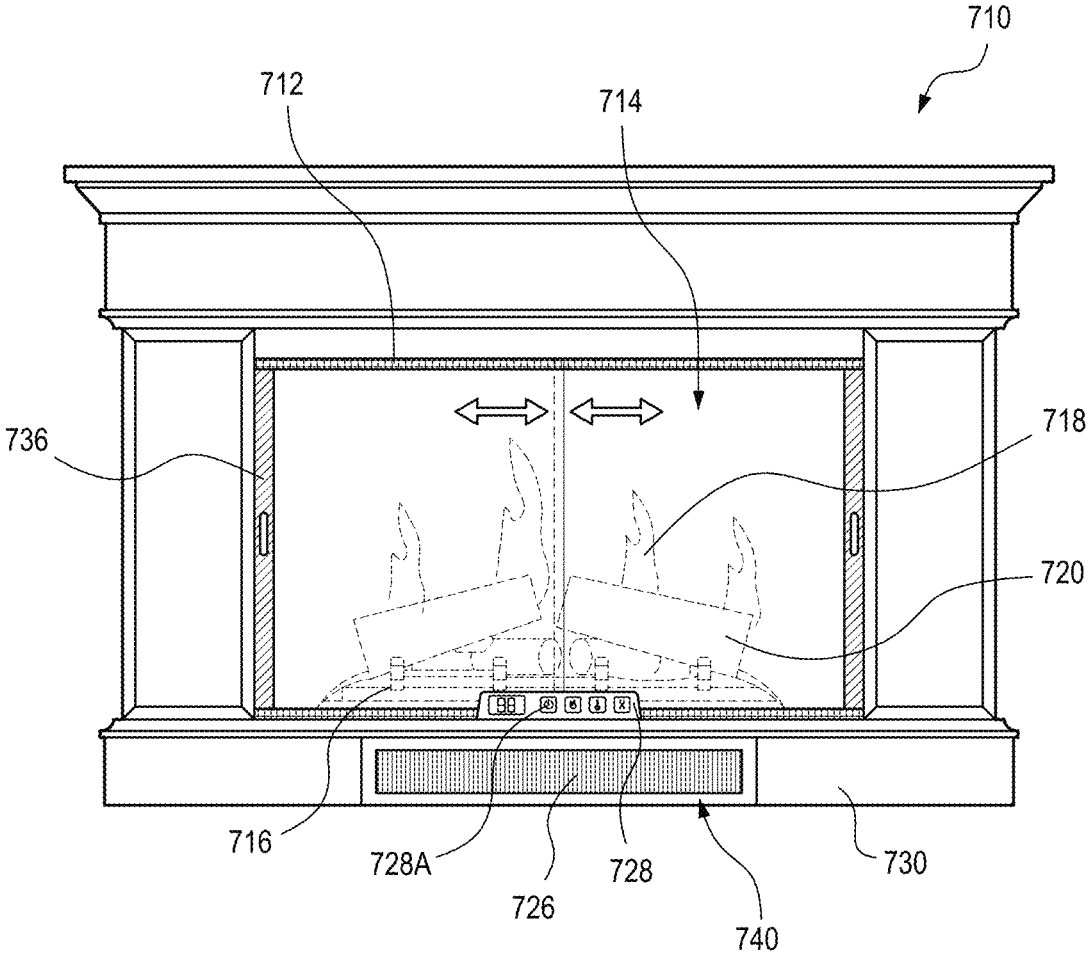
FIG. 7A is a simplified front view illustration of another embodiment of the electric fireplace.

FIG. 7A is a simplified front view illustration of still yet another embodiment of the electric fireplace 710. As illustrated, the electric fireplace 710 is somewhat similar in design to those embodiments illustrated and described herein above. For example, in this embodiment, the electric fireplace 710 again includes a fireplace housing 712, a viewing area 714, a grate 716, a simulated flame 718, simulated logs 720, and a light source 722 (illustrated in FIG. 7B) and/or a flame generator 724 (illustrated more clearly in FIG. 7B) that are substantially similar to what was illustrated and described herein above. Additionally, the electric fireplace 710 further includes an electrical insert 740 that includes a heater assembly 726, and at least portion of a controller 728, that are somewhat similar to what was illustrated and described in certain previous embodiments.

Figure 7B:
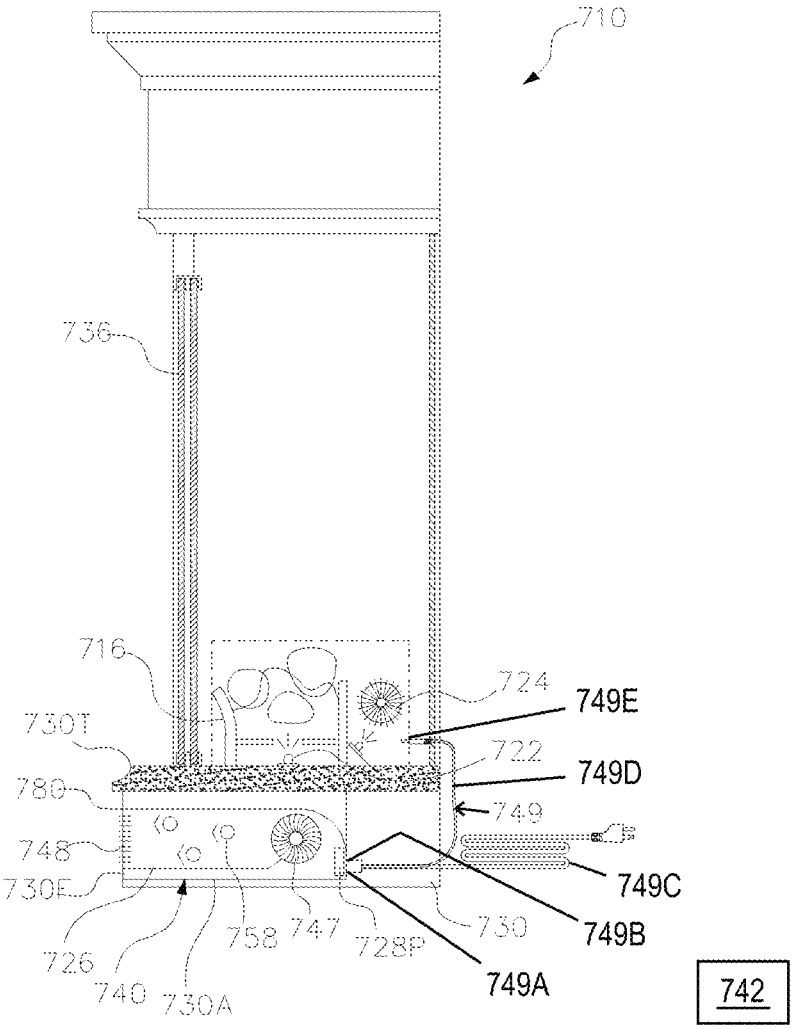
FIG. 7B is a cross-sectional side view illustration of the electric fireplace illustrated in FIG. 7A taken on line B-B.

However, in this embodiment, the base panel 730 of the fireplace housing 712 is somewhat different than in the previous embodiments. Referring briefly to FIG. 7B, FIG. 7B is a cross-sectional side view illustration of the electric fireplace 710 illustrated in FIG. 7A taken on line B-B. In this embodiment, as shown in FIG. 7B, the electrical insert 740 is positioned to be more fully embedded within the base opening 730A of the base panel 730, i.e. such that no part of the electrical insert 740 extends and/or protrudes above a top surface 730T of the base panel 730. With such design, the electric fireplace 710 can have any even more compact overall design during use, as well as for purposes of packaging, shipping and storage.

Additionally, as such, the heater assembly 726 also has a somewhat modified design in comparison to the embodiments described in detail herein above. As with the previous embodiments, the heater assembly 726 is configured to provide heated air which can be directed in a generally outward direction away from the electric fireplace 710. More particularly, as shown in FIG. 7B, the heater assembly 726 includes a fan or blower 747 that blows hot air generated by one or more heating elements 758 through a grill cover 748 (heat vents) into the area surrounding the electric fireplace 710. In this embodiment, the grill cover 748 is positioned to extend and/or direct the heated air through a front opening 780 in the base panel 730. Stated in another manner, the heated air is directed away from a front surface 730F of the base panel 730, i.e. through the grill cover 748, rather than the top surface 730T of the base panel 730 as in certain previous embodiments.

Moreover, in this embodiment, the controller 728 includes components that are included within the electrical insert 740 as well as components that can be alternatively coupled to the grate 716. For example, in one non-exclusive embodiment, the controller 728 can include a main PCBA 728P that is coupled to and/or integrated within the electrical insert 740, and a control panel 728A (illustrated in FIG. 7A) that is coupled to the grate 716 instead of being directly coupled to the body of the electrical insert 740, as was shown in the previous embodiments. With such design, the control panel 728A will be easily accessible to the user, as the user will merely have to open the front frame 736, e.g., by sliding doors of the front frame 736 relative to one another. Alternatively, the control panel 728A can be coupled to and/or incorporated as part of the electrical insert 740, and a separate front opening (not shown) in the base panel 730 can be utilized to provide access to the control panel 728A by the user.

FIG. 7B further illustrates the various components of the electrical connection assembly 749 that can be used to provide the desired power to the electric fireplace 710. More specifically, FIG. 7B further illustrates (i) the first electrical cable assembly 749C that is electrically coupled between the main PCBA 728P of the electrical insert 740, via the first electrical connection port 749A in certain embodiments, and the power source 742; and (ii) the second electrical cable assembly 749D that is electrically coupled between the main PCBA 728P of the electrical insert 740, via the second electrical connection port 749B in certain embodiments, and the grate 716, via the third electrical connection port 749E, and thus the electrical components coupled thereto and/or incorporated therein. Thus, the electrical connection assembly 749 can be used for providing the necessary power to the electrical insert 740, as well as the necessary power and control between the electrical insert 740 and the grate 716, to effectively power one or more of the light source 722, the flame generator 724, the heater assembly 726 and the controller 728.

Figure 8:
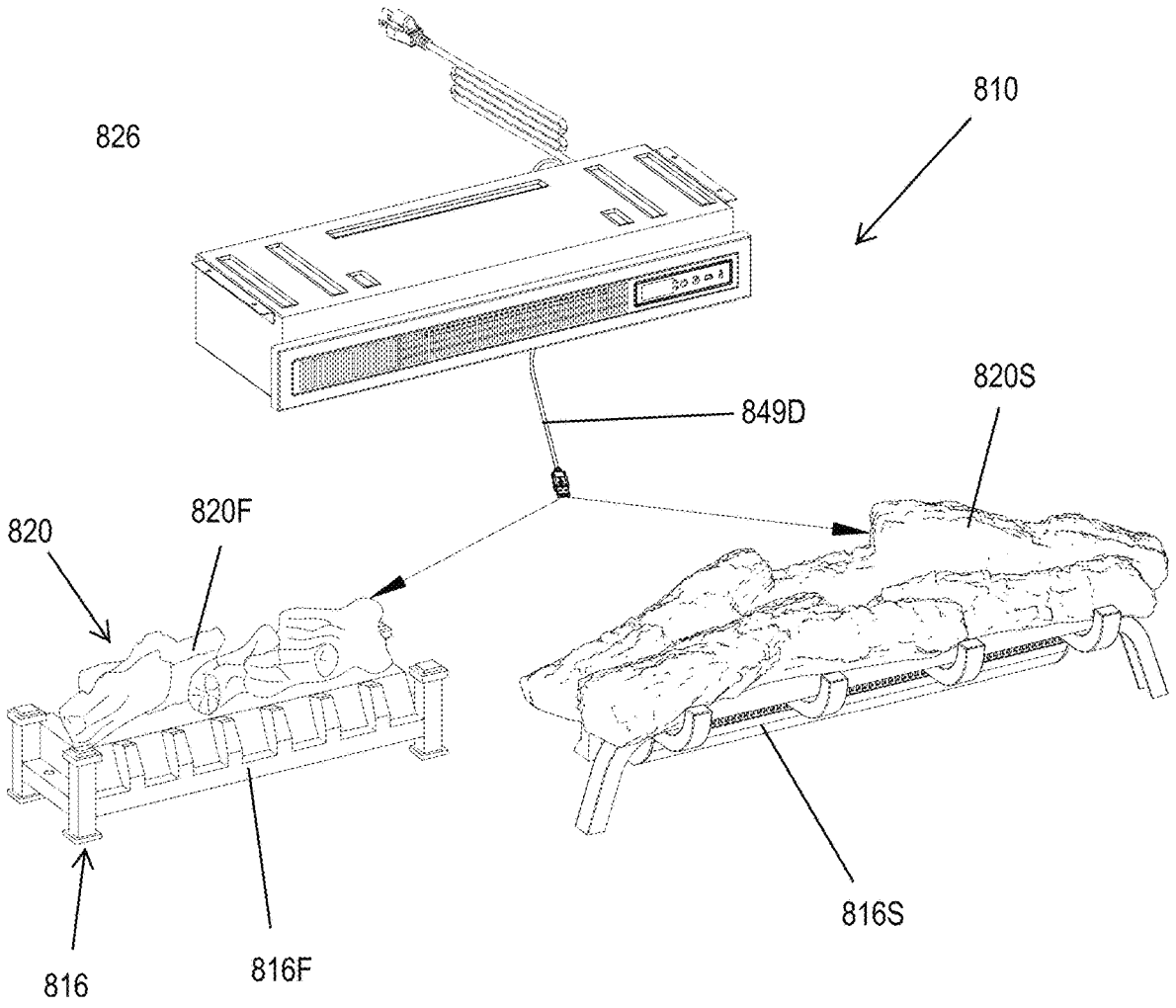
FIG. 8 is a front perspective exploded view of a portion of another embodiment of the electric fireplace.

FIG. 8 is a front partially exploded perspective view of a portion of another embodiment of the electric fireplace 810. More specifically, FIG. 8 illustrates an embodiment of the heater assembly 826, and two alternative embodiments of the grate 816 and the simulated logs 820 that can be mounted on top of the grate 816 and/or integrally formed with the grate 816. In this embodiment, the consumer can alternatively electrically connect a first grate 816F with first simulated logs 820F configuration or a second grate 816S with second simulated logs 820S configuration to the heater assembly 826, i.e. with the second electrical cable assembly 849D which is provided in the form of a low voltage DC connector such as a USB cable with corresponding connector(s). Thus, with such design, the consumer can selectively and alternatively choose any desired grate 816 and simulated logs 820 configuration to achieve a desired aesthetic appearance for the electric fireplace 810. Further, the consumer can later upgrade the grate 816 and/or simulated logs 820 in the event a more realistic or more visually desirable one is available. It is appreciated that the low voltage DC connector used with the second electrical cable assembly 849D allows for easy electrical connection of the grate 816 and simulated logs 820 for easy and convenient interchangeability as desired. Stated in another manner, with the low voltage DC connector used with the second electrical cable assembly 849D, any configuration of grate 816 and simulated logs 820 can be quickly and easily electrically connected and/or disconnected by the consumer to provide any desired aesthetic appearance for the electric fireplace 810.

It is further appreciated that because the light source 22 (illustrated in FIG. 1) and/or the flame generator 24 (illustrated in FIG. 1) are often included, incorporated and/or embedded within the grate 816, the selection of the desired grate 816 and simulated logs 820 configuration can also include variations for the light source 22 and/or the flame generator 24. Thus, the consumer is also able to selectively choose the type of simulated flame 18 (illustrated in FIG. 1), glowing effect for the simulated logs 820, and/or glowing effect for the simulated emberbed, as part of the selection between alternative grate 816 and simulated logs 820 configurations, to further enhance any desired aesthetic appearance for the electric fireplace 810.

Figure 9A:
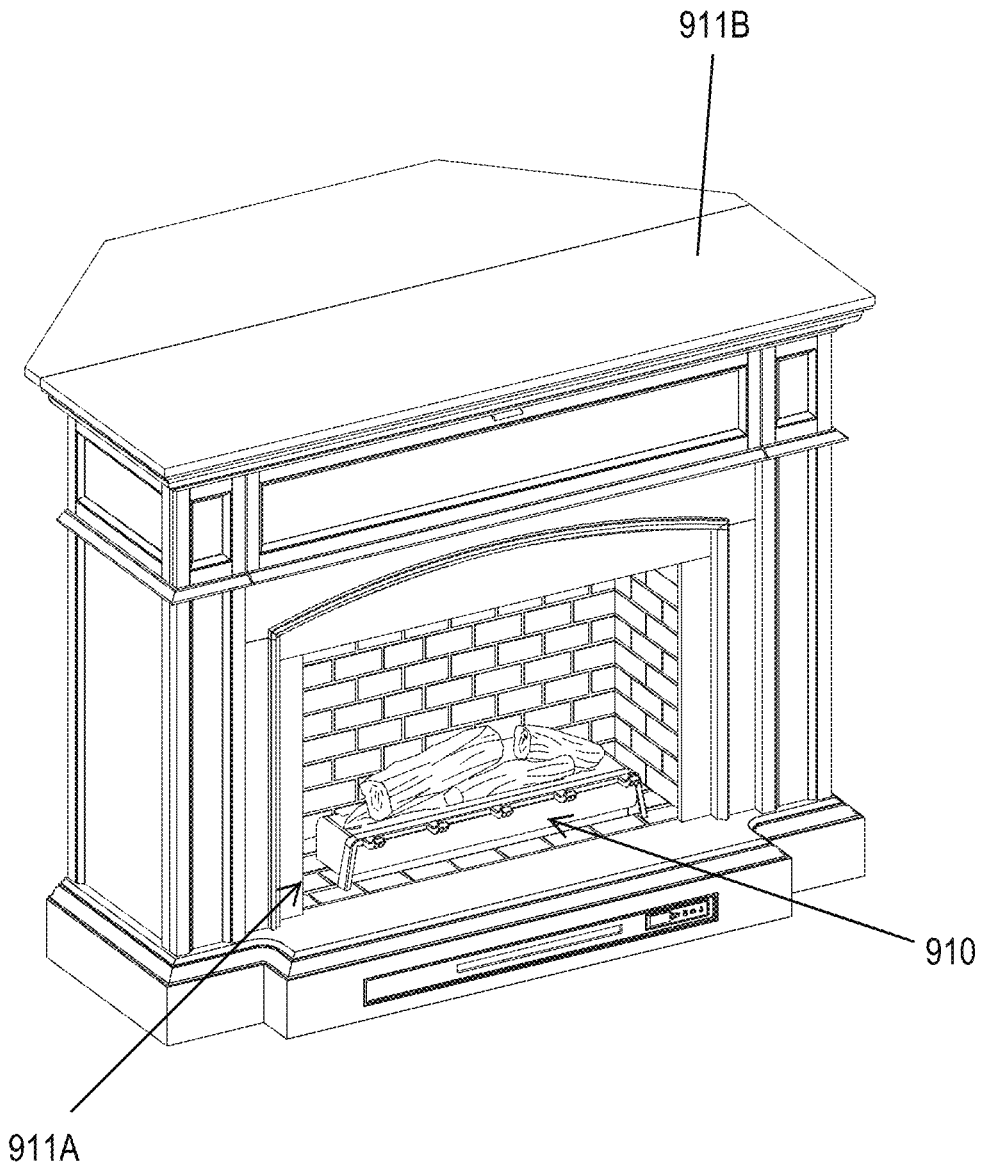
FIG. 9A is a front perspective view illustration of still another embodiment of the electric fireplace that has been installed within a modular cabinet assembly.

FIG. 9A is a front perspective view illustration of still another embodiment of the electric fireplace 910 that has been installed within a modular cabinet assembly 911B. More particularly, FIG. 9A illustrates each of the electric fireplace 910 and the modular cabinet assembly 911B in a fully assembled configuration. FIG. 9A also illustrates the electric fireplace 910 fully installed within the structural opening 911A as defined within the assembled cabinet assembly 911B.

Figure 9B:
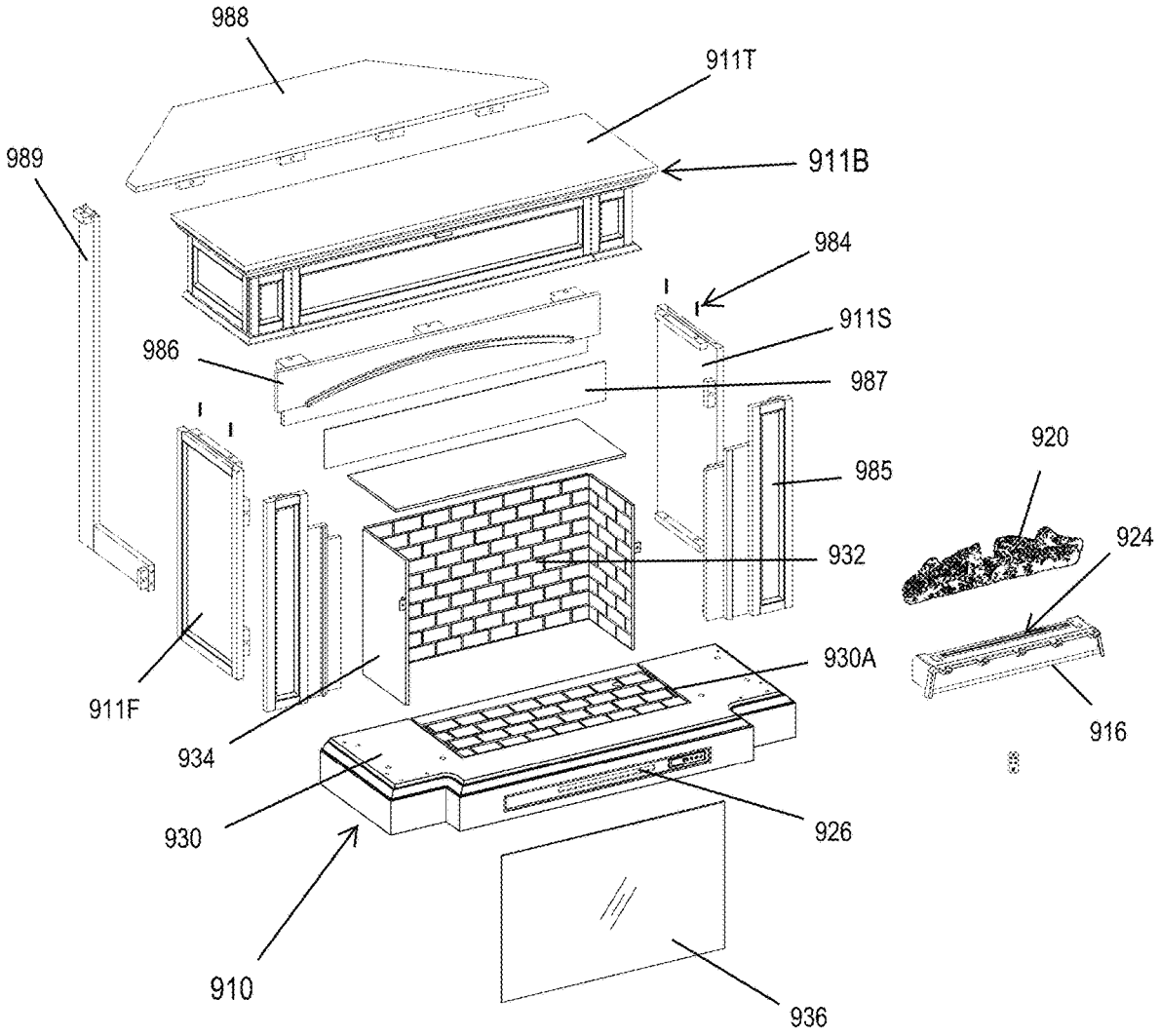
FIG. 9B is an exploded view illustration of the electric fireplace and the modular cabinet assembly illustrated in FIG. 8A.

FIG. 9B is an exploded view illustration of the electric fireplace 910 and the modular cabinet assembly 911B illustrated in FIG. 9A, i.e. the electric fireplace 910 and the cabinet assembly 911B are in an unassembled configuration. It should be noted that in the unassembled configuration, the components of the electrical fireplace 910 and cabinet assembly 911B can be arranged and packaged into a container having a relatively small form factor.

FIG. 9B illustrates all of the various modular components of the electric fireplace 910 and the modular cabinet assembly 911B that are configured to be assembled and/or installed by the consumer after being shipped and package at the factory. During assembly and/or installation of the electric fireplace 910 and the cabinet assembly 911B by the consumer, it is appreciated that at least a portion of the cabinet assembly 911B will typically be assembled by the consumer prior to any components of the electric fireplace 910 being installed within the structural opening 911A (illustrated in FIG. 9A) of the cabinet assembly 911B. For example, as shown, the cabinet assembly 911B can include at least a cabinet top 911T, a first cabinet side 911F and a second cabinet side 911S that are provided as separate components. In various embodiments, prior to any components of the electric fireplace 910 being installed within the structural opening 911A of the cabinet assembly 911B, the first cabinet side 911F and the second cabinet side 911S can be assembled to the cabinet top 911T with a cabinet attachment assembly 984 (e.g., utilizing one or more screws, pins, or other suitable fasteners or attachers), which helps to define the structural opening 911A of the cabinet assembly 911B when in an assembled configuration.

As illustrated, in certain embodiments, the cabinet assembly 911B can further include one or more of front panels 985, a center panel 986, a door panel 987, a corner panel 988, and a corner support 989 that can be individually attached with any suitable attachers or fasteners to the other components of the cabinet assembly 911B as the cabinet assembly 911B is moved from the unassembled configuration to the assembled configuration. It should be noted that the unassembled components of the cabinet assembly 911B can be generically referred to as cabinet structural components. For example, the cabinet structural components of the cabinet assembly 911B of FIGS. 9A and 9B can include the cabinet top 911T, the first cabinet side 911F, the second cabinet side 911S, the base panel 930, the front panels 985, the center panel 986, the door panel 987, the corner panel 988, and the corner support 989.

Additionally, it is further appreciated that during installation of the electric fireplace 910 within the structural opening 911A of the cabinet assembly 911B, (i) in one step the heater assembly 926 can be installed within the structural opening 911A of the cabinet assembly 911B (although it is appreciated that in certain alternative embodiments, the heater assembly 926 can come preinstalled within the base opening 930A of the base panel 930), (ii) in another step the heater assembly 926 can be electrically connected to the power source 42 (illustrated in FIG. 1), e.g., an AC power source, with the first electrical cable assembly 249C (illustrated in FIG. 2), e.g., an AC power cord with corresponding connector(s), of the electrical connection assembly 249 (illustrated in FIG. 2), (iii) in still another step the grate 916 with the light source 22 (illustrated in FIG. 1) and/or the flame generator 924 integrally formed therein or coupled thereto can be installed within the structural opening 911A of the cabinet assembly 911B, and (iv) in yet another step the light source 22, the flame generator 924 and/or the grate 916 can be electrically connected to the heater assembly 926 with the second electrical cable assembly 249D (illustrated in FIG. 2), e.g., a low voltage DC cable such as a USB cable with corresponding connector(s), of the electrical connection assembly 249.

As provided above, in certain implementations, the heater assembly 926 can be preinstalled at the factory (and shipped) within the base opening 930A of the base panel 930 or within another cabinet structural component of the modular cabinet assembly 911B. In this design, when the base panel 930 is secured to the other components of the modular cabinet assembly 911B, the heater assembly 926 will be concurrently positioned in or near to (e.g., just below) the structural opening 911A. Stated in another fashion, with this design, the heater assembly 926 can be secured to and/or positioned within at least one of the cabinet structural components at the factory, and subsequently packaged, and shipped in this configuration. This simplifies the subsequent assembly of the components, while maintaining a compact form factor for shipping.

Further, as shown, the electric fireplace 910 can further include one or more of simulated logs 920, a back panel 932, side panels 934 and a front frame 936 that can each be individually (or collectively in some implementations of the back panel 932 and side panels 934) installed and/or positioned within the structural opening 911A of the cabinet assembly 911B.

Figure 10A:
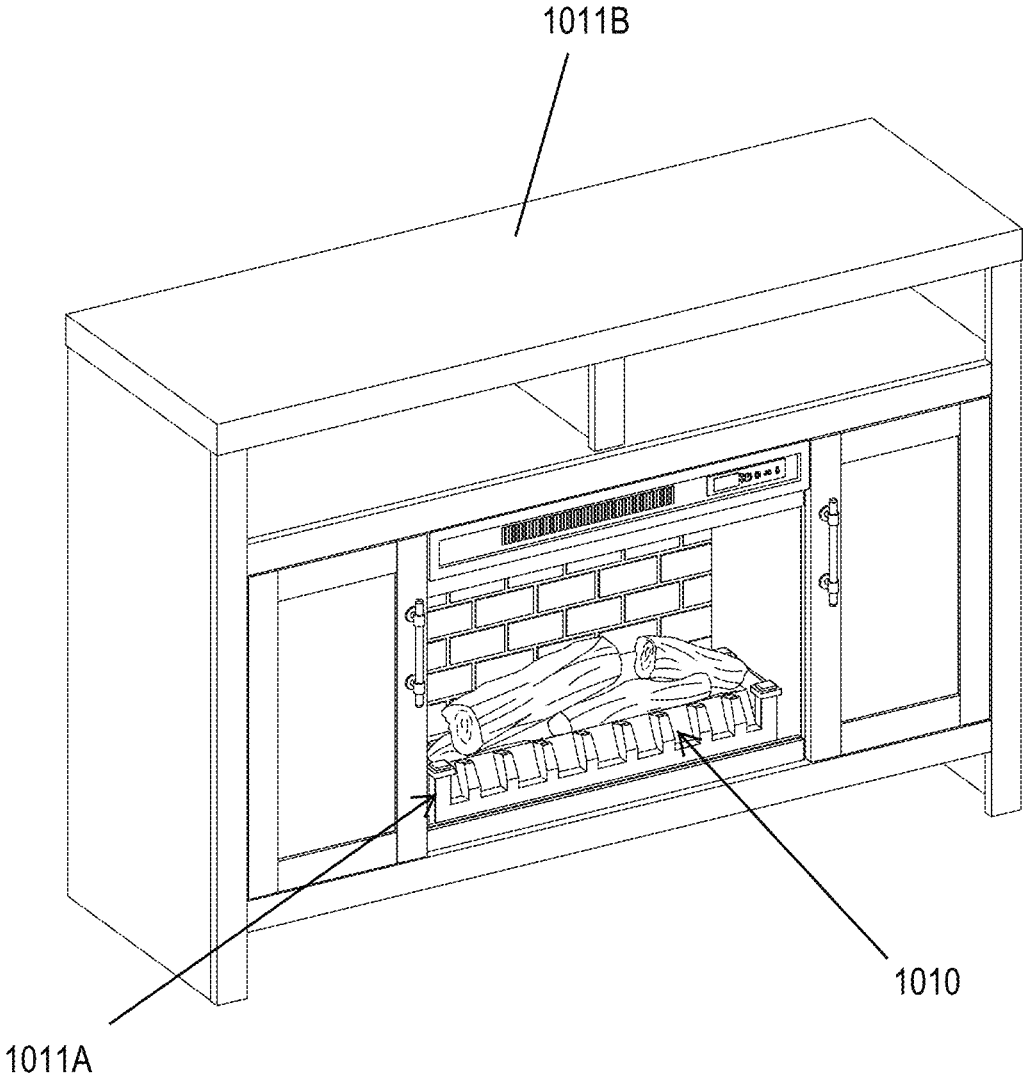
FIG. 10A is a front perspective view illustration of yet another embodiment of the electric fireplace that has been installed within another embodiment of the modular cabinet assembly.

FIG. 10A is a front perspective view illustration of yet another embodiment of the electric fireplace 1010 that has been installed within another embodiment of the modular cabinet assembly 1011B. More particularly, FIG. 10A illustrates each of the electric fireplace 1010 and the modular cabinet assembly 1011B in a fully assembled configuration. FIG. 10A also illustrates the electric fireplace 1010 fully installed within the structural opening 1011A of the assembled cabinet assembly 1011B.

Figure 10B:
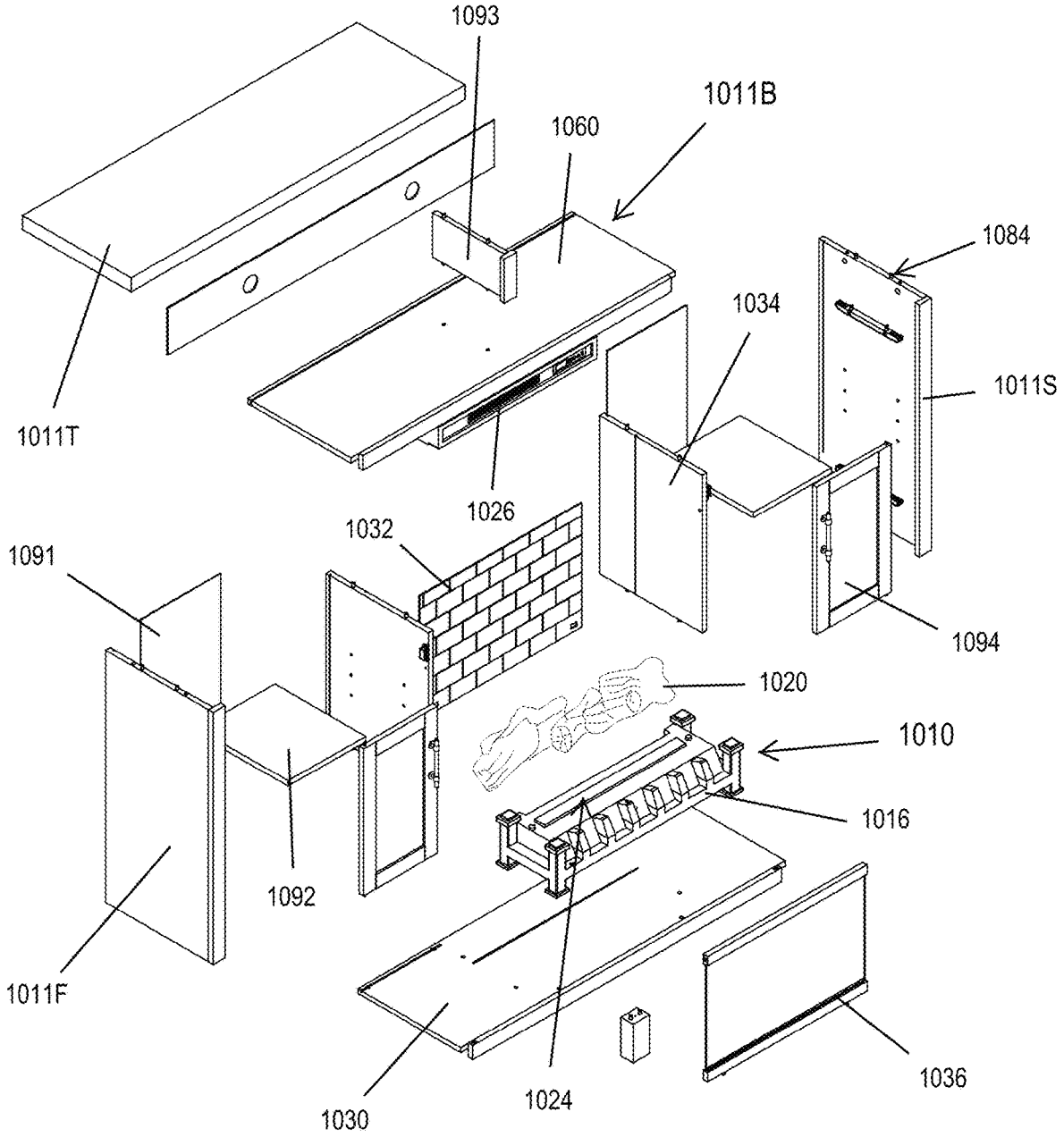
FIG. 10B is an exploded view illustration of the electric fireplace and the modular cabinet assembly illustrated in FIG. 9A.

FIG. 10B is an exploded view illustration of the electric fireplace 1010 and the modular cabinet assembly 1011B illustrated in FIG. 10A, i.e. the electric fireplace 1010 and the cabinet assembly 1011B are in an unassembled configuration. More specifically, FIG. 10B illustrates all of the various modular components of the electric fireplace 1010 and the modular cabinet assembly 1011B that are configured to be assembled and/or installed by the consumer. During assembly and/or installation of the electric fireplace 1010 and the cabinet assembly 1011B by the consumer, it is appreciated that at least a portion of the cabinet assembly 1011B will typically be assembled by the consumer prior to any components of the electric fireplace 1010 being installed within the structural opening 1011A (illustrated in FIG. 10A) of the cabinet assembly 10118. For example, as shown, the cabinet assembly 1011B can include at least a cabinet top 1011T, a first cabinet side 1011F and a second cabinet side 1011S that are provided as separate components. In various embodiments, prior to any components of the electric fireplace 1010 being installed within the structural opening 1011A of the cabinet assembly 1011B, the first cabinet side 1011F and the second cabinet side 1011S can be assembled to the cabinet top 1011T with a cabinet attachment assembly 1084 (e.g., utilizing one or more screws, pins, or other suitable fasteners or attachers), which helps to define the structural opening 1011B of the cabinet assembly 1011B when in an assembled configuration.

As illustrated, in certain embodiments, the cabinet assembly 1011B can further include one or more of back panels 1091, a center shelf 1060, another shelf 1092, a partition 1093, and doors 1094 that can be individually attached with any suitable attachers or fasteners to the other components of the cabinet assembly 1011B as the cabinet assembly 1011B is moved from the unassembled configuration to the assembled configuration. It should be noted that the unassembled components of the cabinet assembly 1011B can be generically referred to as cabinet structural components. For example, the cabinet structural components of the cabinet assembly 1011B of FIGS. 10A and 10B can include the cabinet top 1011T, the first cabinet side 1011F, the second cabinet side 1011S, the base panel 1030, one or more of back panels 1091, the center shelf 1060, another shelf 1092, the partition 1093, and the doors 1094.

Additionally, it is further appreciated that during installation of the electric fireplace 1010 within the structural opening 1011A of the cabinet assembly 1011B, (i) in one step the heater assembly 1026 can be installed within the structural opening 1011A of the cabinet assembly 1011B (although it is appreciated that in certain alternative embodiments, the heater assembly 1026 can come preinstalled and/or coupled adjacent to the center shelf 1060 of the cabinet assembly 1011B), (ii) in another step the heater assembly 1026 can be electrically connected to the power source 42 (illustrated in FIG. 1), e.g., an AC power source, with the first electrical cable assembly 249C (illustrated in FIG. 2), e.g., an AC power cord with corresponding connector(s), of the electrical connection assembly 249 (illustrated in FIG. 2), (iii) in still another step the grate 1016 with the light source 22 (illustrated in FIG. 1) and/or the flame generator 24 (illustrated in FIG. 1) integrally formed therein or coupled thereto can be installed within the structural opening 1011A of the cabinet assembly 1011B, and (iv) in yet another step the light source 22, the flame generator 24 and/or the grate 1016 can be electrically connected to the heater assembly 1026 with the second electrical cable assembly 249D (illustrated in FIG. 2), e.g., a low voltage DC cable such as a USB cable with corresponding connector(s), of the electrical connection assembly 249.

As provided above, in certain implementations, the heater assembly 1026 can be preinstalled at the factory (and shipped) attached to the center shelf 1060 (or other cabinet structural component of the modular cabinet assembly 1011B). In this design, when the center shelf 1060 is secured to the other components of the modular cabinet assembly 1011B, the heater assembly 1026 will be concurrently positioned in or near to (e.g., just above) the structural opening 1011A. Stated in another fashion, with this design, the heater assembly 1026 can be secured to and/or positioned within at least one of the cabinet structural components at the factory, and subsequently packaged, and shipped in this configuration. This simplifies the subsequent assembly of the components, while maintaining a compact form factor for shipping.

Further, as shown, the electric fireplace 1010 can further include one or more of simulated logs 1020, a base panel 1030, a back panel 1032, side panels 1034 and a front frame 1036 that can each be individually (or collectively in some implementations of the back panel 1032 and side panels 1034) installed and/or positioned within the structural opening 1011A of the cabinet assembly 1011B.

Figure 11A:
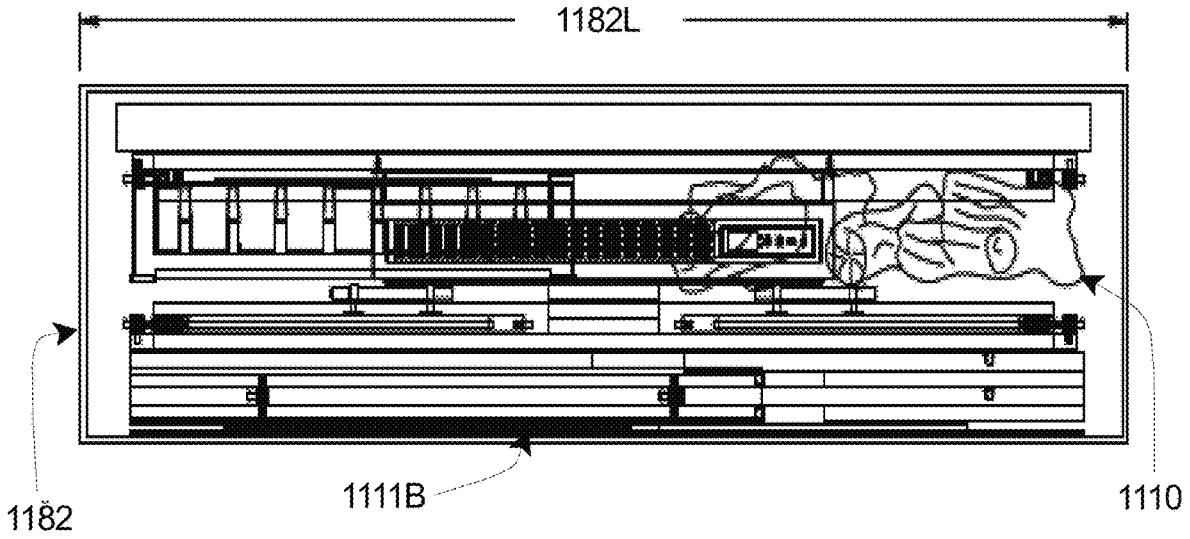
FIG. 11A is a simplified side view illustration of an embodiment of the electric fireplace and the modular cabinet assembly in an unassembled configuration, and a package assembly that can be utilized to contain the electric fireplace and the modular cabinet assembly.

FIG. 11A is a simplified side view illustration of an embodiment of the electric fireplace 1110 and the modular cabinet assembly 1111B in an unassembled configuration, and a package assembly 1182 that can be utilized to contain the unassembled, modular electric fireplace 1110 and the unassembled, modular cabinet assembly 1111B concurrently. The package assembly 1182 is illustrated as being substantially transparent in FIG. 11A so that the electric fireplace 1110 and the cabinet assembly 1111B can be seen as packaged within the package assembly 1182. As shown in this embodiment, the electric fireplace 1110 is unassembled within the package assembly 1182, which is a unique advantage of the present invention in how the electric fireplace 1110 and the cabinet assembly 1111B are packaged, shipped and stored, and arrive to the consumer.

As shown in FIG. 11A, with a standard-sized cabinet assembly 1111B, which can be packaged in an unassembled configuration, and the unassembled electric fireplace 1110, in certain embodiments, the package assembly 1182 can have an assembly length 1182L of between approximately 1065 millimeters (approximately 42 inches) and 1525 millimeters (approximately 60 inches). In one non-exclusive embodiment, the package assembly 1182 can have an assembly length 1182L of approximately 1310 millimeters (approximately 51.5 inches).

Figure 11B:
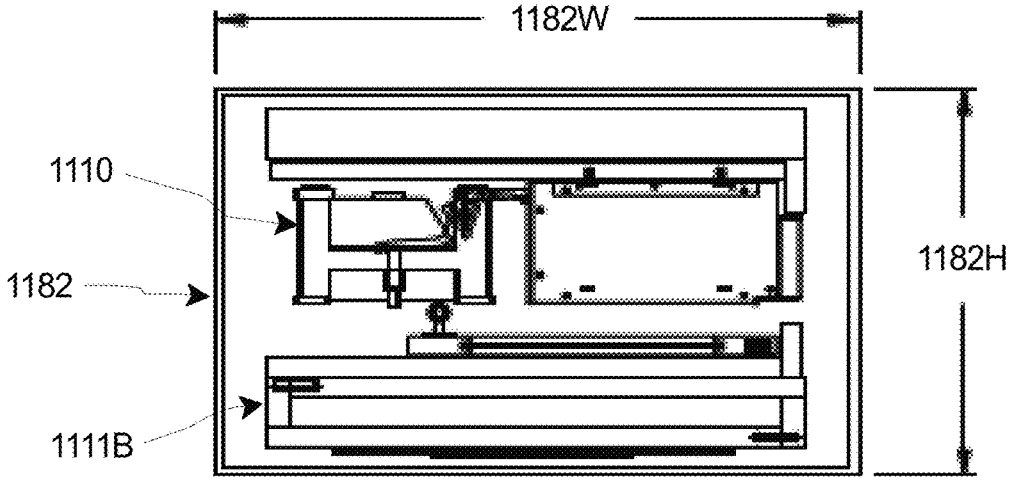
FIG. 11B is a simplified end view illustration of the electric fireplace, the modular cabinet assembly and the package assembly illustrated in FIG. 11A.

FIG. 11B is a simplified end view illustration of the electric fireplace 1110, the modular cabinet assembly 1111B and the package assembly 1182 illustrated in FIG. 11A. The package assembly 1182 is again illustrated as being substantially transparent in FIG. 11B so that the electric fireplace 1110 and the cabinet assembly 1111B can be seen as packaged within the package assembly 1182. As shown in FIG. 11B, in some embodiments, the package assembly 1182 can have an assembly width 1182W of between approximately 380 millimeters (approximately 15 inches) and 560 millimeters (approximately 22 inches). In one non-exclusive embodiment, the package assembly 1182P can have an assembly width 1182W of approximately 470 millimeters (approximately 18.5 inches).

Additionally, FIG. 11B further illustrates that in certain embodiments, the package assembly 1182 can have an assembly height 1182H of between approximately 255 millimeters (approximately 10 inches) and 405 millimeters (approximately 16 inches). In one non-exclusive embodiment, the package assembly 1182 can have an assembly height 1182H of approximately 330 millimeters (approximately 13 inches). As shown, the assembly height 1182H of the package assembly 1182 can be much smaller than in the prior art package assembly 1282P (as described in the Background section herein, and illustrated in FIG. 12B) due to the ability to package the electric fireplace 1110 for the consumer in the unassembled configuration.

Figure 12A:
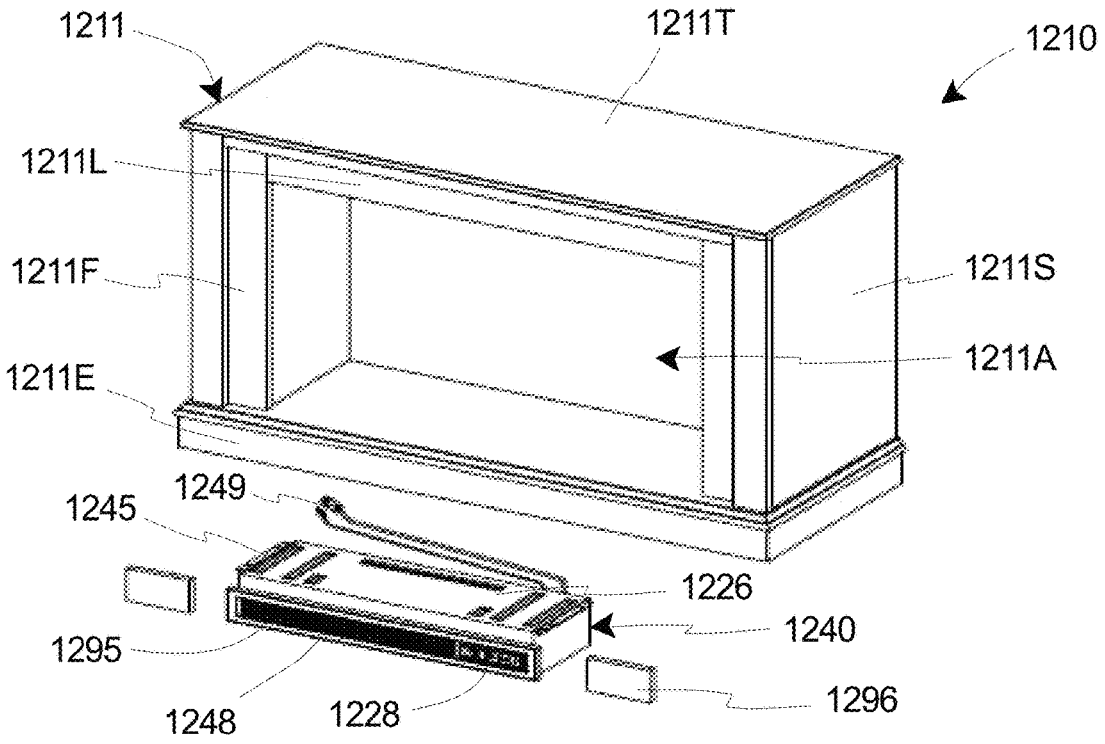
FIG. 12A is a partially exploded front perspective view illustration of a portion of still yet another embodiment of the electric fireplace, including still another embodiment of the heater assembly usable as part of the electric fireplace.

Thus, with the electric fireplace 1110 and the modular cabinet assembly 1111B in the unassembled configuration, the package assembly 1182 is able to retain a desired more compact, reduced form factor for the electric fireplace 1110 and the modular cabinet assembly 1111B in comparison to the prior art package assembly 1282P which includes the electric fireplace 1210P (as described in the Background section herein, and illustrated in FIG. 12A) in the fully assembled configuration. With such design, the more compact, reduced form factor of the package assembly 1182 can greatly reduce the cost of shipping and storing of the electric fireplace 1110 and the modular cabinet assembly 1111B. In some embodiments, the package assembly 1182 can have a reduced form factor relative to the prior art package assembly 1282P such that the package assembly 1182 has an overall size that is between approximately 40% and 90% of the size of the prior art package assembly 1282P. More particularly, in certain non-exclusive embodiments, the reduced form factor of the package assembly 1182 is less than approximately 40%, 45%, 50%, 55%, 60%, 65%, 70%, 75%, 80%, 85% or 90% of the form factor of the prior art package assembly 1282P. Alternatively, the reduced form factor of the package assembly 1182 can have a different relative size in comparison to the form factor of the prior art package assembly 1282P.

Additionally, in various embodiments, the package assembly 1182 can have a package form factor that is substantially equal to, or is only slightly larger than, a form factor of the electric fireplace 1110 and the cabinet assembly 1111B in the unassembled configuration. As utilized herein, the statement that the package assembly 1182 has a package form factor that is substantially equal to, or is only slightly larger than, the form factor of the electric fireplace 1110 and the cabinet assembly 1182 in the unassembled configuration, includes only limited variations for the thickness of the materials used for the package assembly 1182 as well as the size of any secure packaging materials that may be packed around the components of the electric fireplace 1110 and the cabinet assembly 1111B within the package assembly 1182 to protect them from damage during shipping and storage.

Figure 12B:
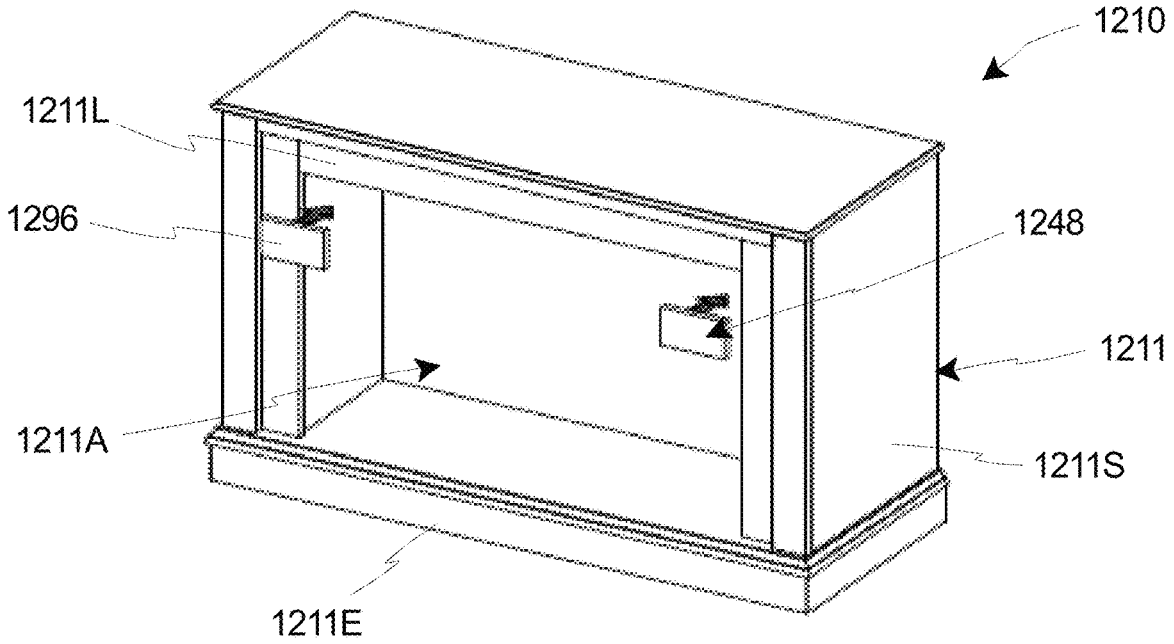
FIG. 12B is a partially exploded front perspective view illustration of a portion of the electric fireplace illustrated in FIG. 12A.

Thus, it is further appreciated that the electric fireplace 1110 and the cabinet assembly 1111B in the unassembled configuration can have an unassembled form factor (such as when they are positioned within the package assembly 1182) that is less than approximately 40%, 45%, 50%, 55%, 60%, 65%, 70%, 75%, 80%, 85% or 90% of a partially assembled form factor of the electric fireplace 1110 and the cabinet assembly 1111B when the electric fireplace 1110 is in the assembled configuration and the cabinet assembly is in the unassembled configuration (such as what is shown in prior art FIGS. 12A and 12B).

As utilized herein, the "form factor" of the package assembly 1182 and/or the components retained therein in the unassembled or assembled configurations is intended to signify the total volume encompassed by the outer surfaces of the package assembly 1182, e.g., assembly length 1182L times assembly width 1182W times assembly height 1182H in a general rectangular box-like configuration.

It is further appreciated that any space saving from having the electric fireplace 1110 and the cabinet assembly 1111B come to the consumer in the unassembled configuration within the package assembly 1182 will be even greater when compared with an electric fireplace that comes fully assembled within a cabinet that is also already fully assembled within any packaging, such as shown in FIGS. 9A and 10A.

FIG. 12A is a partially exploded front perspective view illustration of a portion of still another embodiment of the electric fireplace 1210, including still another embodiment of the heater assembly 1226 usable as part of the electric fireplace 1210. Specifically shown in FIG. 12A are a cabinet 1211 that defines a structural opening 1211A therein, and the heater assembly 1226 that has not yet been installed within the structural opening 1211A of the cabinet 1211. A controller 1228 is also shown as being coupled to and/or incorporated with the heater assembly 1226 as part of the electrical insert 1240. FIG. 12A also shows a portion of an electrical connection assembly 1249 that is usable for providing the necessary power to the electrical components of the electric fireplace 1210, including the heater assembly 1226 and the controller 1228 of the electrical insert 1240.

In the embodiment shown in FIG. 12A, the cabinet 1211 is substantially rectangular-shaped, and includes a cabinet top 1211T, cabinet sides 1211S, and a cabinet base 1211E that cooperate to form a substantially rectangular-shaped structural opening 1211A. The cabinet 1211 further includes a cabinet lip 1211L that is positioned substantially adjacent to and below the cabinet top 1211T, and extends from one cabinet side 1211S to the other cabinet side 1211S near a cabinet front 1211F of the cabinet 1211, in a manner somewhat similar to the shelf lip 360A illustrated in FIG. 3B. Alternatively, the cabinet 1211 and/or the structural opening 1211A defined therein, can have a different size and/or shape than what is specifically shown in FIG. 12A. For example, in certain non-exclusive alternative embodiments, the cabinet 1211 can be designed in a manner similar to any of the cabinets illustrated and described herein.

The electrical insert 1240, including the heater assembly 1226 and the controller 1228, is substantially similar in design and function as embodiments illustrated and described herein above, with the exception of the design of the grill cover 1248 of the heater assembly 1226. In particular, in this embodiment, the grill cover 1248 has a different design that enables the grill cover 1248 to effectively expand from a normal or standard, smaller sized grill cover (similar to the first grill cover 448 shown, for example, in FIG. 4A), to an oversized grill cover (similar to the second grill cover 548 shown, for example, in FIG. 5A).

As shown in FIG. 12A, the heater assembly 1226 includes a heater body 1245 and the grill cover 1248 that has been at least partially, selectively coupled to the heater body 1245, e.g., near a front of the heater body 445 in this particular embodiment. In this embodiment, the grill cover 1248 includes a cover body 1295, and one or more extenders 1296 (two are shown in FIG. 12A) that can be positioned substantially adjacent to and/or selectively coupled to the cover body 1295, and/or selectively coupled to the cabinet 1211, e.g., the cabinet lip 1211L.

The design of the cover body 1295 can be varied. In some embodiments, similar to the grill covers illustrated and described herein above, the cover body 1295 can have an outward appearance including slats or louvers that extend all the way to the edges of the cover body 1295. Alternatively, the cover body 1295 can include slats or louvers that do not extend all the way to the edges of the cover body 1295.

In certain alternative embodiments, the cover body 1295 can have any desired length in order to be used by itself, or with one or more of the extenders 1296, in cabinets 1211 having structural openings 1211A of different sizes and/or widths. For example, in many embodiments, the cover body 1295 can have a cover length that is substantially equal to a body length of the heater body 1245. Thus, with such design, the cover body 1295 can function in a manner substantially similar to the first grill cover 448 illustrated and described in relation to FIG. 4A. Stated in another manner, in such embodiments, the cover body 1295 can be referred to as a "first grill cover" as it is the functional equivalent of the first grill cover 448 of FIG. 4A. Thus, when the cabinet 1211 has a structural opening 1211A with a width that is substantially equal to the length of the cover body 1295 and/or the body length of the heater body 1245, then the grill cover 1248 can be used without any of the one or more extenders 1296.

Additionally, or in the alternative, in some embodiments, if the cabinet 1211 has a structural opening 1211A having a width that is larger or wider than the length of the cover body 1295 and/or the body length of the heater body 1245, then one or more of the extenders 1296 can be positioned substantially adjacent to and/or selectively coupled to the cover body 1295 and/or the cabinet 1211, e.g., the cabinet lip 1211L. Stated in another manner, the cover body 1295 plus the extender(s) 1296 can be referred to as a "second grill cover" as it has become the functional equivalent of the second grill cover 548 of FIG. 5A.

The grill cover 1248 can include any suitable number of extenders 1296, and the extenders 1296 can have any suitable size (i.e. length), and shape. For example, in one embodiment, the grill cover 1248 can include two extenders 1296 that can be selectively coupled to the cabinet 1211, and/or positioned substantially adjacent to and/or selectively coupled to the cover body 1295. Additionally, in such embodiment, the extenders 1296 can have a length such that the two extenders 1296 and the cover body 1295 of the grill cover 1248 cooperate to extend the full width of the structural opening 1211A defined within the cabinet 1211. Alternatively, the grill cover 1248 can include a different number of extenders 1296, and/or each of the extenders 1296 can have a different length. For example, in certain embodiments, in order that the grill cover 1248 of the heater assembly 1226 is able to effectively extend the full width of the structural opening 1211A in multiple, alternative cabinets 1211 having different sizes (i.e. widths) for the structural opening 1211A, the grill cover 1248 can include only one extender 1296, or can include three, four, five, six, seven or eight extenders 1296.

However, it is appreciated that to avoid any undesired complexity, it would generally be preferable that the grill cover 1248 include only one or two extenders 1296 and have the extenders 1296 be sized appropriately (i.e. with sufficient length) for use within the structural opening 1211A of the specific cabinet 1211 within which the heater assembly 1226 is being used. Stated in another manner, it is generally desired that the extenders 1296 be of sufficient length that the use of the one or two extenders 1296 is sufficient to have the grill cover 1248 effectively extend the full width of the structural opening 1211A of the specific cabinet 1211 within which the heater assembly 1226 is being used.

Additionally, it is further appreciated that in order to improve the aesthetic appearance of the electric fireplace 1210, it is generally preferred to have the cover body 1295 of the grill cover 1248, and, thus, the heater body 1245 and the heater assembly 1226 as a whole, substantially centrally positioned within the structural opening 1211A defined within the cabinet 1211. For such reason, it is typically desired that the grill cover 1248 include an even number of extenders 1296 (e.g., two), so that the extenders 1296 can fill up equal spacing relative to the cover body 1295 and/or the heater body 1245 adjacent to each of the cabinet sides 1211S.

With such design as described herein, the heater assembly 1226 can be substantially identical for all potential embodiments of the electric fireplace 1210, with the sole exception of whether or not one or more extenders 1296 are being positioned substantially adjacent to and/or selectively coupled to the cover body 1295, and/or selectively coupled to the cabinet 1211.

FIG. 12B is a partially exploded front perspective view illustration of a portion of the electric fireplace 1210 illustrated in FIG. 12A. In particular, FIG. 12B is a front perspective view of the cabinet 1211, with the extenders 1296 of the grill cover 1248 being in the process of being installed within the structural opening 1211A of the cabinet 1211. As shown, the extenders 1296 are being installed within the structural opening 1211A of the cabinet 1211 and/or coupled to the cabinet 1211 substantially adjacent to the cabinet lip 1211L, and with one of the extenders 1296 being installed substantially adjacent to each of the cabinet sides 1211S. Alternatively, the extenders 1296 can be installed in a different position within the structural opening 1211A of the cabinet 1211. For example, in one such alternative embodiment, each of the extenders 1296 can be positioned substantially adjacent to one of the cabinet sides 1211S and substantially adjacent to the cabinet base 1211E.

Figure 12C:
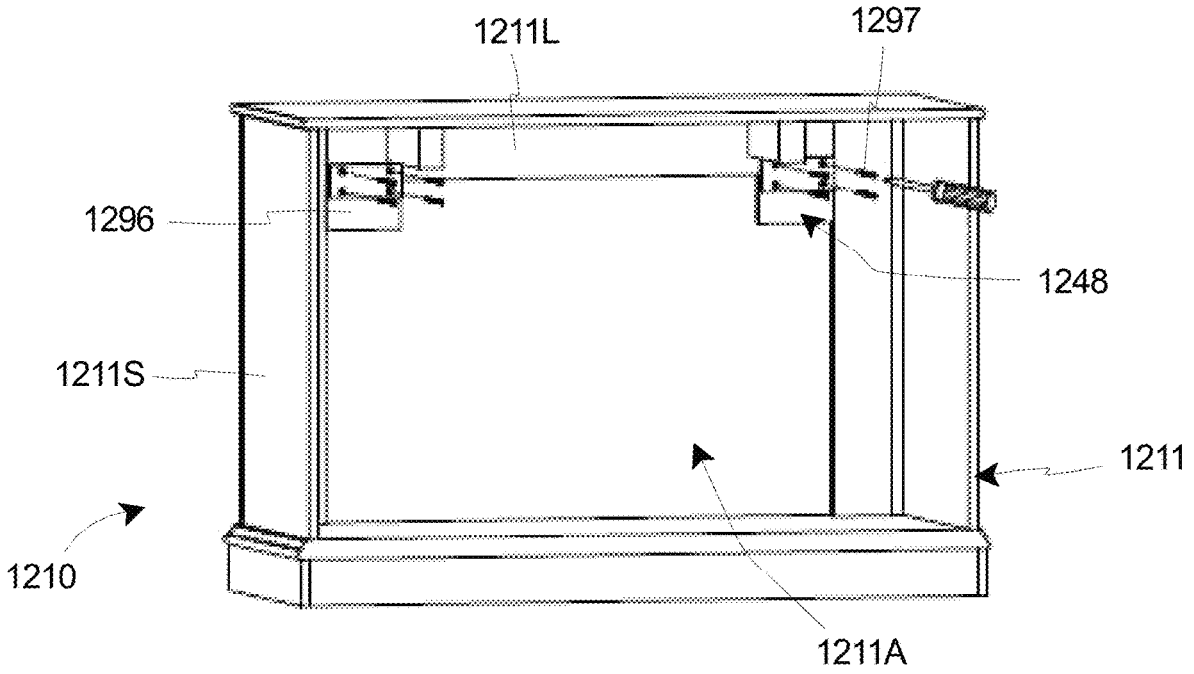
FIG. 12C is a rear perspective view illustration of a portion of the electric fireplace illustrated in FIG. 12A.

FIG. 12C is a rear perspective view illustration of a portion of the electric fireplace 1210 illustrated in FIG. 12A. In particular, FIG. 12C is a rear perspective view of the cabinet 1211, with the extenders 1296 of the grill cover 1248 being installed within the structural opening 1211A of the cabinet 1211 and/or coupled to the cabinet 1211, e.g., substantially adjacent to the cabinet lip 1211L, and with one of the extenders 1296 being installed substantially adjacent to each of the cabinet sides 1211S. The extenders 1296 can be coupled to the cabinet 1211 in any suitable manner. In one embodiment, each of the extenders 1296 can be coupled to the cabinet 1211 with one or more extender attachers 1297 (four extender attachers 1297 are shown for each extender 1296 in FIG. 12C), e.g., screws. As shown, the extender attachers 1297 are being used to attach the extenders 1296 to the cabinet lip 1211L, i.e. to a rear surface of the cabinet lip 1211L in this non-exclusive embodiment. Alternatively, the extenders 1296 can be coupled to the cabinet 1211 in another suitable manner, and/or there can be a different number or design for the extender attachers 1297.

Figure 12D:
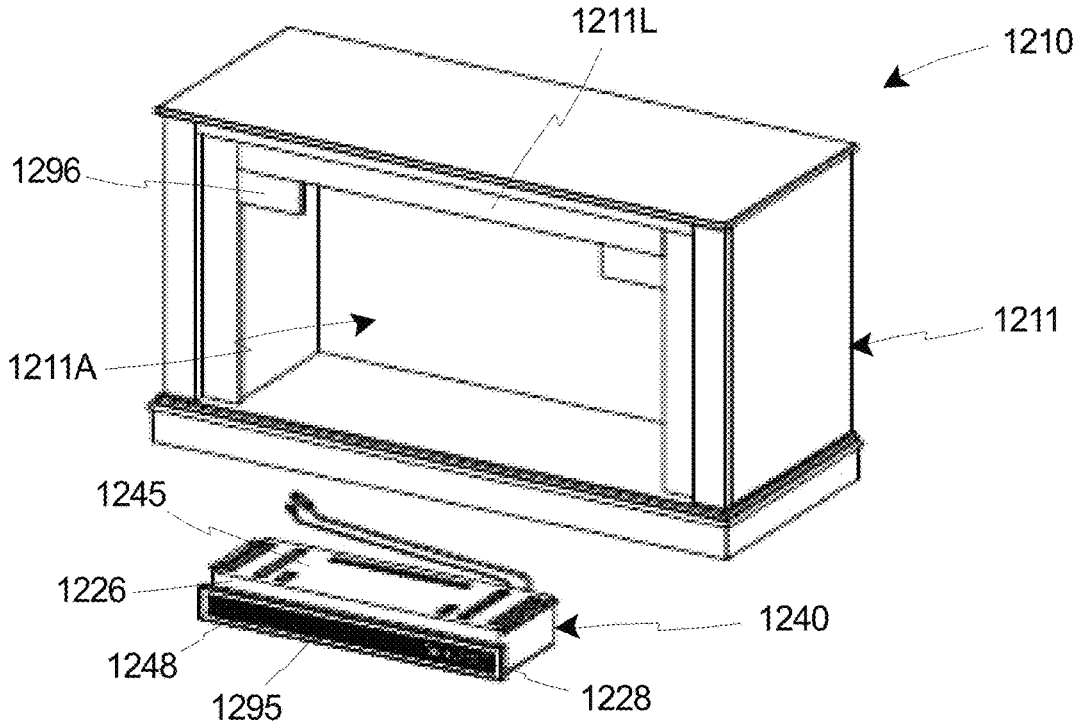
FIG. 12D is a partially exploded front perspective view illustration of the portion of the electric fireplace illustrated in FIG. 12A.

FIG. 12D is a partially exploded front perspective view illustration of the portion of the electric fireplace 1210 illustrated in FIG. 12A. In particular, FIG. 12D is a front perspective view of the cabinet 1211 with the extenders 1296 installed therein and/or coupled thereto, e.g., to the cabinet lip 1211L, and the electrical insert 1240 including the heater assembly 1226 and the controller 1228 positioned spaced apart from the cabinet 1211 prior to installation.

It is appreciated that although FIGS. 12B-12D illustrate the extenders 1296 being installed within the structural opening 1211A of the cabinet 1211 and/or coupled to the cabinet 1211 prior to the installation of the electrical insert 1240, i.e. the heater assembly 1226 and the controller 1228, in other embodiments or applications, the extenders 1296 can be coupled to the electrical insert 1240, e.g., to lateral edges of the cover body 1295 of the grill cover 1248 of the heater assembly 1226, prior to the electrical insert 1240 including the heater assembly 1226 and the controller 1228 being installed within and/or coupled to the cabinet 1211. In such alternative embodiment or application, the electrical insert 1240 including the heater assembly 1226 (heater body 1245, plus grill cover 1248 including cover body 1295 with extenders 1296 attached thereto) and the controller 1228, is installed within and/or coupled to the cabinet 1211 as a fully integral unit.

Figure 12E:
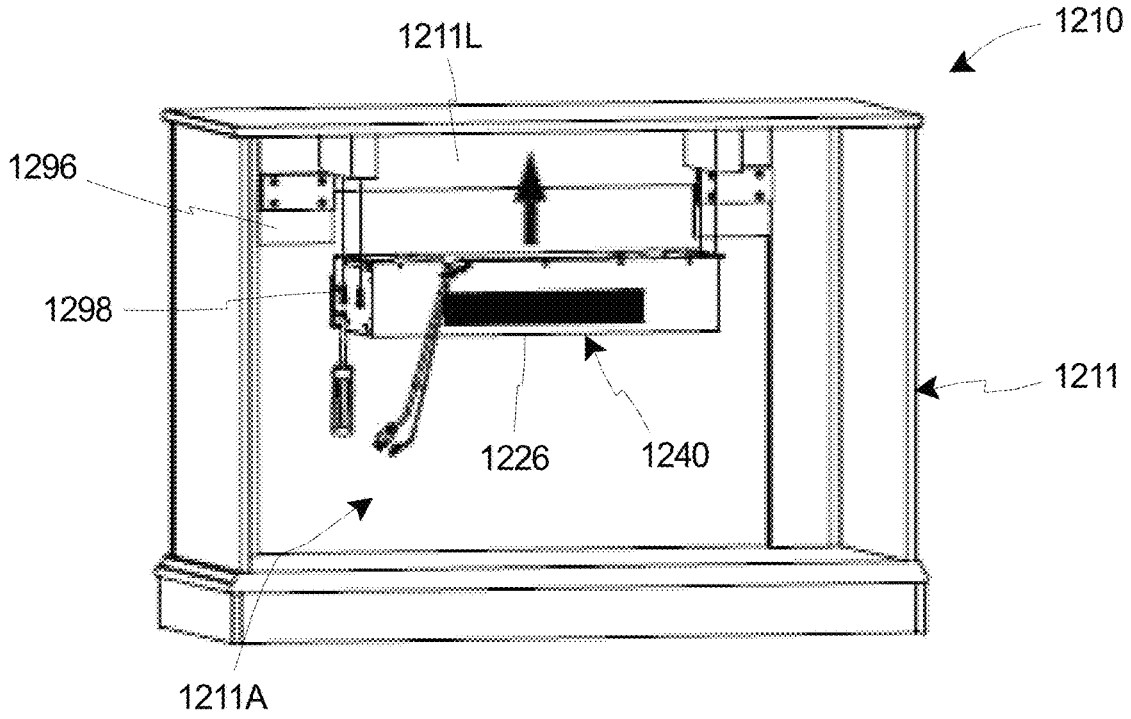
FIG. 12E is a partially exploded rear perspective view illustration of the portion of the electric fireplace illustrated in FIG. 12A.

FIG. 12E is a partially exploded rear perspective view illustration of the portion of the electric fireplace 1210 illustrated in FIG. 12A. In particular, FIG. 12E is a rear perspective view of the cabinet 1211, with the electrical insert 1240 including the heater assembly 1226 in the process of being installed within the structural opening 1211A of the cabinet 1211, i.e. substantially adjacent to the cabinet lip 1211L and the extenders 1296. The electrical insert 1240 and/or the heater assembly 1226 can be installed within and/or coupled to the cabinet 1211 in any suitable manner. For example, as shown, the electrical insert 1240 and/or the heater assembly 1226 can be installed within and/or coupled to the cabinet 1211 with one or more assembly attachers 1298 (four assembly attachers 1298 are shown in FIG. 12E), e.g., screws. Alternatively, the electrical insert 1240 and/or the heater assembly 1226 can be installed within and/or coupled to the cabinet 1211 in another suitable manner.

Additionally, although not specifically shown, the electrical insert 1240 and/or the heater assembly 1226 can also be coupled to the extenders 1296 with one or more extender attachers 1297 (such as extender attachers 1297 shown, for example, in FIG. 12C).

Figure 12F:
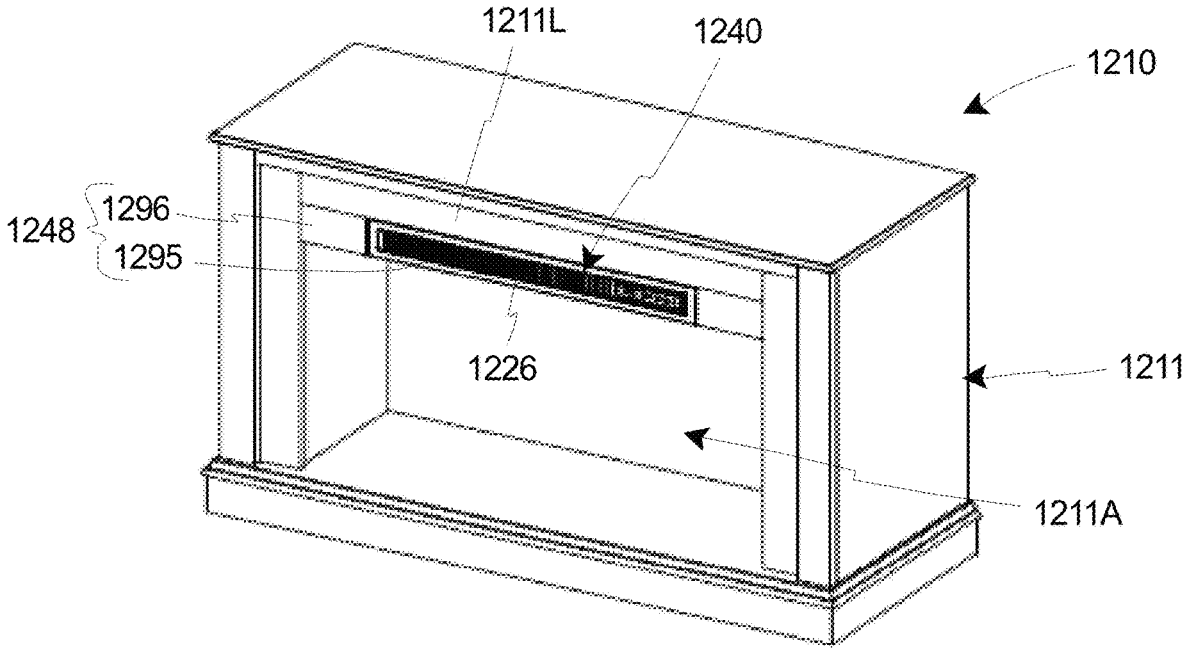
FIG. 12F is a front perspective view illustration of the portion of the electric fireplace illustrated in FIG. 12A.

FIG. 12F is a front perspective view illustration of the portion of the electric fireplace 1210 illustrated in FIG. 12A. In particular, FIG. 12F is a front perspective view of the cabinet 1211 with the electrical insert 1240, including the heater assembly 1226 (i.e. the heater body 1245 (illustrated in FIG. 12A), and the grill cover 1248 (including the cover body 1295 and the extenders 1296)), installed within the structural opening 1211A of the cabinet 1211 and/or coupled to the cabinet 1211. As shown in this embodiment, the electrical insert 1240 and/or the heater assembly 1226 has been installed within and/or coupled to the cabinet 1211 substantially adjacent to the cabinet lip 1211L. More specifically, as illustrated in this embodiment, the electrical insert 1240 and/or the heater assembly 1226 can be wedged in adjacent to the cabinet top 1211T and the cabinet lip 1211L so that the heater assembly 1226 can be relatively easily positioned as desired. Alternatively, the electrical insert 1240 and/or the heater assembly 1226 can be installed within and/or coupled to cabinet 1211 in a different location.

Figure 13A:
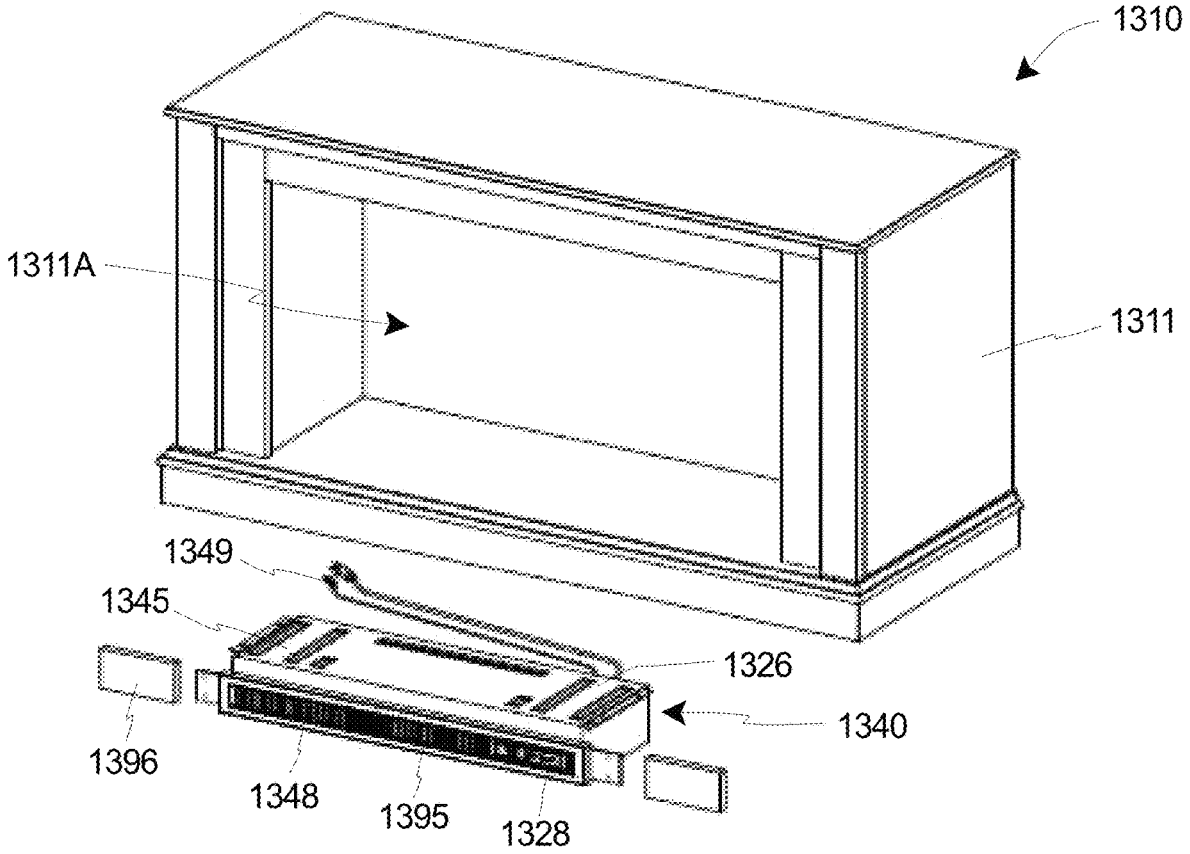
FIG. 13A is a partially exploded front perspective view illustration of a portion of yet another embodiment of the electric fireplace, including yet another embodiment of the heater assembly usable as part of the electric fireplace.

FIG. 13A is a partially exploded front perspective view illustration of a portion of yet another embodiment of the electric fireplace 1310, including yet another embodiment of the heater assembly 1326 usable as part of the electric fireplace 1310. Specifically shown in FIG. 13A are a cabinet 1311 that defines a structural opening 1211A therein, and the heater assembly 1326 that has not yet been installed within the structural opening 1311A of the cabinet 1311. A controller 1328 is also shown as being coupled to and/or incorporated with the heater assembly 1326 as part of the electrical insert 1340. FIG. 13A also shows a portion of an electrical connection assembly 1349 that is usable for providing the necessary power to the electrical components of the electric fireplace 1310, including the heater assembly 1326 and the controller 1328 of the electrical insert 1340.

As shown in this embodiment, the cabinet 1311 is substantially similar to the embodiment illustrated in FIG. 12A. Accordingly, the cabinet 1311 will not be described again in detail. Alternatively, the cabinet 1311 can be designed in a manner similar to any of the cabinets illustrated and described herein.

The electrical insert 1340, including the heater assembly 1326 and the controller 1328, is substantially similar in design and function as embodiments illustrated and described herein above. Additionally, as shown, the heater assembly 1326 includes a heater body 1345 and a grill cover 1348 that are substantially similar to the corresponding components illustrated in FIG. 12A, with the grill cover 1348 again including a cover body 1395 and one or more extenders 1396 (two are shown in FIG. 12A) that can be positioned substantially adjacent to and/or selectively coupled to the cover body 1395, and/or selectively coupled to the cabinet 1311. The cover body 1395 and the extenders 1396 are substantially similar to the previous embodiments. However, in this embodiment, the one or more extenders 1396 are configured to be coupled to the cover body 1395 prior to the heater assembly 1326 being installed within the structural opening 1311A of the cabinet 1311. With such design as described herein, the heater assembly 1326 can be substantially identical for all potential embodiments of the electric fireplace 1310, with the sole exception of whether or not one or more extenders 1396 are being positioned substantially adjacent to and/or selectively coupled to the cover body 1395, and/or selectively coupled to the cabinet 1311.

Figure 13B:
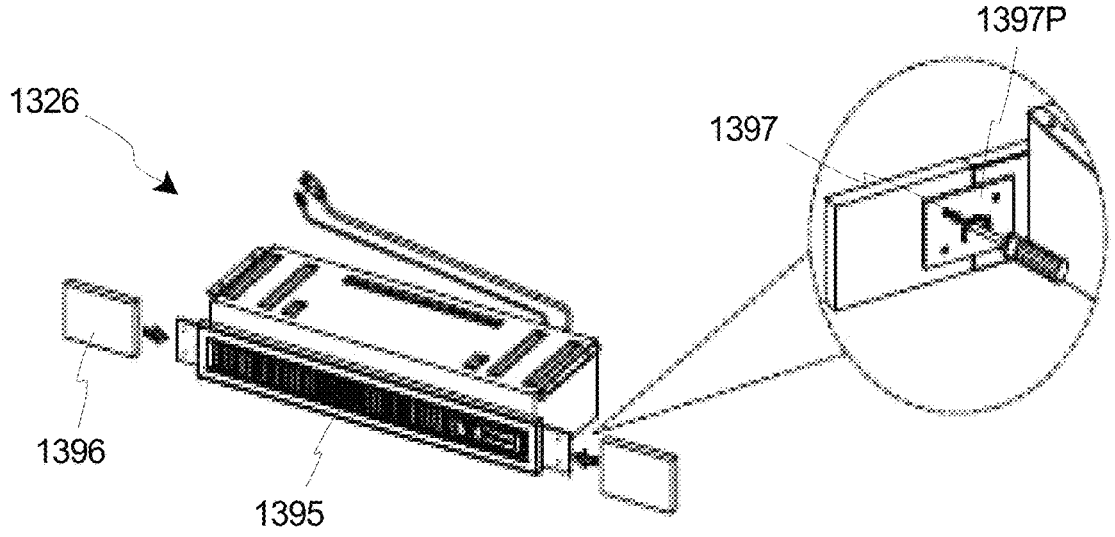
FIG. 13B is a front perspective view illustration of the heater assembly illustrated in FIG. 13A.

FIG. 13B is a front perspective view illustration of the heater assembly 1326 illustrated in FIG. 13A. More particularly, FIG. 13B illustrates the extenders 1396 in the process of being selectively coupled to the cover body 1395. In various embodiments, the extenders 1396 can be configured to be positioned substantially adjacent to and selectively coupled to lateral edges of the cover body 1395.

The extenders 1396 can be selectively coupled to the cover body 1395 in any suitable manner. For example, as shown, the extenders 1396 can be positioned substantially adjacent to and/or positioned to substantially cover or surround a portion of the cover body 1395, and can be selectively coupled to the cover body 1395 with one or more extender attachers 1397, e.g., screws. Additionally, in some embodiments, a separate coupling plate 1397P can be utilized to enhance the desired coupling between the extenders 1396 and the cover body 1395, with at least one of the extender attachers 1397 extending into and/or through the coupling plate 1397P and the extender 1396, and at least one of the extender attachers 1397 extending into and/or through the coupling plate 1397P and the cover body 1395. Alternatively, the extenders 1396 can be selectively coupled to the cover body 1395 in another suitable manner.

Figure 13C:
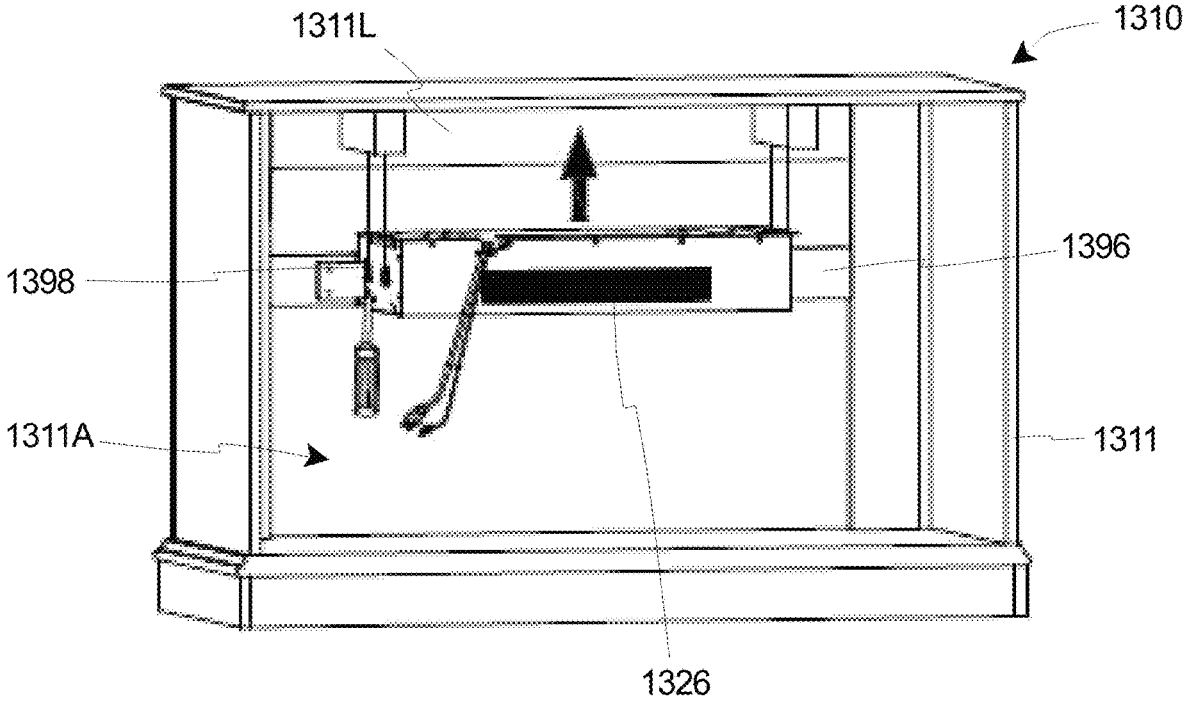
FIG. 13C is rear perspective view illustration of the portion of the electric fireplace illustrated in FIG. 13A.

FIG. 13C is rear perspective view illustration of the portion of the electric fireplace 1310 illustrated in FIG. 13A. In particular, FIG. 13C is a rear perspective view illustration showing the heater assembly 1326, with extenders 1396 included therewith, being installed within the structural opening 1311A of the cabinet 1311, i.e. substantially adjacent to the cabinet lip 1311L in this particular embodiment.

The heater assembly 1326 can be installed within and/or coupled to the cabinet 1311 in any suitable manner. For example, as shown, the heater assembly 1326 can be installed within and/or coupled to the cabinet 1311 with one or more assembly attachers 1398, e.g., screws. Alternatively, the heater assembly 1326 can be installed within and/or coupled to the cabinet 1311 in another suitable manner.

Figure 13D:
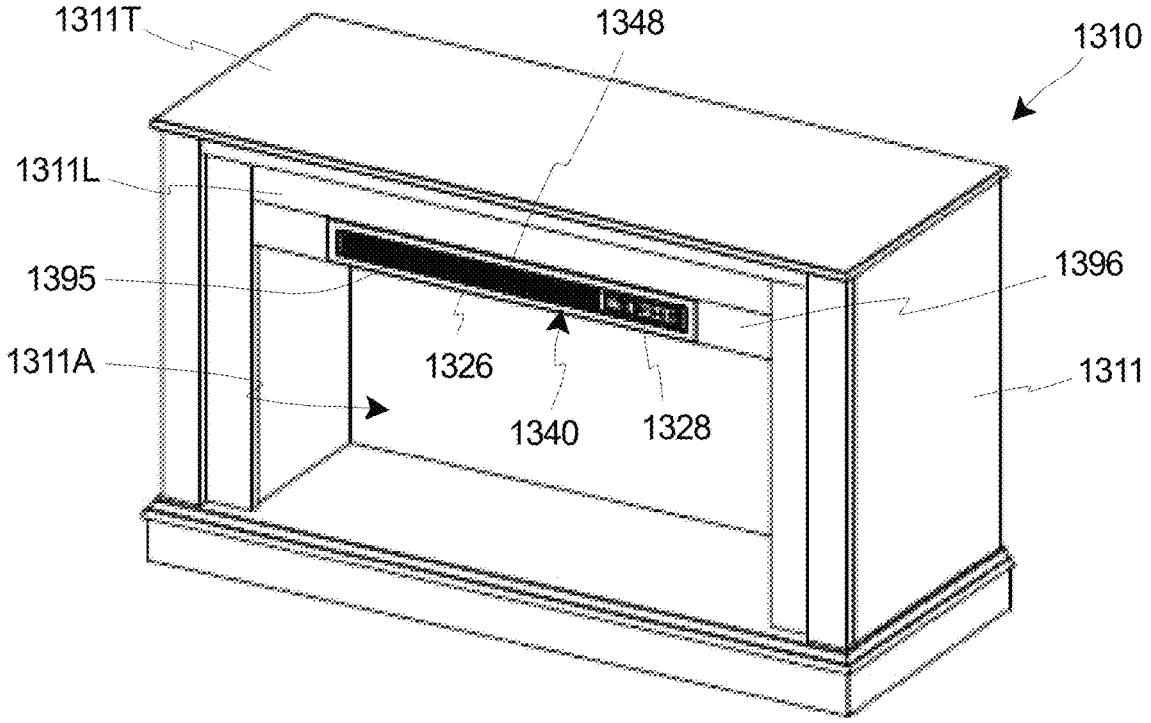
FIG. 13D is a front perspective view illustration of the portion of the electric fireplace illustrated in FIG. 13A.

FIG. 13D is a front perspective view illustration of the portion of the electric fireplace 1310 illustrated in FIG. 13A. In particular, FIG. 13D is a front perspective view of the cabinet 1311 with the electrical insert 1340, including the heater assembly 1326 (i.e. the heater body 1345 (illustrated in FIG. 13A), and the grill cover 1348 (including the cover body 1395 and the extenders 1396)), installed within the structural opening 1311A of the cabinet 1311 and/or coupled to the cabinet 1311. As shown in this embodiment, the electrical insert 1340 and/or the heater assembly 1326 has been installed within and/or coupled to the cabinet 1311 substantially adjacent to the cabinet lip 1311L. More specifically, as illustrated in this embodiment, the electrical insert 1340 and/or the heater assembly 1326 can be wedged in adjacent to the cabinet top 1311T and the cabinet lip 1311L so that the heater assembly 1326 can be relatively easily positioned as desired. Alternatively, the electrical insert 1340 and/or the heater assembly 1326 can be installed within and/or coupled to cabinet 1311 in a different location.

Figure 14A:
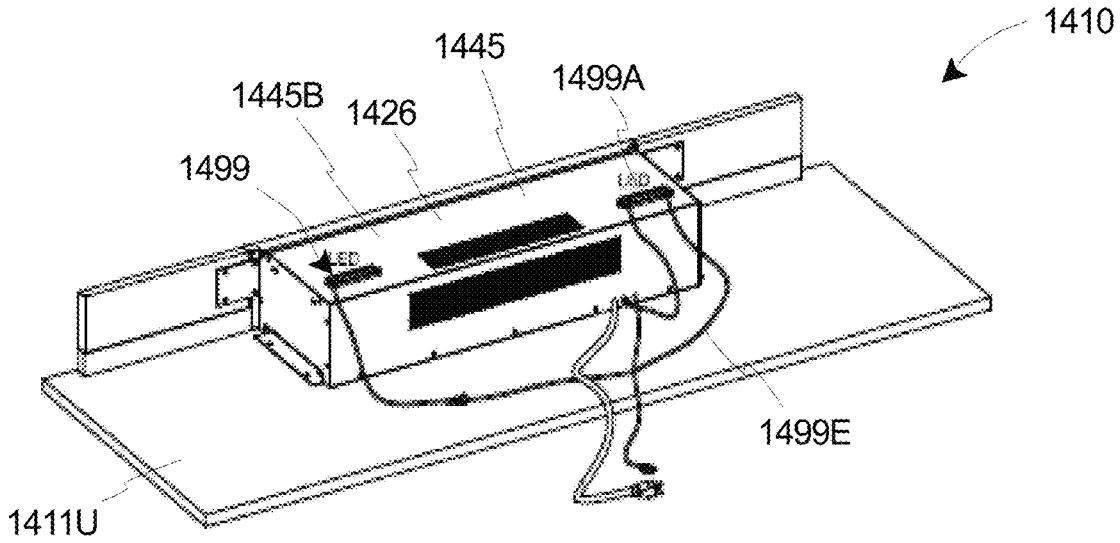
FIG. 14A is a bottom perspective view illustration of a portion of still another embodiment of the electric fireplace, including an embodiment of a downlight assembly usable as part of the electric fireplace.

FIG. 14A is a bottom perspective view illustration of a portion of still another embodiment of the electric fireplace 1410, including an embodiment of a downlight assembly 1499 usable as part of the electric fireplace 1410. As described herein, the downlight assembly 1499 is configured to shine light in a generally downward direction from a downlight light source 1499A to provide a glowing effect for the fireplace housing 1412 (illustrated in FIG. 14B) and/or the structural opening 1411A (illustrated in FIG. 14B) of the cabinet 1411 (illustrated in FIG. 14B) within which the electric fireplace 1410 is installed.

The design of the downlight assembly 1499 can be varied. In the embodiment illustrated in FIG. 14A, the downlight assembly 1499 includes the downlight light source 1499A that is mounted on and/or coupled to the heater assembly 1426, i.e. to a bottom surface 1445B of the heater body 1445. As shown, the downlight assembly 1499 further includes downlight electrical connectors 1499E that can be included as part of the electrical connection assembly 249 (illustrated in FIG. 2) to ensure that electrical power is effectively provided to the downlight light source 1499A. In certain embodiments, the downlight electrical connectors 1499E can be selectively, electrically coupled to the heater assembly 1426 so that when electrical power is provided to the heater assembly 1426, the downlight electrical connectors 1499E enable electrical power to simultaneously be provided to the downlight light source 1499A.

The downlight light source 1499A can have any suitable design. For example, in one non-exclusive alternative embodiment, the downlight light source 1499A can include a flat, PCB board upon which is mounted an LED panel having one or more LED light bulbs. It is appreciated that the use of LED light bulbs makes it generally unnecessary to access the downlight light source 1499A as the LED light bulbs have a very long, life span and do not need to be regularly replaced. Alternatively, the downlight light source 1499A can have another suitable design, e.g., can include other types of light bulbs or another type of light source.

Additionally, in certain embodiments, the downlight light source 1499A can be programmed to undulate and/or pulse, such as being sequenced to follow one or more other features or components of the electric fireplace 1410. In one embodiment, the controller 28 (illustrated in FIG. 1) can be configured to control at least a timing, a pulsing and/or a magnitude of the light being generated by the downlight light source 1499A to more effectively generate a realistic flickering, glowing effect within the fireplace housing 1412 and/or structural opening 1411A of the cabinet 1411.

The downlight light source 1499A can be positioned in any suitable manner in order to effectively direct the light in a generally downward direction to provide the desired glowing effect for the fireplace housing 1412 and/or the structural opening 1411A of the cabinet 1411 within which the electric fireplace 1410 is installed. For example, in various embodiments, the downlight light source 1499A can be mounted on and/or coupled to any generally downward facing surface near an upper portion of the structural opening 1411A and/or the fireplace housing 1412. In this embodiment, as noted above, the downlight light source 1499A can be mounted on and/or coupled to the heater assembly 1426, i.e. to a bottom surface 1445B of the heater body 1445. Alternatively, in another non-exclusive embodiment, the downlight light source 1499A can be mounted on a bottom surface 1411U of a cabinet top 1411T (illustrated in FIG. 14B) and/or a cabinet center shelf so that the desired light shines in the desired downward direction. Still alternatively, the downlight light source 1499A can be positioned in a different manner.

Figure 14B:
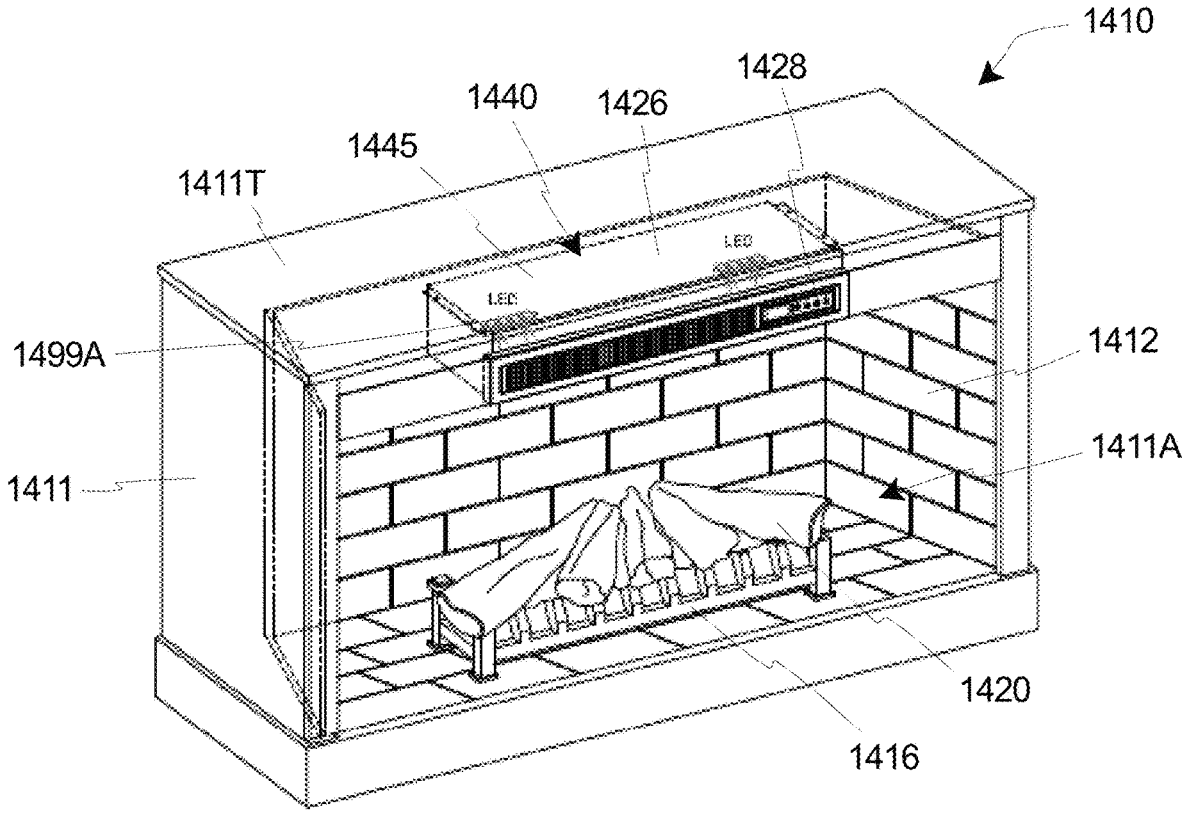
FIG. 14B is a front perspective view illustration of the electric fireplace illustrated in FIG. 14A.

FIG. 14B is a front perspective view illustration of the electric fireplace 1410 illustrated in FIG. 14A. In particular, FIG. 14B illustrates the cabinet 1411 having the structural opening 1411A defined therein, and the fireplace housing 1412, the grate 1416, the one or more simulated logs 1420, and the electrical insert 1440, including the heater assembly 1426 and the controller 1428, having been installed within the structural opening 1411A. As illustrated, the heater assembly 1426 is mounted on and/or coupled to the bottom surface 1411U (illustrated in FIG. 14A) of the cabinet top 1411T, and the downlight light source 1499A is coupled to the bottom surface 1445B (illustrated in FIG. 14A) of the heater body 1445. Alternatively, the downlight light source 1499A can be positioned in another suitable manner.

Figure 15A:
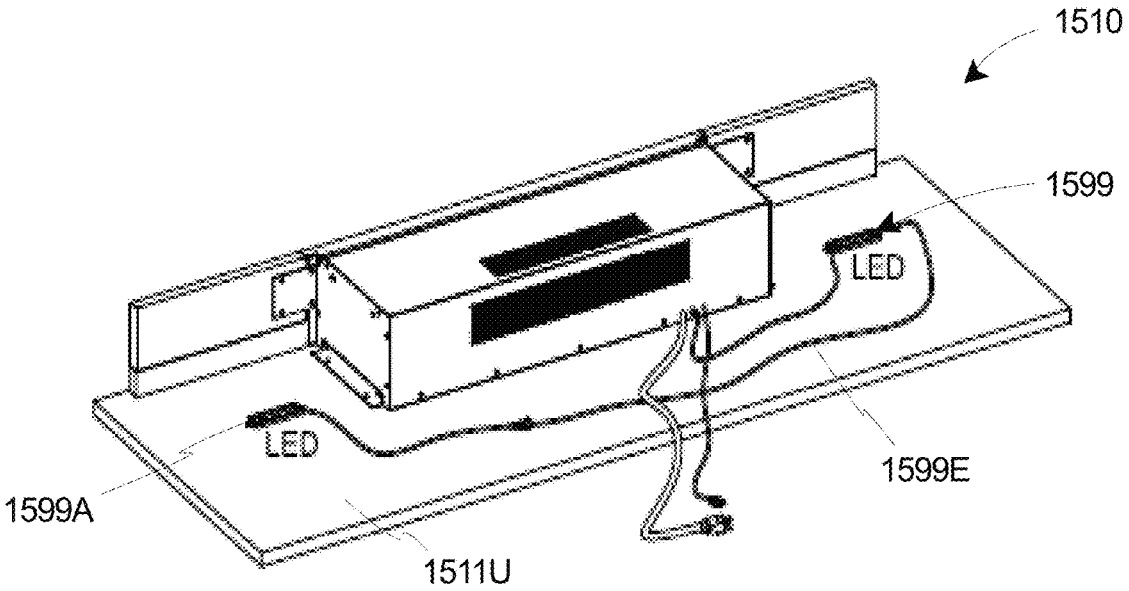
FIG. 15A is a bottom perspective view illustration of still yet another embodiment of the electric fireplace, including another embodiment of the downlight assembly.

FIG. 15A is a bottom perspective view illustration of still yet another embodiment of the electric fireplace 1510, including another embodiment of the downlight assembly 1599 usable as part of the electric fireplace 1510. The downlight assembly 1599 is substantially similar in design and function to the downlight assembly 1499 illustrated and described in relation to FIG. 14A. For example, the downlight assembly 1599 again includes a downlight light source 1599A that is configured to shine light in a generally downward direction from a downlight light source 1599A to provide a glowing effect for the fireplace housing 1512 (illustrated in FIG. 15B) and/or the structural opening 1511A (illustrated in FIG. 15B) of the cabinet 1511 (illustrated in FIG. 15B) within which the electric fireplace 1510 is installed; and downlight electrical connectors 1599E that can be included as part of the electrical connection assembly 249 (illustrated in FIG. 2) to ensure that electrical power is effectively provided to the downlight light source 1599A. As with the previous embodiment, the downlight electrical connectors 1599E can be selectively, electrically coupled to the heater assembly 1526 so that when electrical power is provided to the heater assembly 1526, the downlight electrical connectors 1599E enable electrical power to simultaneously be provided to the downlight light source 1599A.

The downlight light source 1599A can have any suitable design. For example, in one non-exclusive alternative embodiment, the downlight light source 1599A can include a flat, PCB board upon which is mounted an LED panel having one or more LED light bulbs. It is appreciated that the use of LED light bulbs makes it generally unnecessary to access the downlight light source 1599A as the LED light bulbs have a very long, life span and do not need to be regularly replaced. Alternatively, the downlight light source 1599A can have another suitable design, e.g., can include other types of light bulbs or another type of light source.

Additionally, in certain embodiments, the downlight light source 1599A can be programmed to undulate and/or pulse, such as being sequenced to follow one or more other features or components of the electric fireplace 1510. In one embodiment, the controller 28 (illustrated in FIG. 1) can be configured to control at least a timing, a pulsing and/or a magnitude of the light being generated by the downlight light source 1599A to more effectively generate a realistic flickering, glowing effect within the fireplace housing 1512 and/or structural opening 1511A of the cabinet 1511.

However, in this embodiment, the downlight light source 1599A is positioned in a different manner than in the previous embodiment. More specifically, as shown, the downlight light source 1599A is mounted on a bottom surface 1511U of a cabinet top 1511T (illustrated in FIG. 15B) and/or a cabinet center shelf so that the desired light shines in the desired downward direction.

Figure 15B:
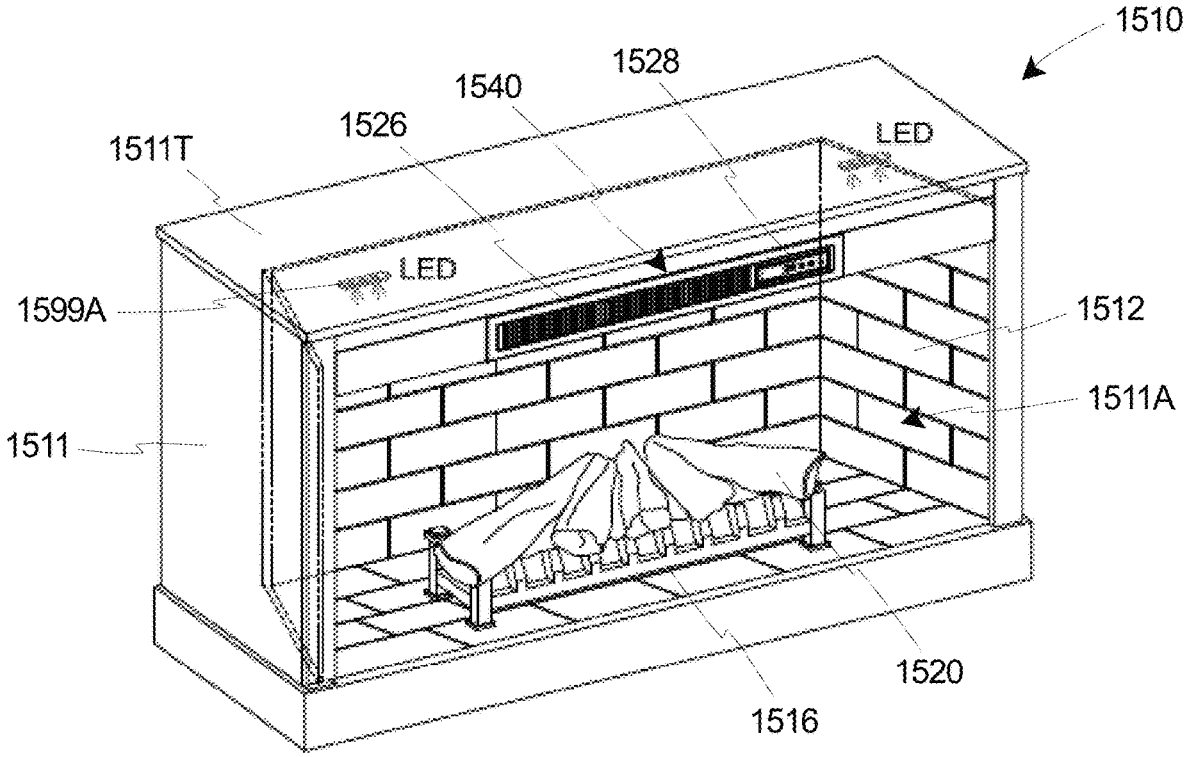
FIG. 15B is a front perspective view illustration of the electric fireplace illustrated in FIG. 15A.
Figure 16A:
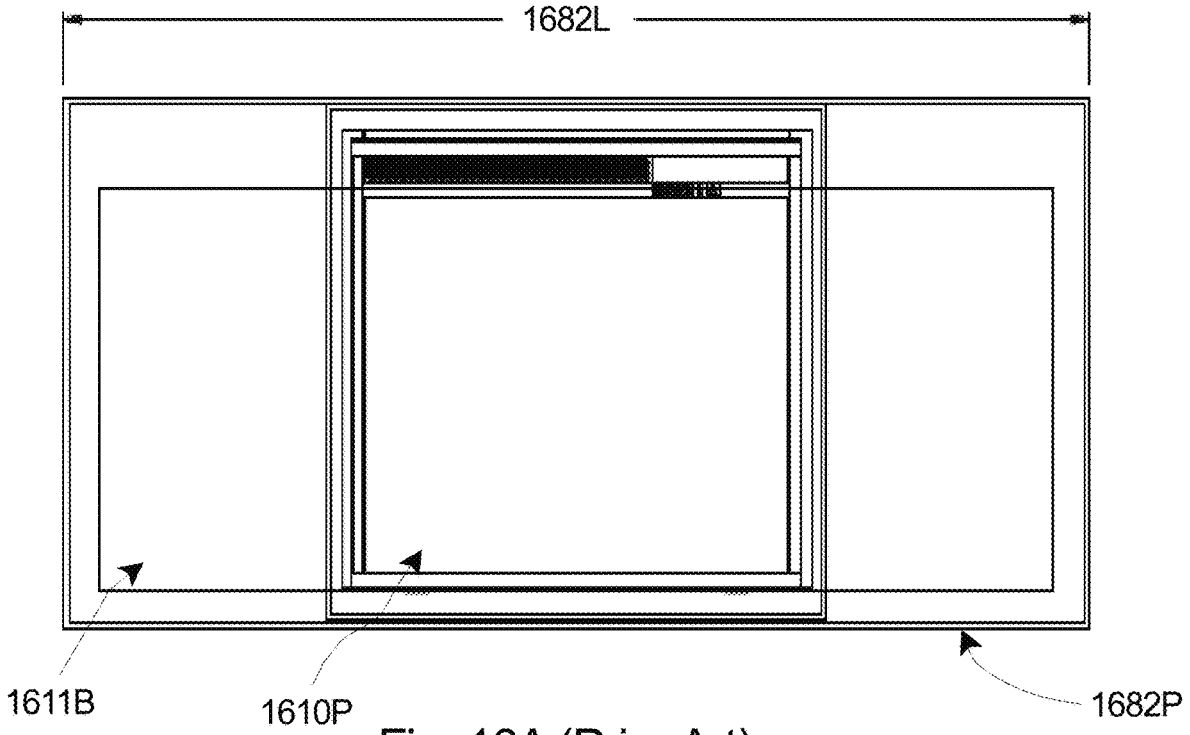
Fig. 16A (Prior Art)
FIG. 16A is a simplified side view illustration of a prior art embodiment of an electric fireplace and a cabinet assembly, and a package assembly that can be utilized to contain the electric fireplace and the cabinet assembly.
Figure 16B:
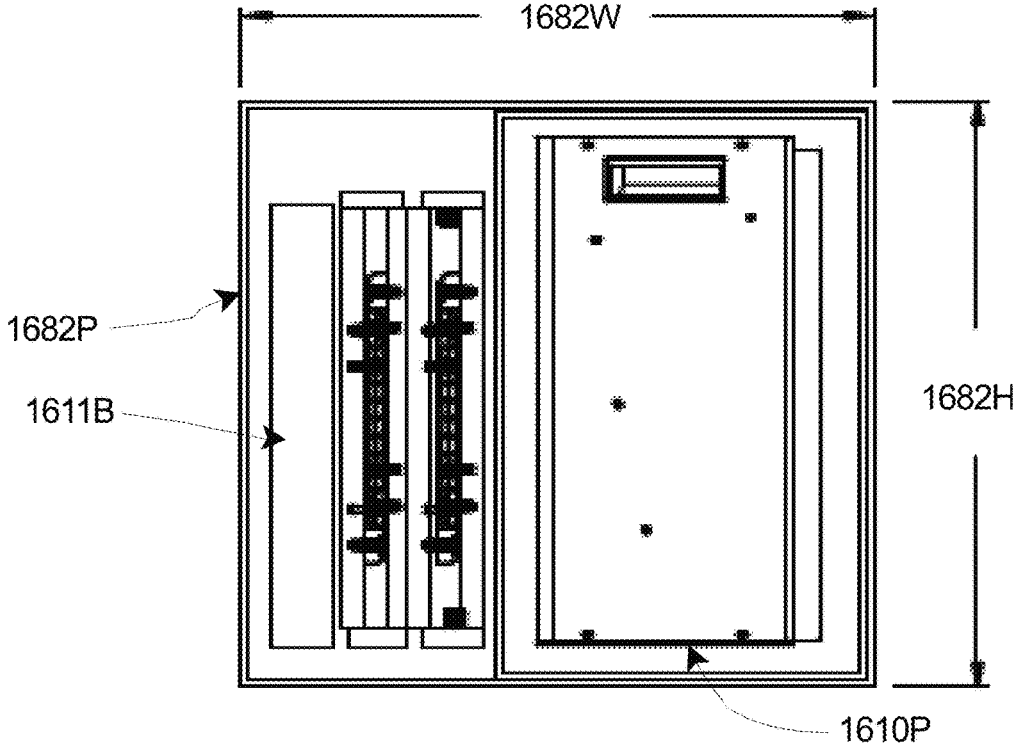
Fig. 16B (Prior Art)
FIG. 16B is a simplified end view illustration of the prior art electric fireplace, modular cabinet assembly and package assembly illustrated in FIG. 16A.

FIG. 15B is a front perspective view illustration of the electric fireplace 1510 illustrated in FIG. 15A. In particular, FIG. 15B illustrates the cabinet 1511 having the structural opening 1511A defined therein, and the fireplace housing 1512, the grate 1516, the one or more simulated logs 1520, and the electrical insert 1540, including the heater assembly 1526 and the controller 1528, having been installed within the structural opening 1511A. As illustrated, the heater assembly 1526 is mounted on and/or coupled to the bottom surface 1511U (illustrated in FIG. 15A) of the cabinet top 1511T. Additionally, the downlight light source 1599A is also mounted on and/or coupled to the bottom surface 1511U of the cabinet top 1511T. Alternatively, the downlight light source 1599A can be positioned in another suitable manner.

It is understood that although a number of different embodiments of the electric fireplace 10 have been illustrated and described herein, one or more features of any one embodiment can be combined with one or more features of one or more of the other embodiments, provided that such combination satisfies the intent of the present invention.

While a number of exemplary aspects and embodiments of the electric fireplace 10 have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A method for installing an electric fireplace by a user into a structural opening of a cabinet, the method comprising the steps of:

providing a modular electric fireplace to the user, the modular electric fireplace including (i) a heater assembly that is configured to provide heated air, the heater assembly including a heater body, and a first extender; and (ii) an electric, flame generator that is configured to generate a simulated flame;

installing and coupling the heater body and the first extender to the cabinet independent of the flame generator; and installing the flame generator into the structural opening independent of the heater body and the first extender.

2. The method of claim 1 wherein the structural opening has a width, and wherein the step of installing and coupling the heater assembly and the first extender to the cabinet includes the first extender being positioned between the heater assembly and the cabinet along the width of the structural opening.

3. The method of claim 1 wherein the step of providing a modular electric fireplace includes the heater assembly having a grill cover that is positioned over the heater body and the first extender.

4. The method of claim 3 wherein the step of providing a modular electric fireplace includes the heater body having a body length and the grill cover having a cover length that is greater than the body length.

5. The method of claim 1 wherein the step of installing the flame generator includes positioning the flame generator below the heater assembly in the cabinet.

6. The method of claim 1 wherein the step of providing a modular electric fireplace includes providing a panel; and the method further comprising the step of coupling the panel to the cabinet independently of the heater assembly and the flame generator.

7. The method of claim 1 wherein the step of electrically connecting includes electrically connecting the flame generator to the heater body with a connector cable after the flame generator and the heater body have been positioned within the structural opening of the cabinet.

8. The method of claim 7 wherein the step of providing a modular electric fireplace includes providing a simulated log and a grate configured to support the simulated log; and the method further comprising the step of installing the grate and simulated log into the structural opening independently of the heater body; wherein the connector cable is coupled to the grate.

9. The method of claim 1 wherein the step of providing a modular electric fireplace includes the heater assembly having a second extender, and wherein the first extender and the second extender are secured to the cabinet on opposite sides of the heater body.

10. A modular electric fireplace that is configured to be installed by a user into a structural opening of a cabinet, the modular electric fireplace comprising:

a heater assembly that is configured to provide heated air, the heater assembly including a heater body, and a first extender; and an electric, flame generator that is configured to generate a simulated flame;

wherein the heater body and the first extender are configured to be installed and attached to the cabinet independent of the flame generator; and wherein the flame generator is configured to be installed and attached to the cabinet independent of the heater body and the first extender.

11. The modular electric fireplace of claim 10 wherein the structural opening has a width, and wherein first extender is positioned between the heater assembly and the cabinet along the width of the structural opening.

12. The modular electric fireplace of claim 10 wherein the heater assembly includes a grill cover that is positioned over the heater body and the first extender.

13. The modular electric fireplace of claim 12 wherein the heater body has a body length and the grill cover having a cover length that is greater than the body length.

14. The modular electric fireplace of claim 10 wherein the flame generator is positioning below the heater assembly in the structural opening.

15. The modular electric fireplace of claim 10 further comprising a panel that is configured to be coupled to the cabinet independently of the heater assembly and the flame generator.

16. The modular electric fireplace of claim 10 further comprising a connector cable that is configured to electrically connect the flame generator to the heater body after the flame generator and the heater body have been positioned within the structural opening.

17. The modular electric fireplace of claim 16 further comprising a simulated log and a grate configured to support the simulated log; wherein the simulated log and the grate are configured to be installed into the structural opening independently of the heater body.

18. The modular electric fireplace of claim 17 wherein the flame generator is incorporated into the grate, and wherein the connector cable is coupled to the grate.

19. The modular electric fireplace of claim 10 further comprising a second extender, and wherein the first extender and the second extender are configured to be secured to the cabinet on opposite sides of the heater body.

20. The modular electric fireplace of claim 10 further comprising a downlight light source that is configured to direct light in a downward direction from the heater body.

* * * * *